US011156082B2

(12) United States Patent
Li et al.

(10) Patent No.: US 11,156,082 B2
(45) Date of Patent: Oct. 26, 2021

(54) DOWNHOLE CHARACTERIZATION OF FORMATION PRESSURE

(71) Applicant: Schlumberger Technology Corporation, Sugar Land, TX (US)

(72) Inventors: Jiyao Li, Piermont, NY (US); Terizhandur S. Ramakrishnan, Boxborough, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 220 days.

(21) Appl. No.: 16/014,475

(22) Filed: Jun. 21, 2018

(65) Prior Publication Data

US 2018/0371902 A1 Dec. 27, 2018

Related U.S. Application Data

(60) Provisional application No. 62/523,146, filed on Jun. 21, 2017.

(51) Int. Cl.
*E21B 49/00* (2006.01)
*E21B 49/08* (2006.01)
*E21B 47/06* (2012.01)

(52) U.S. Cl.
CPC ..... *E21B 49/008* (2013.01); *E21B 47/06* (2013.01); *E21B 49/084* (2013.01); *E21B 49/088* (2013.01); *E21B 49/0875* (2020.05)

(58) Field of Classification Search
CPC ..... E21B 49/008; E21B 47/06
See application file for complete search history.

(56) References Cited

U.S. PATENT DOCUMENTS 3,742,443 A 6/1973 Foster et al.
2005/0171699 A1* 8/2005 Zazovsky ..... E21B 49/008 702/11
2005/0257960 A1* 11/2005 McGregor ..... E21B 49/10 175/24

(Continued)

OTHER PUBLICATIONS

Cannistraci, Median Modified Wiener Filter for nonlinear adaptive spatial denoising of protein NMR multidimensional spectra, Scientific Reports | 5 : 8017 (Year: 2015).*

(Continued)

*Primary Examiner* — Michael J Dalbo
(74) *Attorney, Agent, or Firm* — Trevor G. Grove

(57) ABSTRACT

A method includes operating a downhole acquisition tool in a wellbore in a geological formation and performing formation testing to determine at least one measurement associated within the formation, the wellbore, or both. The tool may include sensors to detect measurements including, for example, formation pressure and/or wellbore pressure. The tool may also include a processor to obtain at least one spectral characteristic associated with the measurement, which may include frequencies of oscillation. The processor may also determine one or more parameters, associated with an oscillation suppression process, based on the spectral characteristic and remove oscillations, including noise associated with fluctuations of a fluid level in the wellbore, in the measurement based on the parameters. Petrophysical parameters may be estimated based on the modified measurement.

5 Claims, 49 Drawing Sheets

(56) References Cited

U.S. PATENT DOCUMENTS

| | | | | |
|---|---|---|---|---|
| 2007/0192031 | A1* | 8/2007 | Li | E21B 47/18 702/6 |
| 2007/0198192 | A1 | 8/2007 | Hsu et al. | |
| 2009/0030614 | A1* | 1/2009 | Carnegie | G01V 1/48 702/6 |
| 2009/0283265 | A1 | 11/2009 | Maxit et al. | |
| 2013/0028327 | A1 | 1/2013 | Narroschke et al. | |
| 2015/0218937 | A1* | 8/2015 | Conn | E21B 47/01 367/83 |
| 2017/0328199 | A1* | 11/2017 | Marsh | F04B 47/02 |
| 2017/0356944 | A1* | 12/2017 | George | G10L 21/0208 |
| 2018/0203151 | A1 | 7/2018 | Kouchmeshky et al. | |
| 2018/0371903 | A1 | 12/2018 | Li et al. | |

OTHER PUBLICATIONS

Brand, The pi theorem of dimensional analysis, Archive of Rational mechanics and analysis, 1(1), 35-45, 1957 (11 pages).

D.J.H. Moore and D.J. Parke, On nonlinear filters involving transformation of the time variable. IEEE Transations on Information theory, 19(4), 415-422, 1973.

Office Action received in U.S. Appl. No. 16/014,543 dated Apr. 17, 2020 (16 pages).

Office Action received in U.S. Appl. No. 16/014,543 dated Oct. 29, 2020 (17 pages).

Office Action received in U.S. Appl. No. 16/014,543 dated Feb. 19, 2021, (22 pages).

* cited by examiner

DOWNHOLE CHARACTERIZATION OF FORMATION PRESSURE

BACKGROUND

This disclosure relates to downhole measurement of formation pressure.

This section is intended to introduce the reader to various aspects of art that may be related to various aspects of the present techniques. These are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Formation testing may be used to better understand a hydrocarbon reservoir. Indeed, formation testing may be used to measure and model properties within the reservoir to determine a quantity and/or quality of formation fluids such as liquid and/or gas hydrocarbons, condensates, drilling muds, fluid contacts, and so forth, providing much useful information about the reservoir. This may allow operators to better assess the economic value of the reservoir, infer completion strategies, develop reservoir development plans, and identify hydrocarbon production concerns for the reservoir. For a given reservoir, possible reservoir models may have different degrees of accuracy. The accuracy of the reservoir model may impact plans for future well operations, such as completions, injection strategies, production logging operations, enhanced oil recovery, and well testing. The more accurate the reservoir model, the greater the likely value of future well operations to the operators producing hydrocarbons from the reservoir.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method includes operating a downhole acquisition tool in a wellbore in a geological formation and performing formation testing to determine at least one measurement associated within the formation, the wellbore, or both. The tool may include sensors to detect measurements including, for example, formation pressure and/or wellbore pressure. The tool may also include a processor to obtain at least one spectral characteristic associated with the measurement, which may include frequencies of oscillation. The processor may also determine one or more parameters, associated with an oscillation suppression process, based on the spectral characteristic and remove oscillations, including noise associated with fluctuations of a fluid level in the wellbore, in the measurement based on the parameters. Petrophysical parameters may be estimated based on the modified measurement.

In another example, one or more tangible, non-transitory, machine-readable media includes instructions to receive at least one measurement of a geological formation, a wellbore, or both, as measured by a downhole acquisition tool in the wellbore in the geological formation. The measurement may include oscillations associated with changes in an amount of the fluid within the wellbore. The measurement may include a formation pressure, wellbore pressure, or both. The instructions may also include determining one or more parameters associated with an oscillation suppression process based on a spectral characteristic, which may include frequencies of oscillation of measurement. The instructions may also include removing oscillations in the measurement based on the parameters to generate a modified measurement and estimating at least one petrophysical property of the geological formation, the wellbore, or both, based on the modified measurement.

In another example, a system includes a downhole acquisition tool including one or more sensors to measure at least one measurement of a geological formation of a hydrocarbon reservoir, a wellbore within the geological formation, or both. The measurement may include oscillations corresponding to a mud-cake permeability and a pressure or a frequency spectrum of the pressure. The system may also include a data processing system including one or more tangible, non-transitory, machine-readable media including instructions to receive the measurement from the downhole acquisition tool and determine one or more parameters associated with an oscillation suppression process based on measurement. The data processing system may also include instructions to attenuate one or more frequencies associated with the oscillations in the measurement and retain frequency components of the measurement having an amplitude above a threshold amplitude to generate a modified measurement. The instructions may also include estimating a formation production parameter based on the modified measurement, which may be a pressure measurement.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
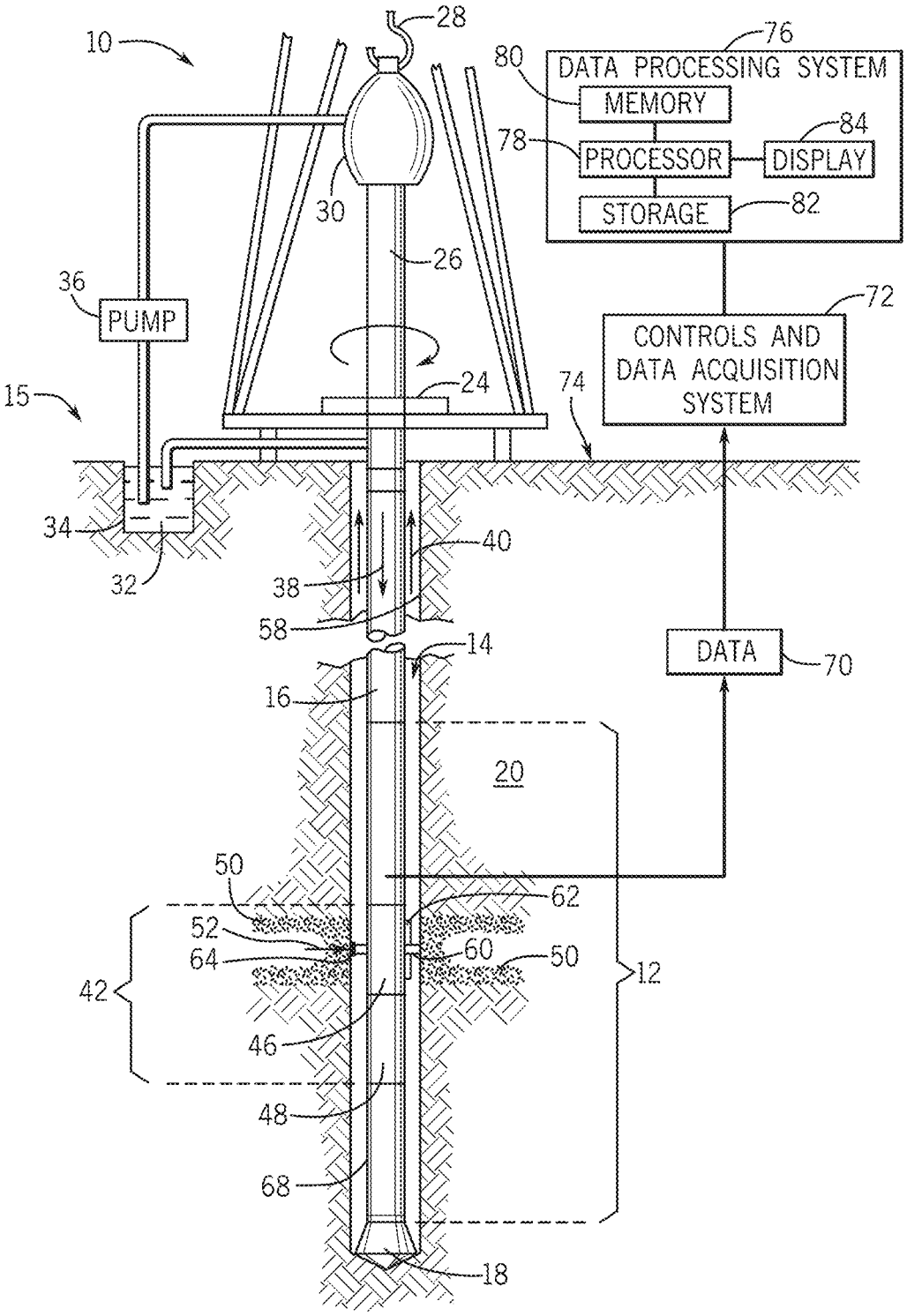
FIG. 1 is a schematic diagram of a wellsite system that may employ downhole fluid analysis for determining fluid properties of a reservoir, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Acquisition and analysis representative of a geological formation downhole and/or wellbore (e.g., pressure and permeability) in delayed or real time may be used in reservoir characterization, management, forecasting, and performance analysis. In certain downhole formation-testing applications, it may be desirable to increase production pump-out rate of reservoir fluids within the reservoir during the downhole formation testing. The inability of the wellbore, also known as a borehole, to accommodate this influx necessitates mixing the formation fluid with the circulating mud for removal from the wellbore. Accordingly, removal of the reservoir fluid may be dependent on the fluid level of the circulating mud within the wellbore, which is required to be maintained within a desired safe range. However, variations in the fluid level of the mud circulating through the wellbore may create pressure fluctuations (e.g., pressure oscillations) that result in noisy pressure measurements that may affect the accuracy of formation pressure estimated based on the pressure measurements.

Overpressured mud within the wellbore may cause the mud filtrate to infiltrate the formation and deposit a mud-cake on the wellbore surface. Mud-cake permeability is much lower than formation permeability, suppressing pressure communication between the wellbore and formation fluids. However, the circulation of mud and pumped-out formation fluid with the wellbore may hinder mud-cake growth. Thus, any fluctuations in the wellbore is communicated to the formation, though muted. It has been recognized that removing the noise in formation pressure by applying proper filters could give more accurate estimation of the formation pressure. Conversely, fluctuation noises transferred from the wellbore into the formation may be utilized to estimate petrophysical properties of the formation and the mud-cake. Accordingly, embodiments of the present disclosure include techniques for removing the pressure oscillations using filters. Additionally, embodiments of the present disclosure include techniques for determining petrophysical properties of the geological formation based on a frequency response of the formation pressure. The frequency response of the formation pressure may allow assessment of parameters associated with a diffusion time across the mud-cake and a mobility ratio of the geological formation to the mud-cake. These parameters may be useful in determining the permeability of the geological formation and/or the mud-cake, and may facilitate characterization of the productivity of the reservoir in the geological formation.

Figure 2:
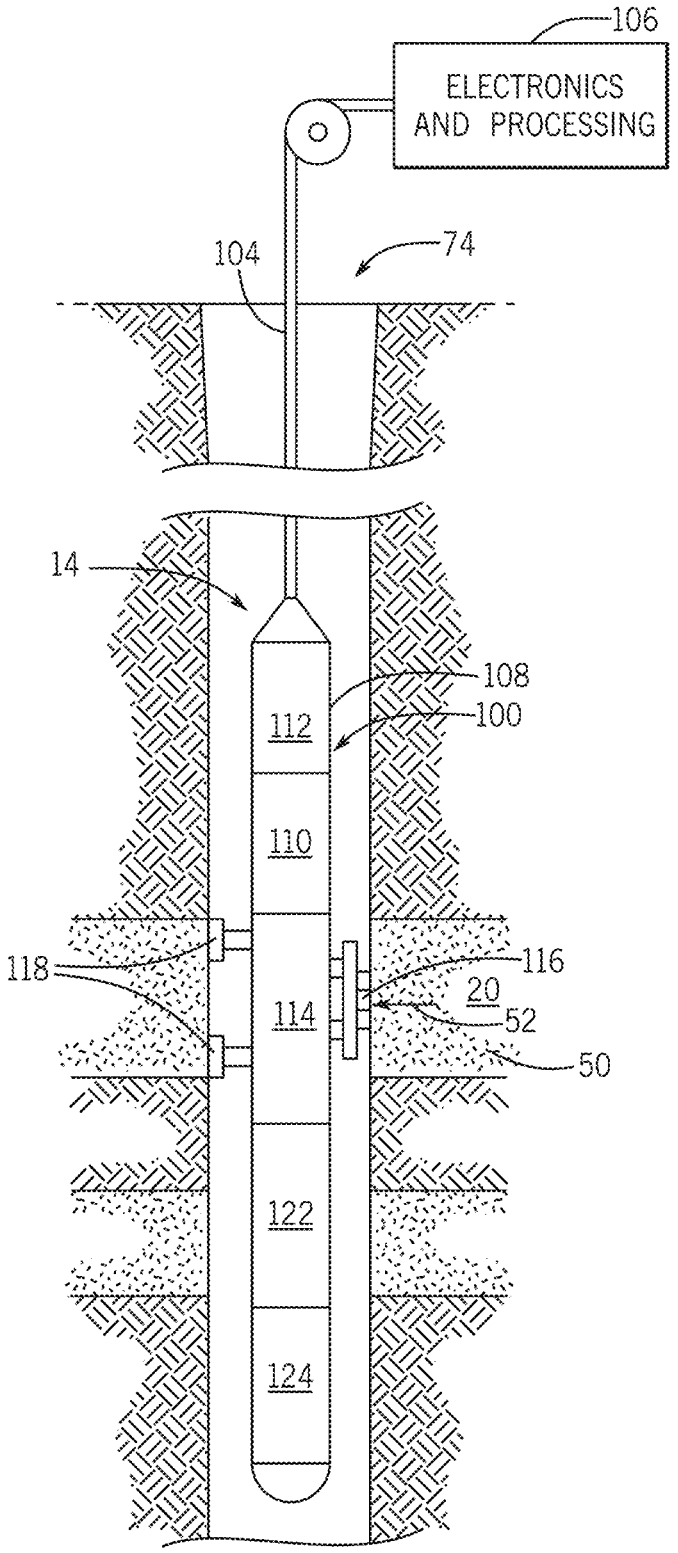
FIG. 2 is a schematic diagram of another embodiment of a wellsite system that may employ downhole fluid analysis methods for determining fluid properties and formation characteristics within a wellbore, in accordance with an embodiment.

FIGS. 1 and 2 depict examples of wellsite systems that may employ the fluid analysis systems and techniques described herein. FIG. 1 depicts a rig 10 with a downhole acquisition tool 12 suspended therefrom and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid or mud 32 (e.g., oil base mud (OBM) or water-based mud (WBM)) is stored in a pit 34 formed at the well site. A pump 36 delivers the drilling mud 32 to the interior of the drill string 16 via a port in the swivel 30, inducing the drilling mud 32 to flow downwardly through the drill string 16 as indicated by a directional arrow 38. The drilling fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and post-drilling via wireline, or other suitable types of conveyance.

In certain embodiments, the downhole acquisition tool 12 includes a downhole fluid analysis (DFA) system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

The downhole acquisition tool 12 may evaluate fluid properties of reservoir fluid 50. Accordingly, the sampling system 42 may include sensors that may measure fluid properties such as gas-to-oil ratio (GOR), mass density, optical density (OD), composition of carbon dioxide ($CO_2$), $C_1$, $C_2$, $C_3$, $C_4$, $C_5$, and $C_{6+}$, formation volume factor, viscosity, resistivity, fluorescence, American Petroleum Institute (API) gravity, pressure, and combinations thereof of the reservoir fluid 50. The fluid communication module 46 includes a probe 60, which may be positioned in a stabilizer blade or rib 62. The probe 60 includes one or more inlets for receiving the formation fluid 52 and one or more flow lines (not shown) extending into the downhole acquisition tool 12 for passing fluids (e.g., the reservoir fluid 50) through the tool. In certain embodiments, the probe 60 may include a single inlet designed to direct the reservoir fluid 50 into a flowline within the downhole acquisition tool 12. Further, in other embodiments, the probe 60 may include multiple inlets that may, for example, be used for focused sampling. In these embodiments, the probe 60 may be connected to a sampling flow line, as well as to guard flow lines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

In certain embodiments, the downhole acquisition tool 12 includes a logging while drilling (LWD) module 68. The module 68 includes a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based at least in part on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, etc.) calculating and estimating fluid properties of the reservoir fluid 50, modeling the fluid behaviors using, e.g., equation of state models (EOS). The memory 80 may store reservoir modeling systems (e.g., geological process models, petroleum systems models, reservoir dynamics models, etc.), mixing rules and models associated with compositional characteristics of the reservoir fluid 50, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 20 and reservoir fluid 52, respectively. In certain embodiments, the data processing system 54 may apply filters to remove noise from the data 70.

To process the data 70, the processor 78 may execute instructions stored in the memory 80 and/or storage 82. For example, the instructions may cause the processor to compare the data 70 (e.g., from the logging while drilling and/or downhole fluid analysis) with known reservoir properties estimated using the reservoir modeling systems, use the data 70 as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 8.

FIG. 2 depicts an example of a wireline downhole tool 100 that may employ the systems and techniques described herein to determine formation and fluid property characteristics of the reservoir 8. The downhole tool 100 is suspended in the wellbore 14 from the lower end of a multi-conductor cable 104 that is spooled on a winch at the surface 74. Similar to the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 is configured to selectively seal off or isolate selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The reservoir fluid 50 may be expelled to the wellbore through a port in the body 108 or the reservoir fluid 50 may be sent to one or more fluid sampling modules 122 and 124. The fluid sampling modules 122 and 124 may include sample chambers that store the reservoir fluid 50. In the illustrated example, the electronics and processing system 106 and/or a downhole control system are configured to control the extendable probe assembly 116 and/or the drawing of a fluid sample from the formation 20 to enable analysis of the fluid properties of the reservoir fluid 50, as discussed above.

As discussed above, it may be desirable to increase a production pump-out rate of the reservoir fluid 50 during formation testing operations. For example, in certain embodiments, the production pump-out rate of the reservoir fluid 50 from the geological formation 20 may be increased by between approximately 25% and approximately 100%. However, the wellbore 14 may be unable to accommodate the increased influx of the reservoir fluid 50. Therefore, the reservoir fluid 50 may be mixed with the mud 32 to facilitate removal of the reservoir fluid 50 from the wellbore 14, thereby allowing the production pump-out rate to be increased. As such, a fluid level of mud 32 circulating within the annulus of the wellbore 14 may change over time during formation testing depending on the production pump-out rate. Accordingly, the removal of the reservoir fluid 50 from the wellbore 14 may depend on a fluid level of the mud 32 within the wellbore 14. Therefore, the fluid level of the mud 32 circulating within the wellbore 14 may need to be maintained within an acceptable threshold range to achieve the desired production pump-out rate. The fluid levels of the mud 32 may be maintained by continuous operation of a feed-back controlled mud pump during formation testing applications.

Figure 3:
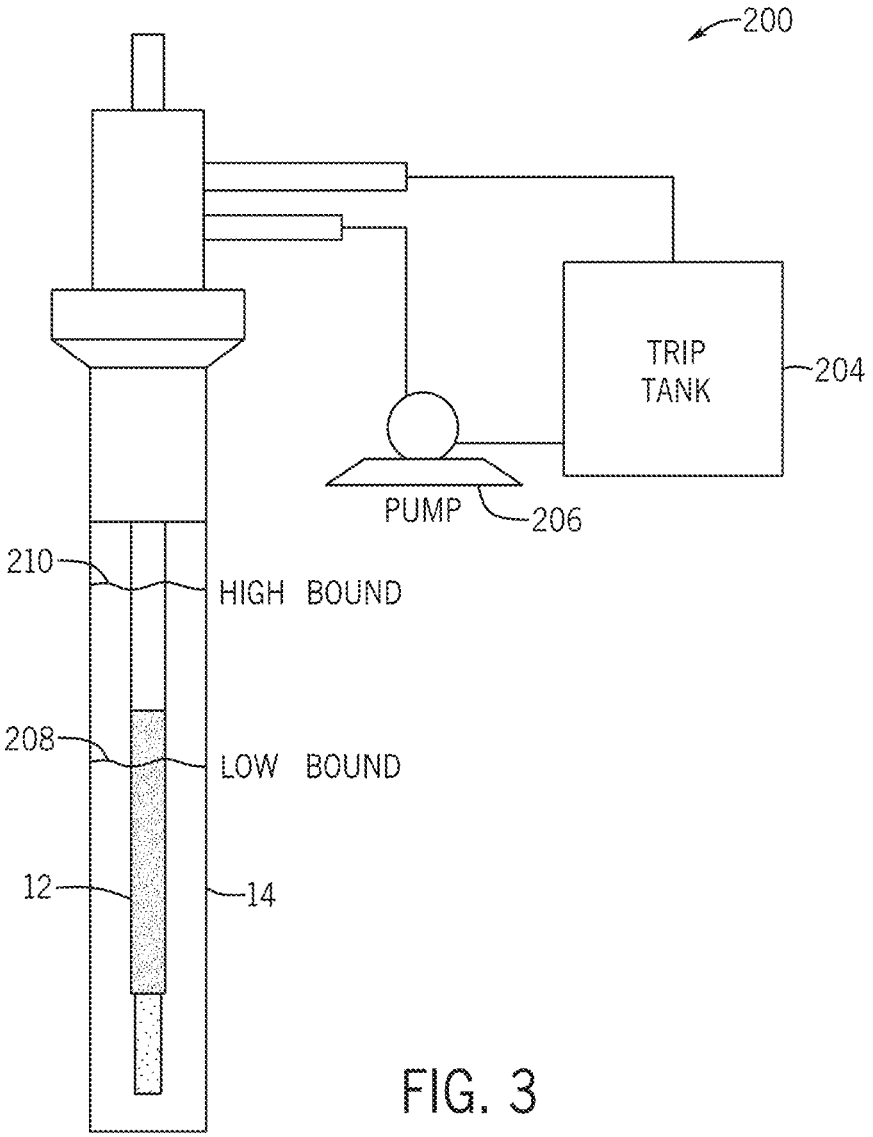
FIG. 3 is a schematic diagram of an embodiment of a trip-tank mud-pump assembly that may be used to circulate and control mud fluid levels through the wellbore, in accordance with an embodiment.

FIG. 3 illustrates an embodiment of a trip-tank mud-pump assembly 200 that may control fluid levels of the mud 32 circulating within the wellbore 14. The trip-tank mud-pump assembly 200 includes a trip tank 204 (e.g., container) that contains and provides the mud 32 that is circulated through the wellbore 14 during drilling, or, if desired, post drilling. In addition to the trip tank 204, the trip-tank mud-pump assembly 200 also includes a mud pump 206 that pumps the mud 32 into and out of the wellbore 14. The mud pump 206 circulates the mud 32 to and from the wellbore 14 based on the fluid level of the mud 32 within the wellbore 14. For example, when the fluid level of the mud 32 is at or below a low bound level 208, the mud-pump 206 pumps the mud 32 from the trip tank 204 into the wellbore 14. The mud-pump 206 may continue to pump the mud 32 from the trip tank 204 into the wellbore 14 until the fluid level of the mud 32 is above the low bound level 208 and below an upper bound level 210. In contrast, if the fluid level of the mud 32 is above the upper bound level 210, the mud-pump 206 removes a portion of the mud 32 from the wellbore 14 and into the trip tank 204 until the fluid level of the mud 32 within the wellbore 14 is below the upper bound level 210 and above the low bound level 208. In certain embodiments, a flow rate of the mud-pump 206 may be constant (e.g., non-variable) throughout the formation testing. In other embodiments, the flow rate of the mud-pump 206 may vary throughout the formation testing to maintain the mud 32 within the bound levels 208, 210.

During circulation of the mud 32 through the wellbore 14, a portion of the mud 32 may flow into the geological formation 20, thereby decreasing the fluid level of the mud 32 circulating within the wellbore 14. Variations in the fluid level of the mud 32 may result in fluctuations in formation pressure. If the loss rate $q_l$ of the mud 32 is fixed, a periodicity for pressure oscillations within the wellbore 14 during formation testing may be expressed as follows;

$$\{\pi(r_w^2 - r_d^2)\Delta(l_t - l_b)\}\left(\frac{1}{(q_{pb} + q_l)} + \frac{1}{(q_{pd} - q_l)}\right) \quad \text{EQ. 1}$$

where $l_b$ and $l_t$ are the lower bound level 208 and the upper bound level 210, respectively, for the set height in the wellbore 14 for pump on-off control; $r_w$ and $r_d$ are wellbore and drill pipe radii, respectively, and $q_p$ is the flow rate of the mud-pump 206. In certain embodiments, the mud-pump 206 may be operate bidirectionally. That is, the mud-pump 206 may be used to pump the mud 32 into and out of the wellbore 14. Accordingly, the pump-out/drawdown rate is $q_{pd}$ and the pump-in/build-up rate is $q_{pb}$. In other embodiments, the mud-pump 206 operates unidirectionally (e.g., pumps the mud 32 into or out of the wellbore 14). Accordingly, either the $q_{pd}$ or the $q_{pb}$ is zero. The magnitude of pressure fluctuation in the wellbore 14 may be expressed as follows:

$$\rho_m g(l_t - l_b)\cos\theta \quad \text{EQ. 2}$$

Where $\rho_m$ is mud density, g is acceleration (e.g., due to gravitational forces), and θ is a wellbore angle from the vertical between $l_t$ and $l_b$. The magnitude and time period for the pressure fluctuation may be compared with measured values for error diagnostics.

During formation testing, the probe 60 of the downhole acquisition tool 12 is set past the mud-cake following a flowing period. Setting the probe 60 past the mud filter cake may cause a pressure of the probe 60 to be approximately equal to the formation pressure, once communication is established by drawing down formation fluid and allowing pressure to build-up. Pressure build-up in an infinitely radial and thick reservoir is spherical and has a response of $\sqrt{(1/t)}$, where t is the elapsed time after a flow rate change. In a finite-thickness reservoir the pressure build-up mimics cylindrical flow and has a response of lnt. For multiple flow rates, superposition is used to infer an extrapolation axis, and determine formation pressure. However, the mud-cake has a finite nonzero permeability that may result in wellbore pressure fluctuations to be communicated (e.g., transferred) to the formation, which may decrease the accuracy of the formation pressure obtained via extrapolation techniques. Therefore, it may be desirable to apply filters to build-up formation pressure data to improve the accuracy of the formation pressure.

Figure 4:
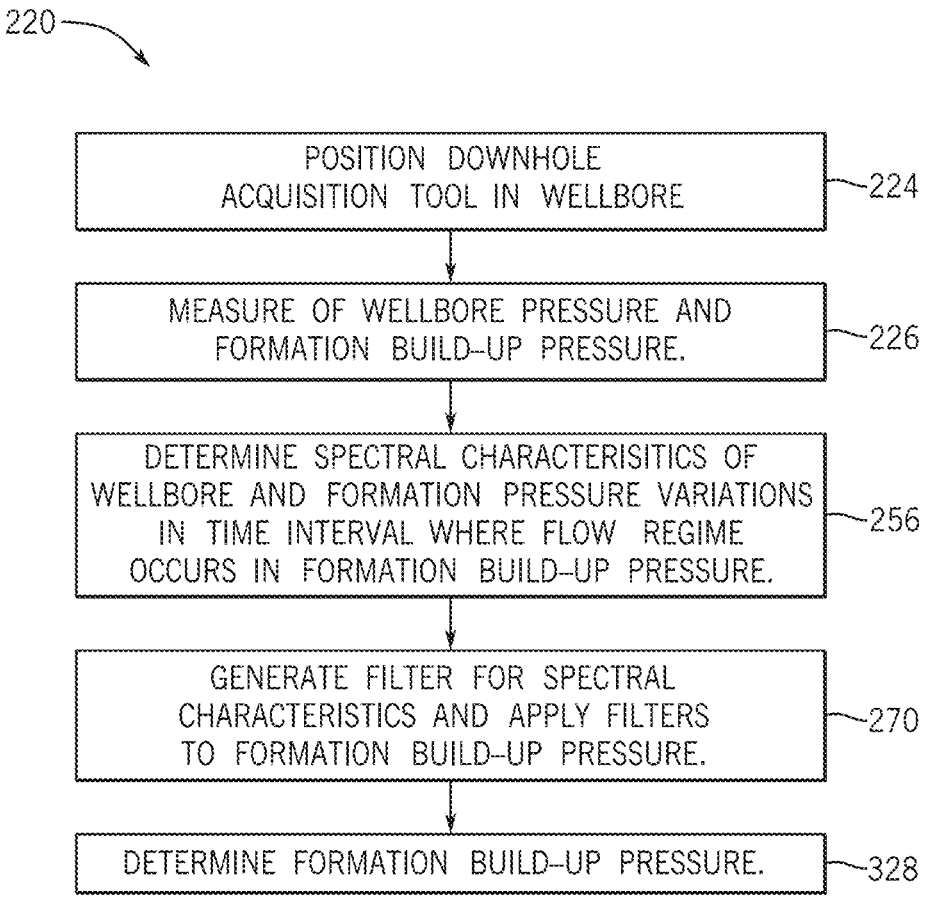
FIG. 4 is flowchart of an embodiment of a method that determines initial formation pressure using filtered noisy build-up formation pressure. The filters are designed based on the spectral characteristics of the measured noise in the wellbore and formation pressure, in accordance with an embodiment.

A method for determining the build-up formation pressure by applying filters to the build-up formation pressure data obtained in situ in real-time with the downhole acquisition tool 12 is illustrated in flowchart 220 of FIG. 4. In the illustrated flowchart 220, the downhole acquisition tool 12 is positioned at a desired depth within the wellbore 14 (block 224) and a pressure of the formation and the wellbore is measured (block 226). For example, the downhole acquisition tool 12 is lowered into the wellbore 14, as discussed above, such that the probe 60, 116 is within a region of interest. The probe 60, 116 faces toward the geological formation 20 to enable measurement of the formation and wellbore pressure.

Figure 5:
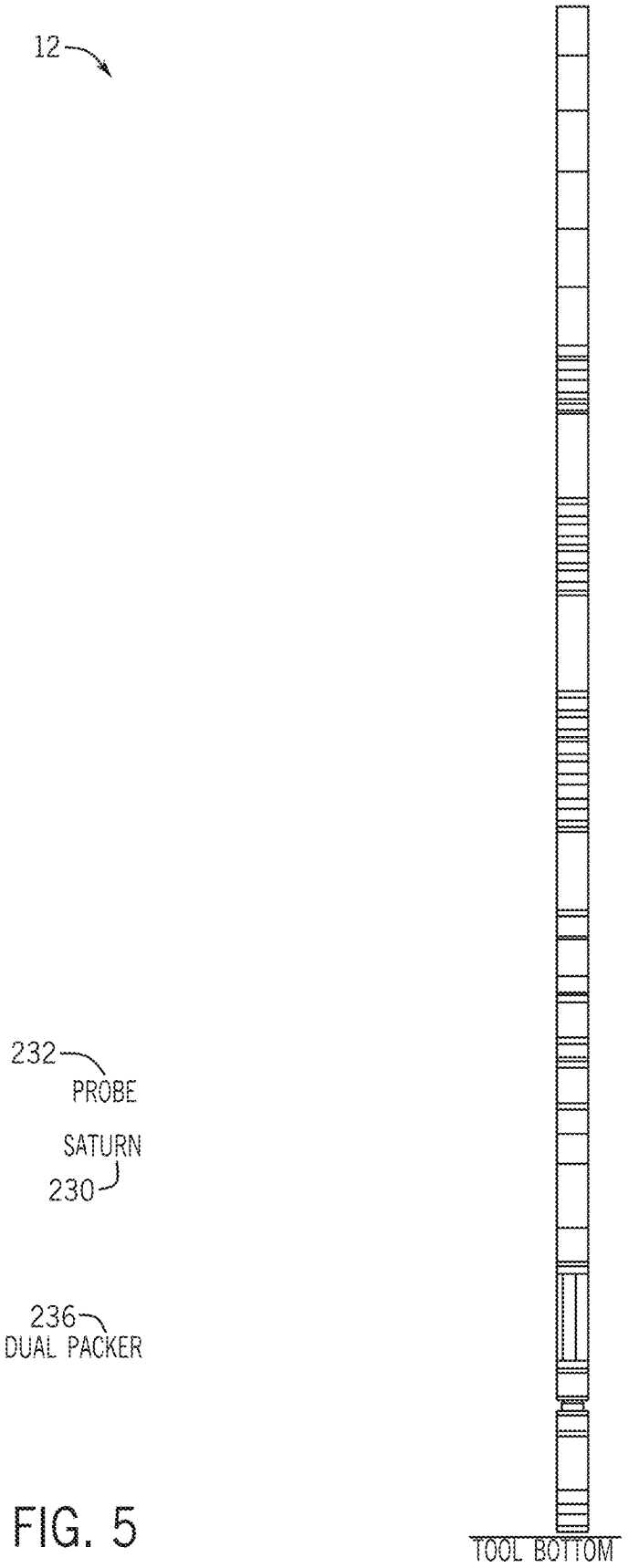
FIG. 5 is a schematic diagram of an embodiment of a downhole data acquisition tool that may be used in the wellsite system of FIGS. 1 and 2 to measure build-up pressure within the wellbore, in accordance with an embodiment.

FIG. 5 is an embodiment of a configuration of the downhole acquisition tool 12 that was used in a field interval pressure transient test (IPTT) that measured the pressure of the formation and the wellbore of a reservoir. In the illustrated embodiment, the downhole acquisition tool 12 includes a set-packer interval 230 (e.g., SATURN® available from Schlumberger of Houston, Tex.), a probe 232, and a dual packer 236. During the IPTT, the downhole acquisition tool 12 measured the wellbore pressure above and below the set-packer interval 230. When one or more packers is deployed, flow may occur through the packer interval sector-opening due, in part, to operational pumps within the downhole acquisition tool 12. However, while the packers are deployed, communication between the wellbore pressure and the formation fluid 52 below the packer within the downhole acquisition tool 12 is permitted. The probe 232 is set to measure the formation pressure through the mud filter cake above the set-packer interval 230, and the dual packer 236 is unset, measuring the wellbore pressure below the packer interval 230. Multiple drawdowns were performed through the set-packer interval 230. During the multiple drawdowns, a passive pressure measurement of the formation was obtained through the probe 232 (e.g., through the mud filter cake) and a pressure measurement within the set-packer interval 230 was also obtained. The pressure measurement within the set-packer interval 230 measured flow-line pressure connected to the mud 32 circulating through the wellbore.

Figure 6:
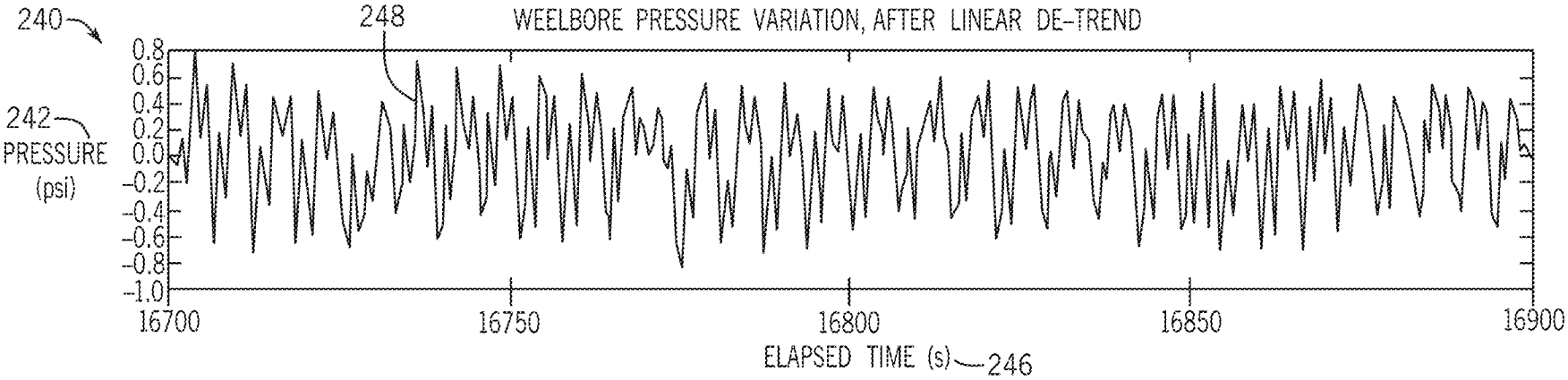
FIG. 6 is a representative plot of measured wellbore pressure as a function of elapsed time for wellbore undergoing formation testing, whereby the measured pressure is de-trended to remove background trends, in accordance with an embodiment.
Figure 7:
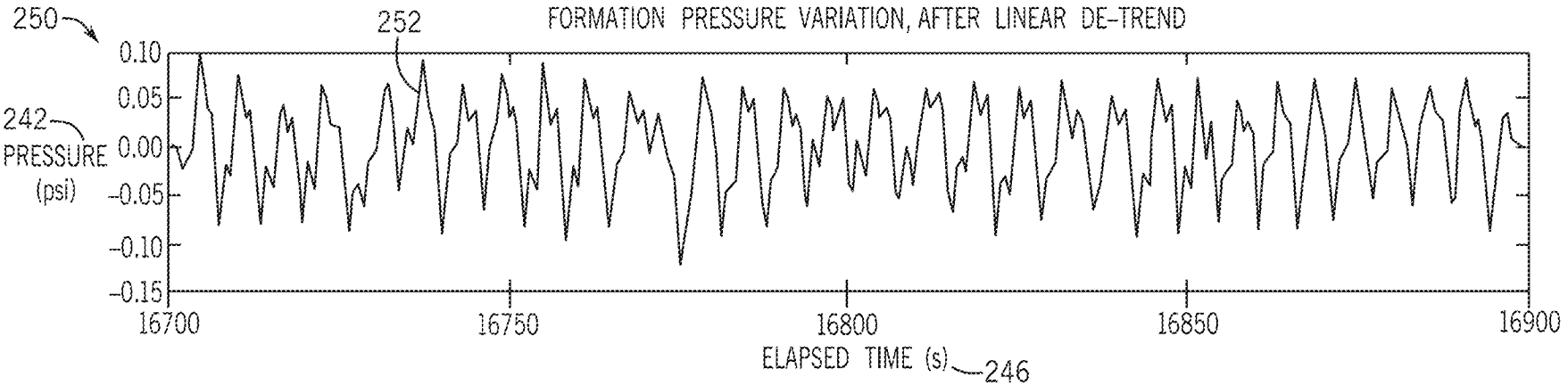
FIG. 7 is a representative plot of measured formation pressure as a function of elapsed time for the wellbore of FIG. 6, whereby the measured pressure is de-trended to remove background trends, in accordance with an embodiment.

As discussed above, the trip-tank mud-pump assembly 200 circulates the mud 32 into and out of the wellbore 14 based on the fluid level of the mud 32 within the wellbore 14. Accordingly, the pressure of the mud 32 oscillates even when flow of the mud 32 through the packer interval is shut down, for the period when the mud level fluctuates. The fluctuating level may induce noise in the measured wellbore and formation pressures. For example, FIG. 6 is a plot 240 of pressure 242 in pound force per square inch (psi) as a function of time 246 in seconds (sec) for wellbore pressure data 248 measured above the set-packer interval 230 (e.g., using a strain gauge). Similarly, FIG. 7 is a plot 250 of the pressure 242 as a function of time 246 for the formation pressure data 252. The pressure data 248, 252 in FIGS. 6 and 7 is given as a variation from a zero-point, and not as an absolute pressure. A de-trend was performed on the pressure data 248, 252 to remove background linear trend and facilitate viewing oscillations in the pressure data 248, 252. The de-trend was performed over a time interval that allowed a desirable amount of cycles to be included in the pressure data 248, 252 and the background trend to be linear. In addition to removing the background linear trend, non-oscillating components of the pressure data 248, 252 were also removed to facilitate spectral processing. As shown in the plot 240, 250, the pressure data 248, 252, respectively, oscillates over time. Accordingly, the fluctuation in the wellbore pressure appears to be transmitted through the mud filter cake, thereby creating noise in the measured formation pressure build-up. Therefore, extrapolating the formation pressure may result in an inaccurate formation pressure or have an unacceptable uncertainty. Accuracy of the formation pressure obtained by extrapolation may be improved by applying filters that remove the oscillations in the pressure data 248, 252.

Figure 8:
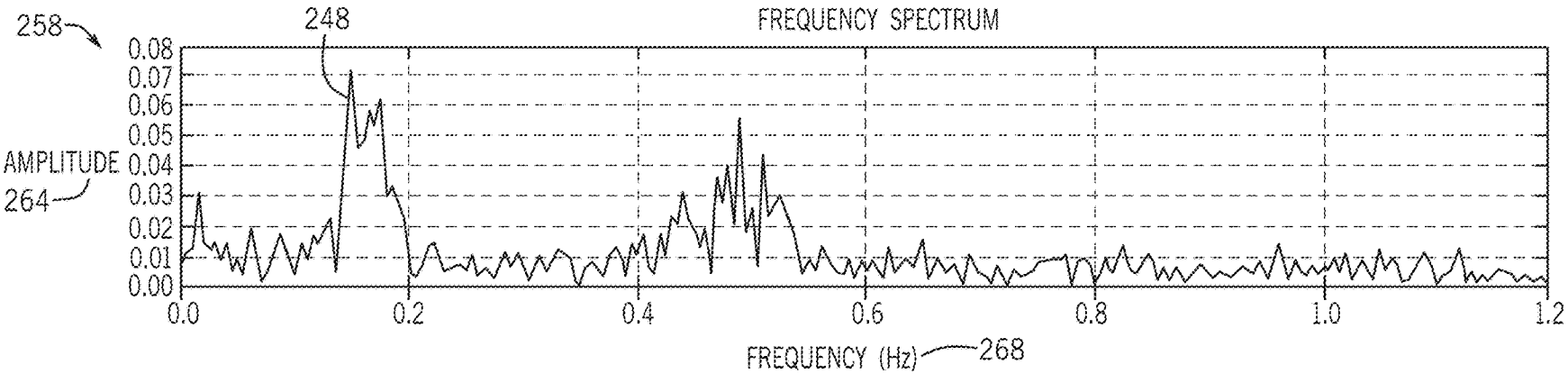
FIG. 8 is a representative plot of amplitude as a function of frequency for the wellbore pressure of FIG. 6, in accordance with an embodiment.
Figure 9:
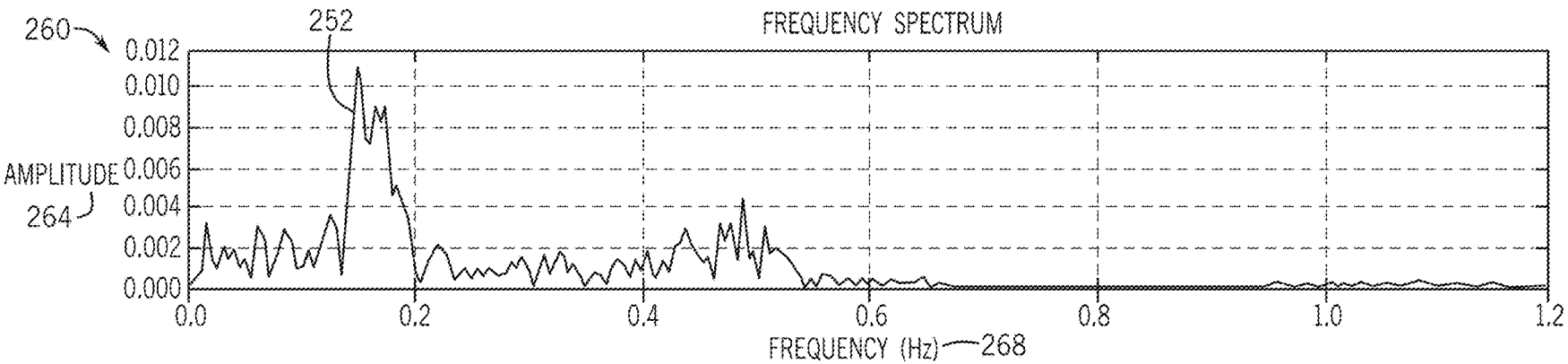
FIG. 9 is a representative plot of amplitude as a function of frequency for the formation pressure of FIG. 7, in accordance with an embodiment.

Before applying a filter to the pressure data 248, 252, it may be desirable to determine certain spectral characteristics of the pressure data 248, 252. Accordingly, returning to the method of FIG. 4, the flowchart 220 includes determining spectral characteristics of the wellbore and formation pressure variations during a time interval where a flow regime occurs in the formation build-up pressure (block 256). For example, removing the background linear trend from the pressure data 248, 252 may facilitate identification of modal frequencies that may otherwise be dominated by the background and, therefore, may be difficult to determine. FIGS. 8 and 9 illustrate plot 258, 260 of amplitude 264 as a function of frequency 268 in hertz (Hz) illustrating the spectral characteristics of the pressure data 248, 252, respectively. As shown in the plots 258, 260, the oscillations in pressure data 248, 252, respectively, have two dominant frequencies at approximately 0.14 Hz (7 second in period) and 0.5 Hz (2 seconds in period). The oscillations in the wellbore pressure data 248 at both 0.14 Hz and 0.5 Hz have an amplitude of approximately 0.6 psi. The formation pressure data 252 also has oscillations at both 0.14 Hz and 0.5 Hz. However, the amplitude 264 of the oscillations in the formation pressure data 252 is less than that of the wellbore pressure data 248. For example, at 0.14 Hz the amplitude of the formation pressure data 252 is approximately one eighth less than the amplitude of the wellbore pressure data 248. The fluctuation at 0.5 Hz is also present in the formation pressure data 252. However, as shown by the low amplitude, the fluctuation of the formation pressure data 252 at 0.5 Hz is much weaker compared to the wellbore pressure data 248. The weaker formation pressure fluctuation at 0.5 Hz may be due, in part, to a higher attenuation of higher frequency on transmission, or different sensor response between a quartz gauge used to measure the formation pressure and the strain gauge used to measure the wellbore pressure.

Returning to the flowchart 220 of FIG. 4, following identification of the spectral characteristics of the wellbore and formation pressure data 248, 252, respectively, the flowchart 220 includes generating and applying a filter for the pressure data 252 (block 270). For example, based on the frequency content of the oscillations in the pressure data 248, 252, a filter to remove the oscillations may be generated. By way of non-limiting example, filters that may be generated and applied to the pressure data 252 may include a band-stop filter, a low-pass filter, or any other suitable filter that removed the pressure oscillations. The band-stop filter passes high and low frequency components of the pressure data 248, 252 that are outside the domain of induced oscillation. The low-pass filter may be applied given that the build-up pressure is expected to behave linearly with respect to logarithm or inverse square root time (t). The filters are applied to the original pressure data (e.g., pressure data that does not have the background trend removed).

Figure 10:
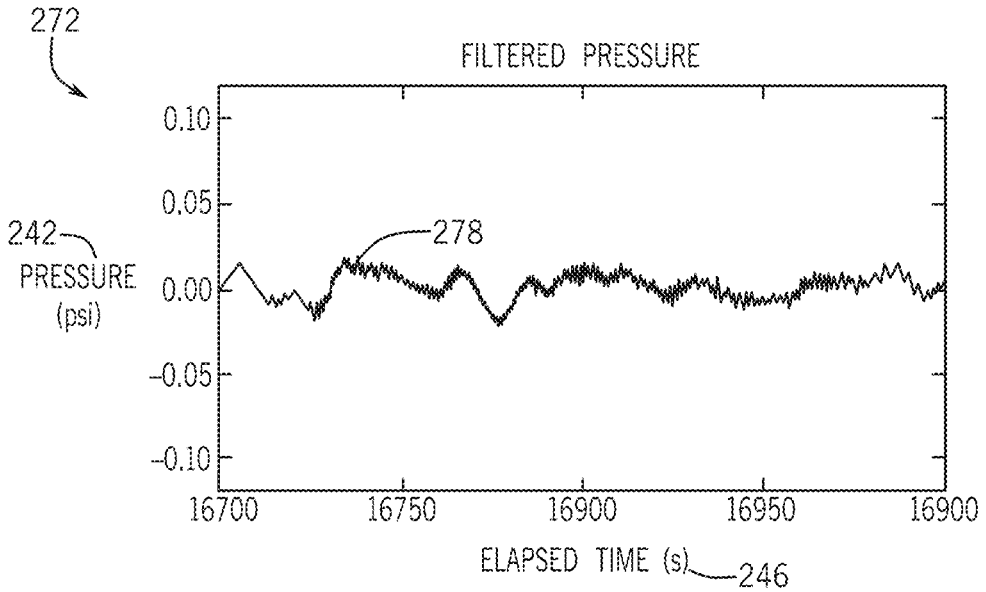
FIG. 10 is a representative plot of the formation pressure as a function of elapsed time for the wellbore of FIG. 6, whereby the measured formation pressure is filtered using band-stop filter, in accordance with an embodiment.
Figure 11:
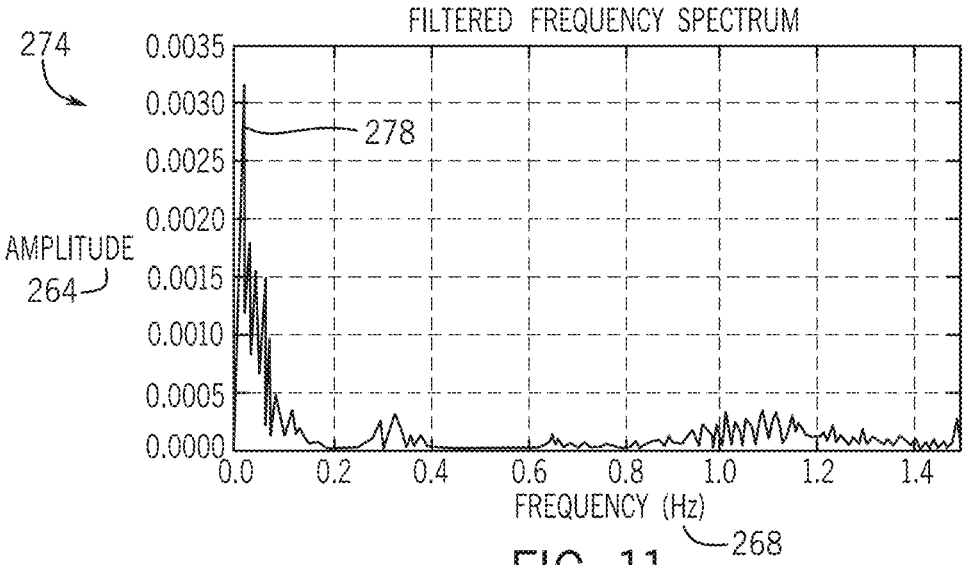
FIG. 11 is a representative plot of the amplitude as a function of frequency for the formation pressure of FIG. 9, whereby the measured formation pressure is filtered using band-stop filter, in accordance with an embodiment.
Figure 12:
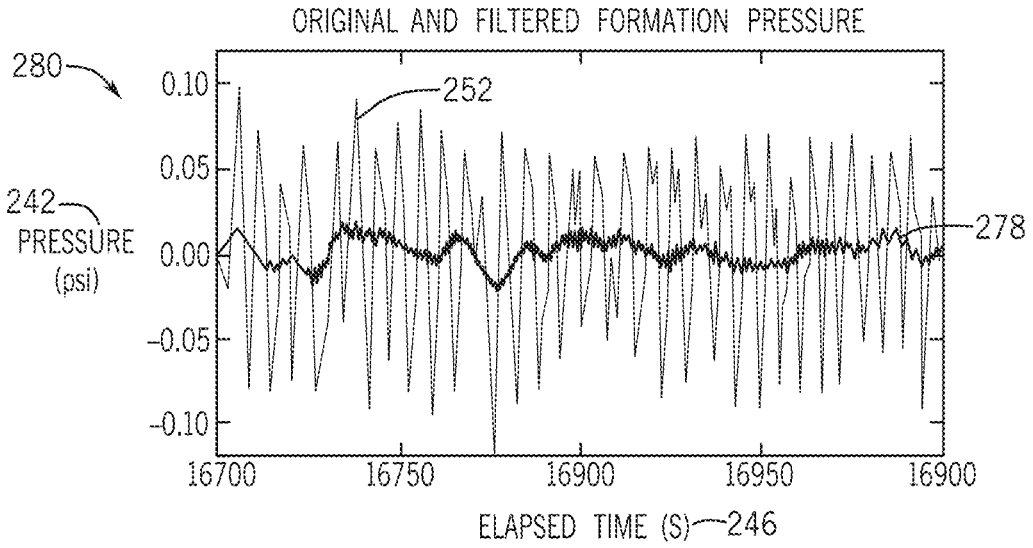
FIG. 12 is a representative plot combining the measured formation pressure of FIG. 7 and the filtered formation pressure of FIG. 10 as a function of elapsed time for the, in accordance with an embodiment.
Figure 13:
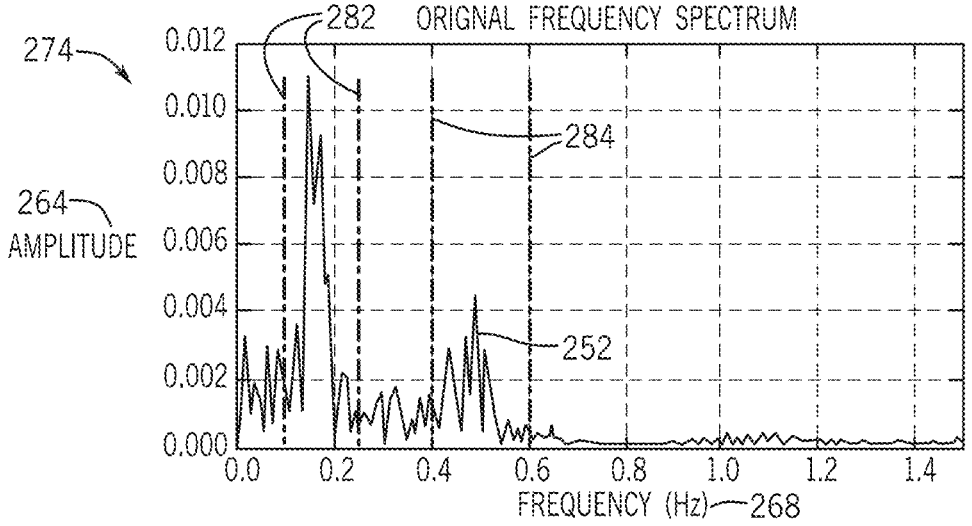
FIG. 13 is a representative plot of the amplitude as a function of the frequency for the formation pressure of FIG. 8 indicating two frequency bands used for the band-stop filtering, in accordance with an embodiment.

FIGS. 10 and 11 illustrate plots 272, 274, respectively, for the formation pressure data 252 filtered using a band-stop filter. For example, as shown in the plot 272 the pressure oscillations for the formation pressure data 252 shown in the plot 250 of FIG. 7 are reduced after applying the band-stop filter to the original formation pressure data. Accordingly, filtered formation pressure data 278 has significantly less noise compared to the formation pressure data 252, which may allow a more precise assessment of the formation pressure. For example, the filtered formation pressure data 278 has a noise of approximately ±0.0078 psi with a Bessel filter (as shown), and ±0.014 psi with a Butterworth filter, compared to 0.043 psi noise in the unfiltered formation pressure data 252. A comparison of the unfiltered formation pressure data 252 and the filtered formation pressure data 278 is shown in plot 280 illustrated in FIG. 12. Similarly, the filtered frequency spectrum of the formation pressure data 252 illustrates a reduced amplitude at the two frequencies identified as having variations in the time interval where the flow regime occurs in the formation build-up pressure. FIG. 13 illustrates the plot 260 having showing two sets of filtering bands identified by vertical dashed lines 282, 284. In this particular example, the petrophysical parameters were as follows: porosity=0.2; permeability=0.01 square micrometers ($\mu m^2$); viscosity=0.5 milliPascal second (mPa s); compressibility of fluid=$4\times10^{-10}$ $Pa^{-1}$. A single flowing period of 10000 sec at a rate of 100 milliliters per second (mL/s) was used for pressure build-up calculations.

Figure 14:
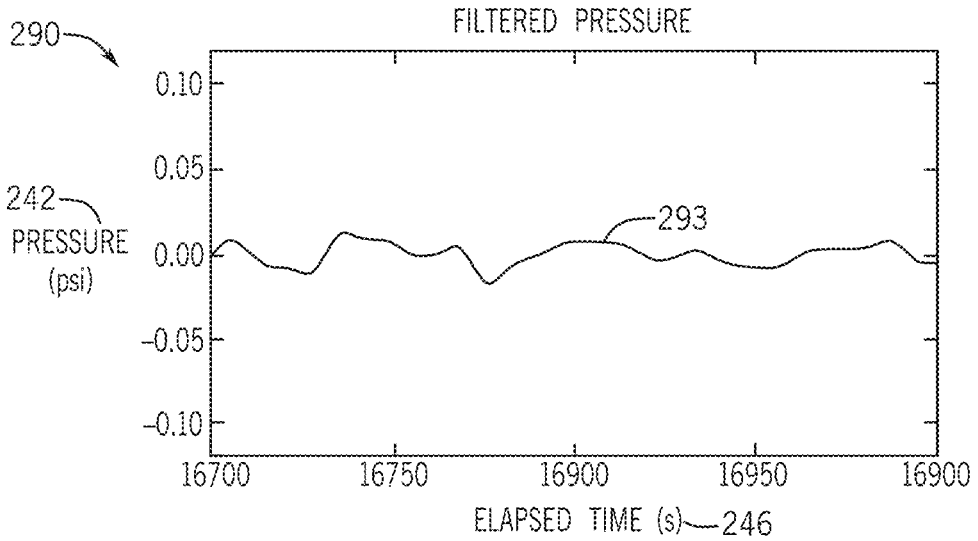
FIG. 14 is a representative plot of the formation pressure as a function of elapsed time for the wellbore of FIG. 6, whereby the measured formation pressure is filtered using low-pass filter, in accordance with an embodiment.
Figure 15:
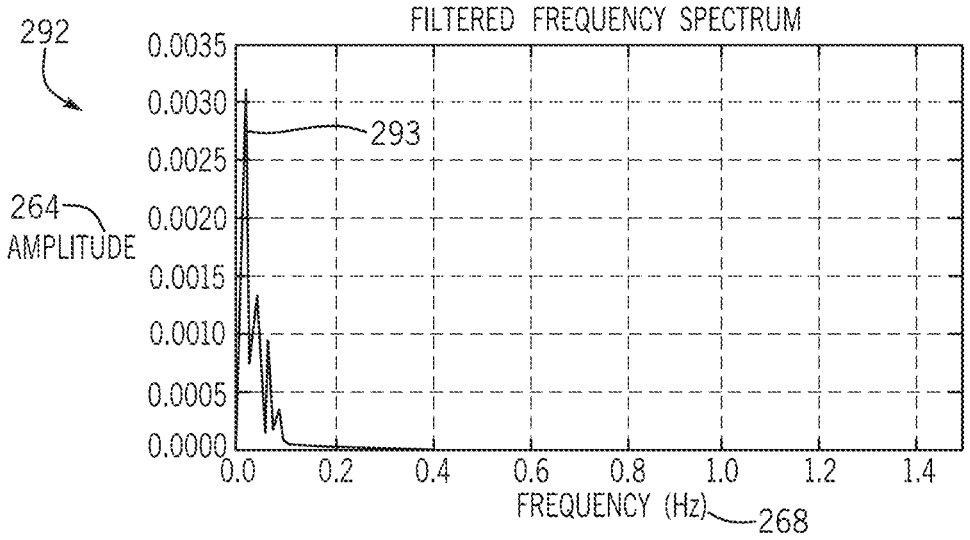
FIG. 15 is a representative plot of the amplitude as a function of the frequency for the formation pressure of FIG. 9, whereby the measured formation pressure is filtered using a low-pass filter, in accordance with an embodiment.
Figure 16:
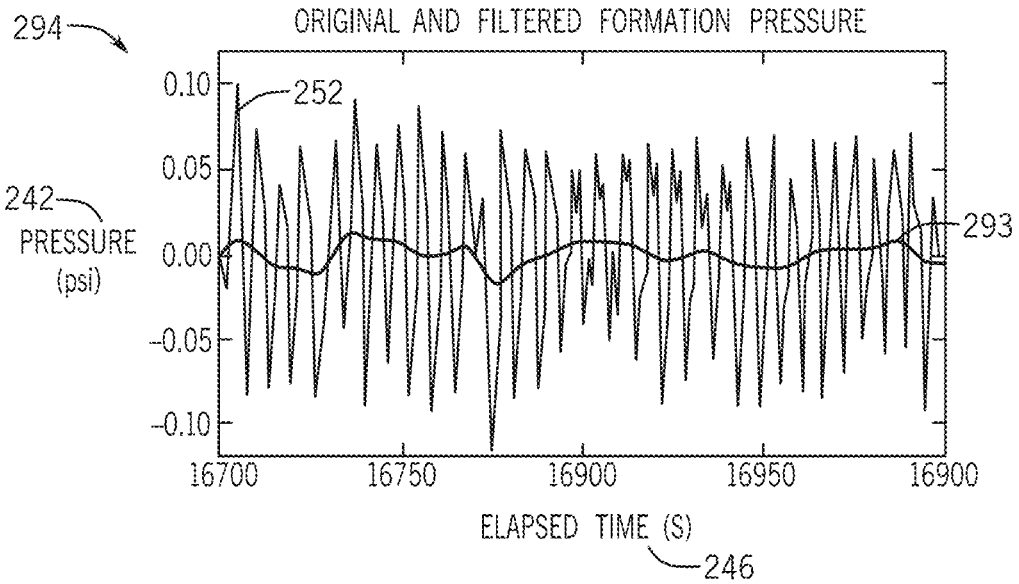
FIG. 16 is a representative plot combining the measured formation pressure of FIG. 7 and the filtered formation pressure of FIG. 14 as a function of elapsed time, in accordance with an embodiment.

In addition to the band-stop filter, the formation pressure data 252 was filtered using a low-pass filter. FIGS. 14 and 15 illustrates plots 290, 292, respectively, for the formation pressure data 252 filtered using a low-pass filter. For example, as shown in the plot 290 the pressure oscillations for the formation pressure data 252 shown in the plot 250 of FIG. 7 are reduced after applying the low-pass filter to the original formation pressure data. The low-pass cut-off was at 0.1 Hz, which did not appear to reduce the noise measurably more than the band-stop filter. For example, the filtered formation pressure data 278 has a noise of approximately ±0.0065 psi with a low-pass Bessel filter (as shown), and ±0.011 psi with a low-pass Butterworth filter, which is similar to the standard deviation of noise for the filtered formation pressure data 278 filtered using the band-stop filter (see, e.g. FIGS. 10 and 11). A comparison of the unfiltered formation pressure data 252 and the low-pass filtered formation pressure data 293 is shown in plot 294 illustrated in FIG. 16. The petrophysical parameters for the low-pass filter analysis were the same as the band-stop filter analysis.

Figure 17:
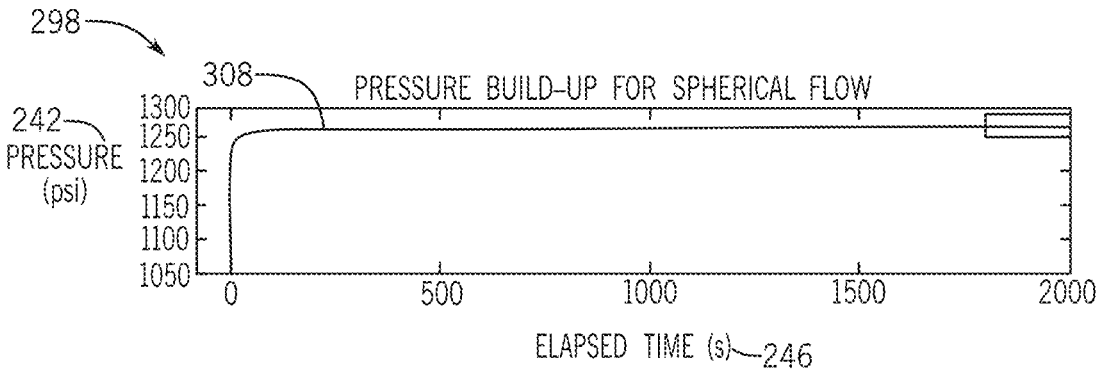
FIG. 17 is a representative plot of modeled formation build-up pressure as a function of elapsed time for a radial-spherical flow regime, in accordance with an embodiment.
Figure 18:
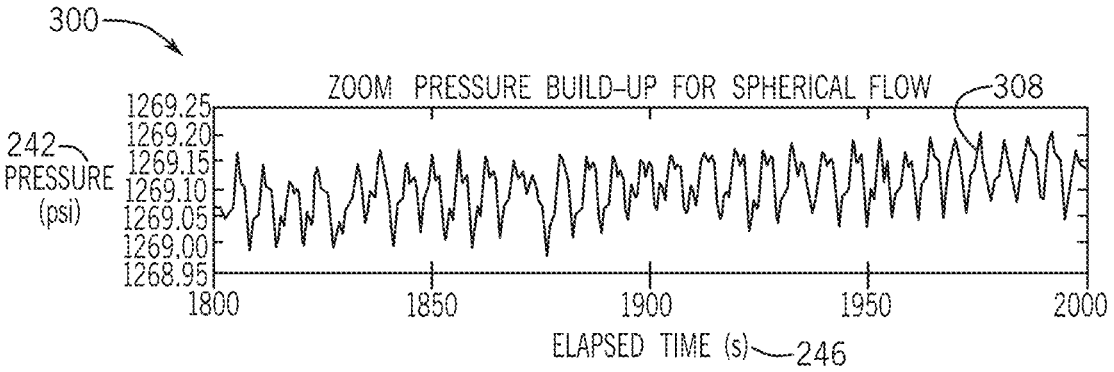
FIG. 18 is a representative plot of the modeled formation build-up pressure as a function of elapsed time for the radial-spherical flow regime of FIG. 17 showing the final 200 seconds of the modeled formation build-up pressure, in accordance with an embodiment.
Figure 19:
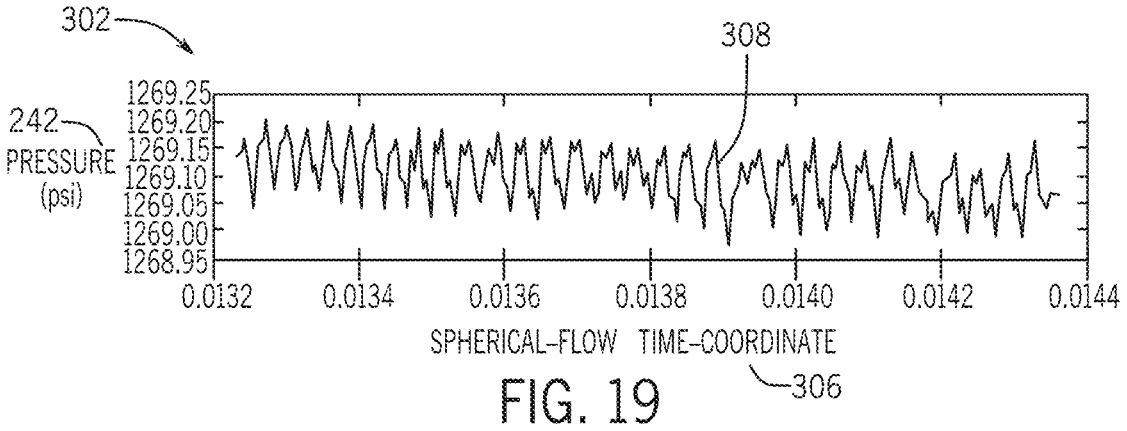
FIG. 19 is a representative plot of the modeled formation build-up pressure as a function of spherical-flow time-coordinate showing the final 200 seconds of the radial-spherical flow regime of FIG. 17, in accordance with an embodiment.

Synthetic modeling of formation testing studies were performed to determine the effectiveness of the filters for filtering pressure build-up data having trip-tank induced noise. In the following examples, late-time transient was in the interval of between approximately 1800 and 2000 sec and the initial formation pressure was set to 1270 psi. The build-up data in these examples include theoretical pressure response to a flow rate change superimposed with a noise spectrum of the examples illustrated in FIGS. 10-16. For example, FIGS. 17 and 18 illustrate plots 298, 300 of the pressure 242 as a function of time 246 for pressure build-up for a spherical flow regime induced by a point source that may be used during formation testing. The plot 300 of FIG. 18 is an expanded view for the final 200 sec of the build-up data shown in FIG. 17. The spherical-flow time coordinate is expressed as follows:

$$\frac{1}{\sqrt{\Delta t}} - \frac{1}{\sqrt{\Delta t + t_p}} \qquad \text{EQ. 3}$$

where $\Delta t$ is the elapsed time between the cessation of flow and to a production time of 10000 s, i.e., $t_p$. FIG. 19 is a plot 302 of the pressure 242 as a function of the spherical-flow time coordinate 306.

Figure 20:
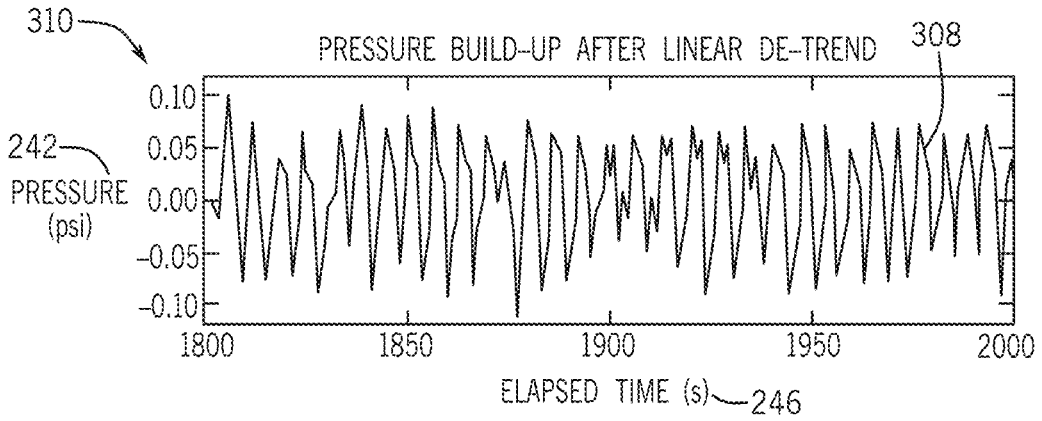
FIG. 20 is a representative plot of the modeled formation build-up pressure as a function of elapsed time for the radial-spherical flow regime of FIG. 17, whereby the measured pressure is de-trended to remove background trends, in accordance with an embodiment.
Figure 21:
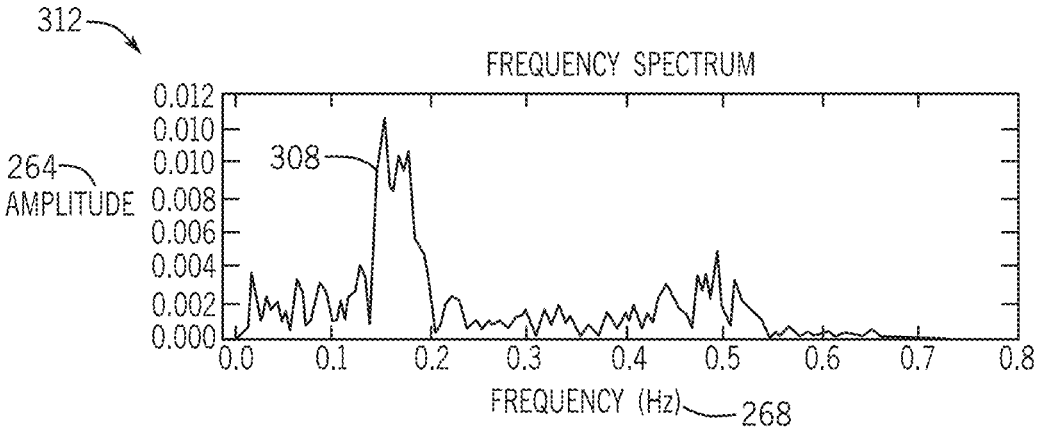
FIG. 21 is a representative plot of amplitude as a function of frequency for the radial-spherical flow regime of FIG. 17, in accordance with an embodiment.
Figure 22:
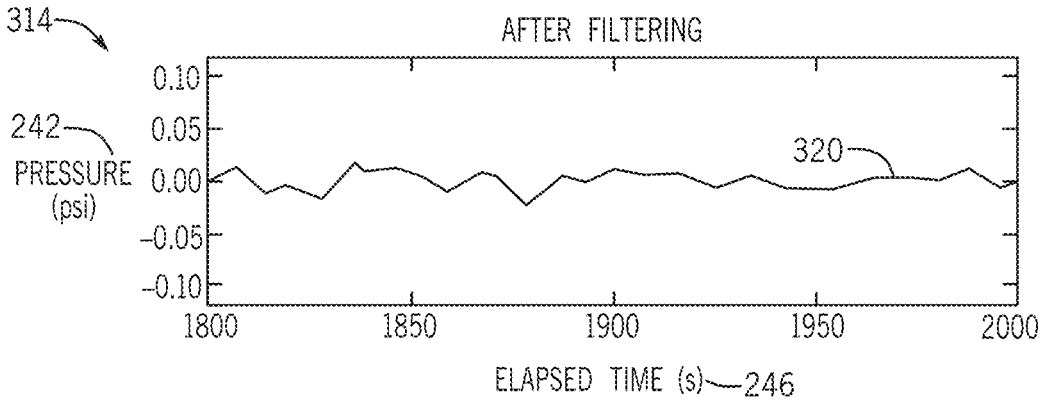
FIG. 22 is a representative plot of the modeled formation build-up pressure as a function of elapsed time for the radial-spherical flow regime of FIG. 17, whereby the measured formation pressure is filtered using a band-stop filter, in accordance with an embodiment.
Figure 23:
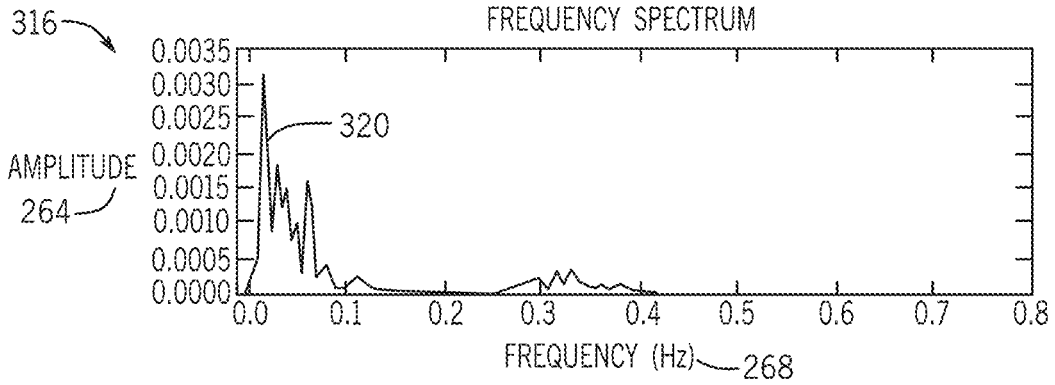
FIG. 23 is a representative plot of amplitude as a function of frequency for the radial-spherical flow regime of FIG. 17, whereby the measured formation pressure is filtered using a band-stop filter, in accordance with an embodiment.
Figure 24:
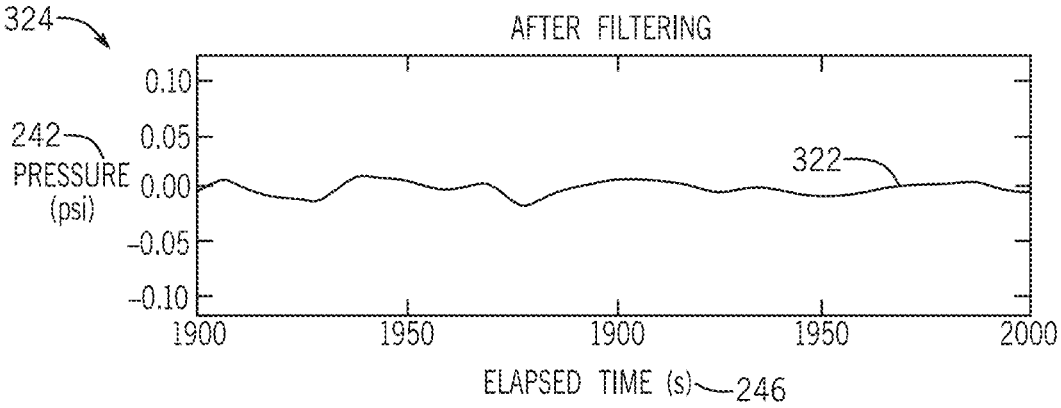
FIG. 24 is a representative plot of the modeled formation build-up pressure as a function of elapsed time for the radial-spherical flow regime of FIG. 17, whereby the measured formation pressure is filtered using a low-pass filter, in accordance with an embodiment.
Figure 25:
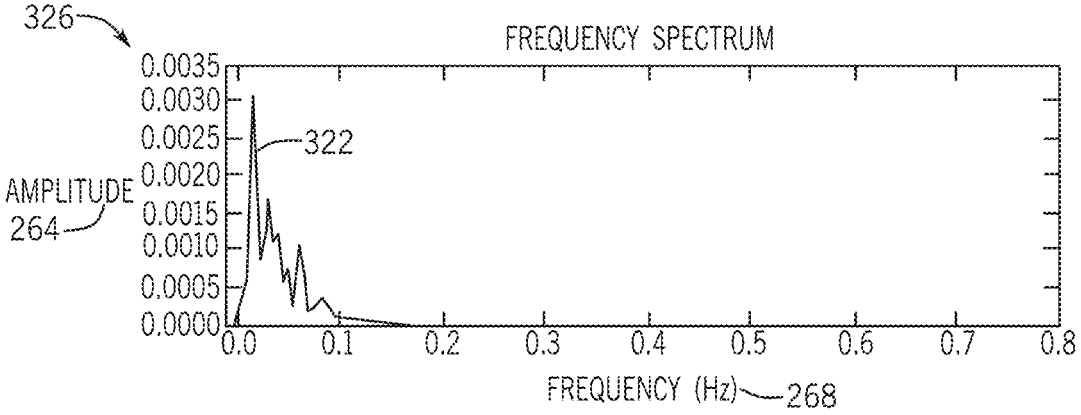
FIG. 25 is a representative plot of amplitude as a function of frequency for the radial-spherical flow regime of FIG. 17, whereby the measured formation pressure is filtered using a low-pass filter, in accordance with an embodiment.

Similar to the example illustrated in FIGS. 7 and 9, the build-up pressure data 308 was de-trended to remove background linear trends and facilitate identification of the spectral characteristics of the build-up data 308. FIG. 20 illustrates a plot 310 of the build-up pressure data 308 after removal of the background linear trends. The spectral characteristics of the build-up pressure data 308 are identified at a frequency of approximately 0.15 Hz and approximately 0.48 Hz, as shown in the plot 312 illustrated in FIG. 21. A band-stop filter was applied to the build-up pressure data 308 to remove the pressure oscillations created by the noise spectrum superimposed on the original build-up pressure data (e.g., the build-up pressure data including the background linear trends). For example, a band-stop filter of approximately 0.1 and 0.25 Hz and approximately 0.4 and 0.6 Hz was applied based on the identified frequencies of 0.15 Hz and 0.48 Hz. FIGS. 22 and 23 illustrates plots 314 and 316 of the de-trended build-up pressure data 308 after applying the band-stop filter. As shown in the plot 314 and 316, the oscillations in the pressure are removed from filtered build-up pressure data 320. The build-up pressure data 308 was also filtered using a low-pass filter. FIGS. 24 and 25 illustrate plots 324 and 326, respectively, of the low-pass filtered de-trended build-up pressure data 322 generated by applying a low-pass filter to the build-up pressure data 308. Similar to the band-stop filter, the low-pass filter removes the pressure oscillations in the build-up pressure data 308 created by the noise spectrum superimposed on the original build-up pressure data. As such, applying the filters to the build-up pressure data 308 provides a formation pressure over time that is close to the actual formation pressure of the wellbore (e.g., the wellbore 14). Accordingly, extrapolation of the formation pressure may be used to determine the formation pressure of wellbore at any given time with improved precision and accuracy.

Figure 26:
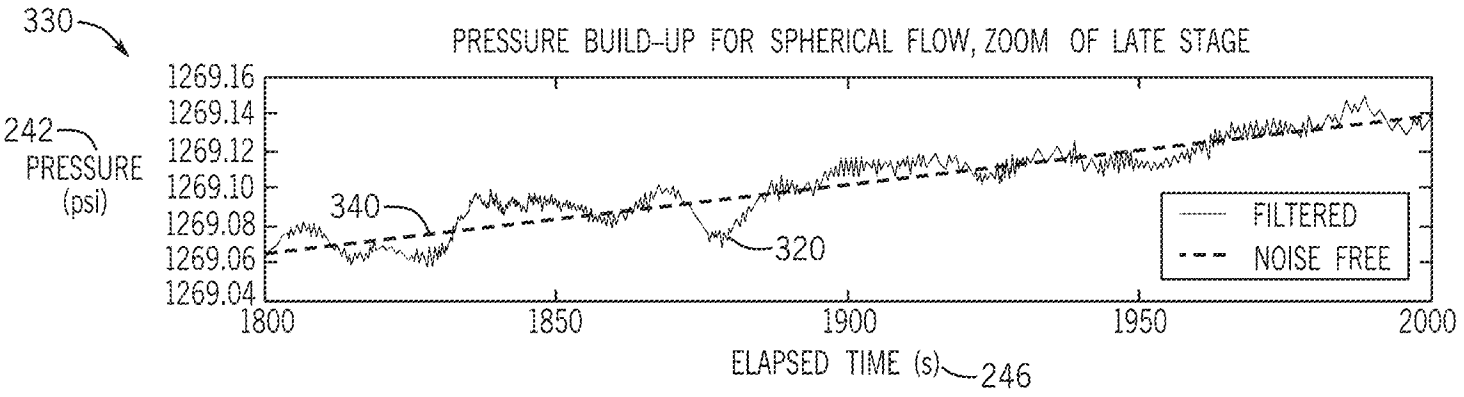
FIG. 26 is a representative plot of the modeled formation build-up pressure as a function of elapsed time having filtered and noise-free modeled data for the radial-spherical flow regime of FIG. 17, whereby the modeled formation build-up pressure is filtered using the band-stop filter and the formation pressure is extrapolated to estimate a formation build-up pressure for the radial-spherical flow regime, in accordance with an embodiment.
Figure 27:
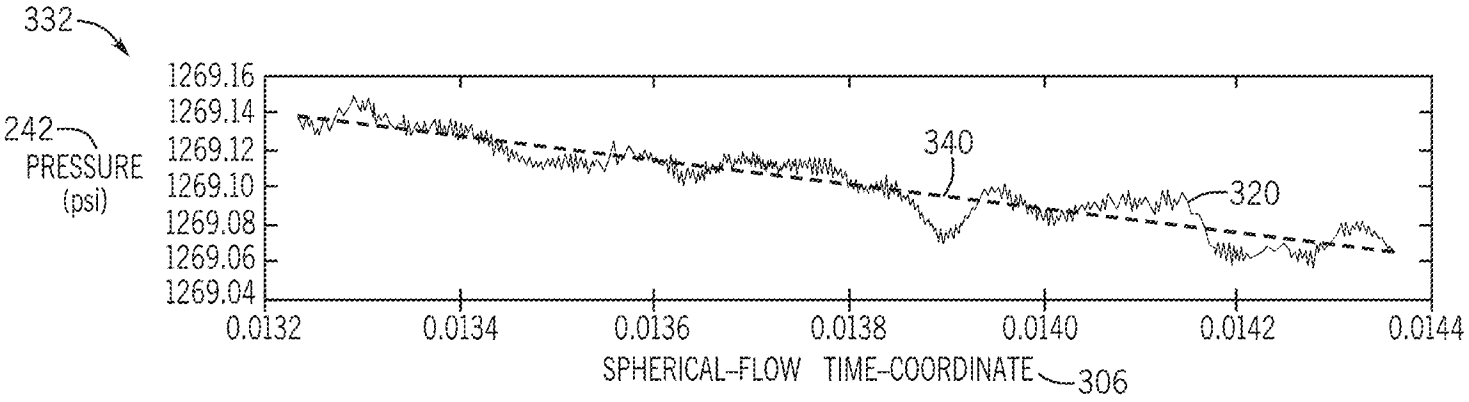
FIG. 27 is a representative plot of the modeled formation build-up pressure as a function of the spherical-flow time-coordinate having filtered and noise-free modeled data for the radial-spherical flow regime of FIG. 17, whereby the modeled formation build-up pressure is filtered using the band-stop filter and formation pressure is extrapolated to estimate a formation build-up pressure for the radial-spherical flow regime, in accordance with an embodiment.
Figure 28:
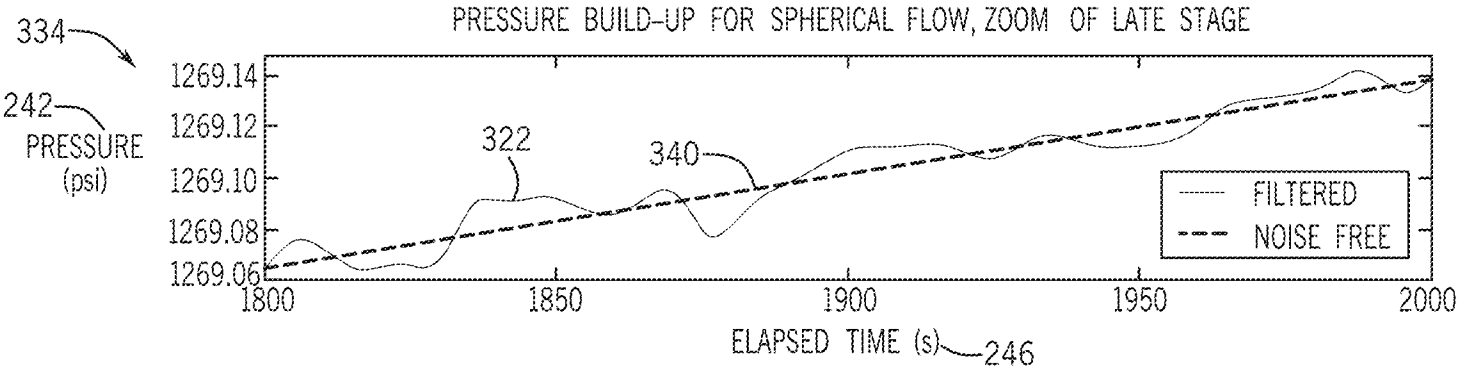
FIG. 28 is a representative plot of the modeled formation build-up pressure as a function of elapsed time having filtered and noise-free modeled data for the radial-spherical flow regime of FIG. 17, whereby the modeled formation build-up pressure is filtered using the low-pass filter and the formation pressure is extrapolated to estimate a formation build-up pressure for the radial-spherical flow regime, in accordance with an embodiment.
Figure 29:
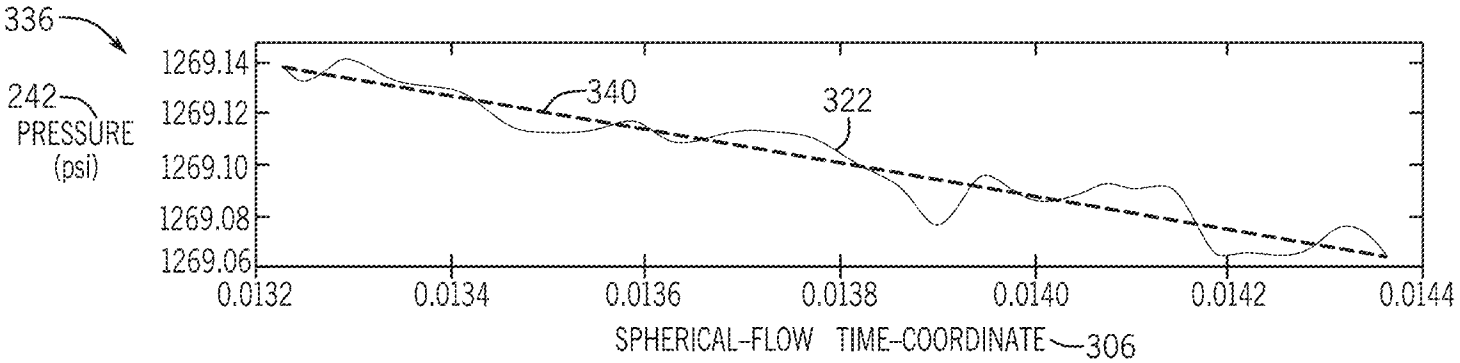
FIG. 29 is a representative plot of the modeled formation build-up pressure as a function of the spherical-flow time-coordinate having filtered and noise-free modeled data for the radial-spherical flow regime of FIG. 17, whereby the modeled formation build-up pressure is filtered using the low-pass filter and formation pressure is extrapolated to estimate a formation build-up pressure for the radial-spherical flow regime, in accordance with an embodiment.

Returning to the method of FIG. 4, the flowchart 220 further includes determining the formation build-up pressure based on extrapolation of the filtered formation pressure (block 328). For example, FIGS. 26 and 27 illustrate plots 330 and 332 of the build-up pressure data 308 without de-trending as a function of elapsed time 246 and the spherical-flow time coordinate 306, respectively, after filtering the build-up pressure data 308 with the band-stop filter. FIGS. 28 and 29 illustrate plots 334 and 336 of the build-up pressure data 308 without de-trending as a function of elapsed time 246 and the spherical-flow time coordinate 306, respectively, after filtering the build-up pressure data 308 with the low-pass filter. The plots 330, 332, 334, and 336 illustrate the filtered build-up pressure data 320, the low-pass filtered build-up pressure data 322, and the noise-free build-up pressure data 340 (e.g., build-up pressure that is not superimposed with the noise spectrum). As discussed above, the formation pressure used to model the build-up pressure was 1270 psi. As shown in FIGS. 26-29, the extrapolated build pressure obtained from the filtered build-up pressure data 320 and low-pass filtered build-up pressure data 322 is approximately 1269.984 psi after band-stop filtering and 1269.991 psi after low-pass filtering, which is very similar to the formation pressure of 1270 psi used to model the build-up pressure for the spherical flow regime. Accordingly, inferring filters from de-trended build-up pressure data and applying the filters to build-up pressure data (e.g., the build-up pressure data 308) may decrease an amount of uncertainty and improve the accuracy of the formation pressure of the wellbore over time determined using extrapolation techniques.

Similar experiments were done to determine the build-up pressure of the formation based on a cylindrical flow regime. In this particular embodiment, the formation is between (e.g., sandwiched) two impermeable boundaries spaced apart a desired distance. For example, the data presented below was determined using a distance of 10 meters between the two impermeable boundaries. As discussed above, for linear behavior to be observed, the cylindrical flow regime may be determined based on the following relationship:

$$\ln\frac{\Delta t + t_p}{\Delta t} \qquad \text{EQ. 4}$$

Figure 30:
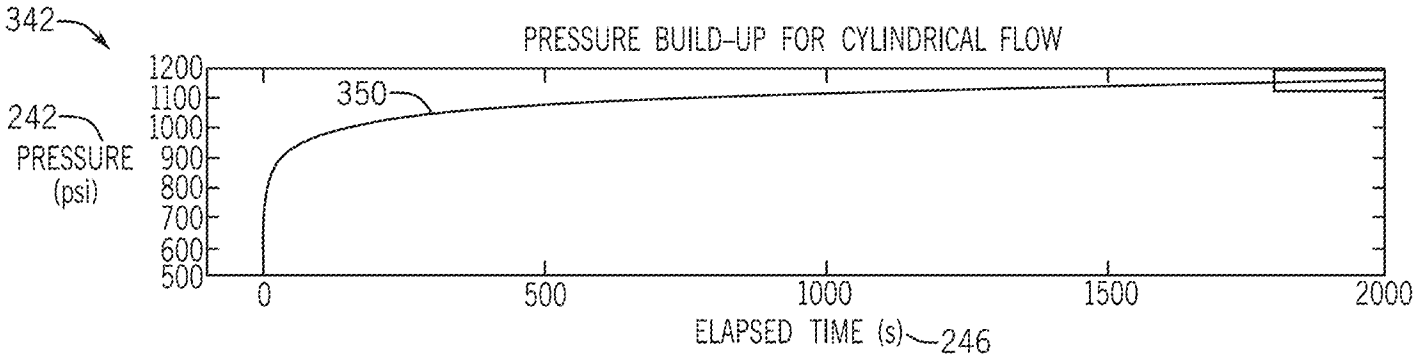
FIG. 30 is a representative plot of modeled formation build-up pressure as a function of elapsed time for a radial-cylindrical flow regime, in accordance with an embodiment.
Figure 31:
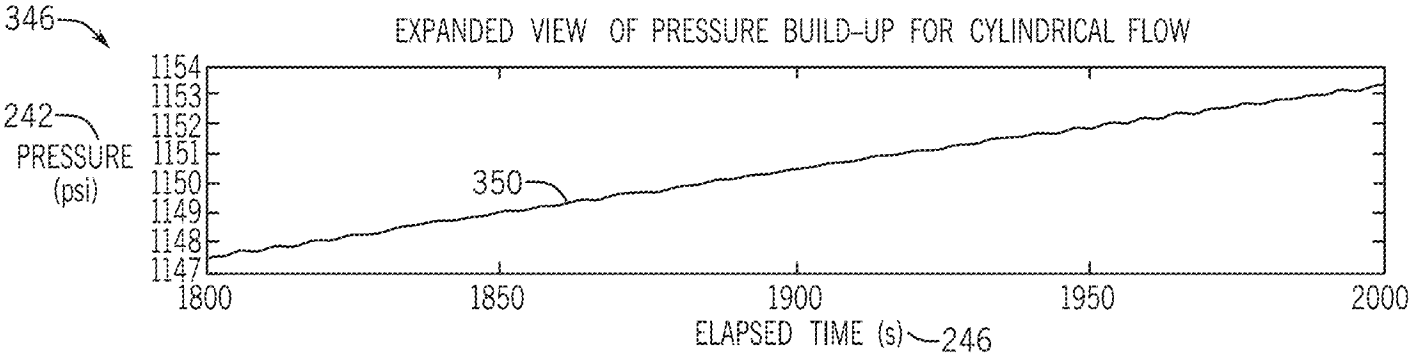
FIG. 31 is a representative plot of the modeled formation build-up pressure as a function of elapsed time for the radial-cylindrical flow regime of FIG. 30 showing the final 200 seconds of the modeled formation build-up pressure, in accordance with an embodiment.
Figure 32:
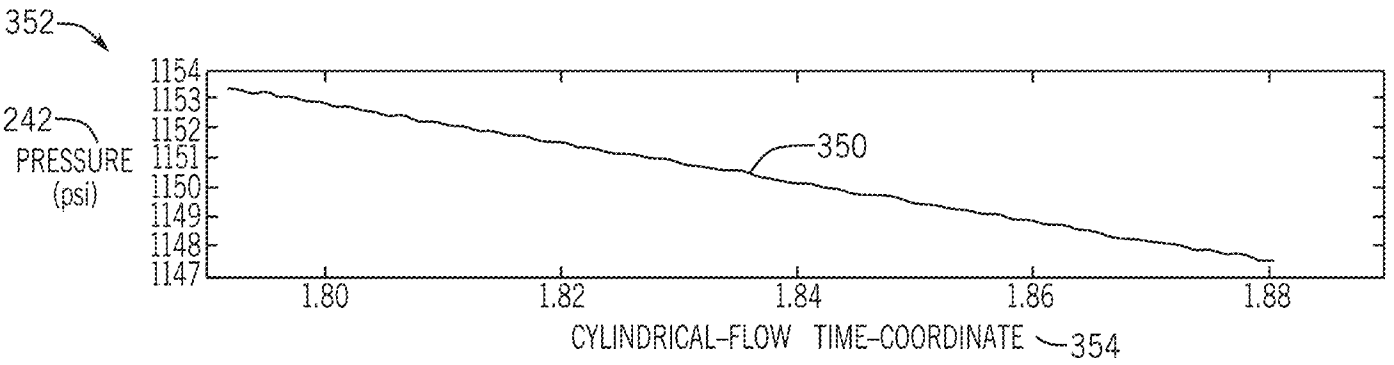
FIG. 32 is a representative plot of the modeled formation build-up pressure as a function of cylindrical-flow time-coordinate showing the final 200 seconds of the radial-cylindrical flow regime of FIG. 30, in accordance with an embodiment.

Similar to the spherical flow regime, the build-up pressure is modeled and a noise spectrum is added to the modeled build-up pressure, as shown in plots 342 and 346 illustrated in FIGS. 30 and 31, respectively. FIG. 31 is an expanded view of the last 200 seconds of cylindrical flow modeled build-up pressure data 350. FIG. 32 illustrates a plot 352 of the pressure 242 as a function of cylindrical-flow coordinate time 354.

Figure 33:
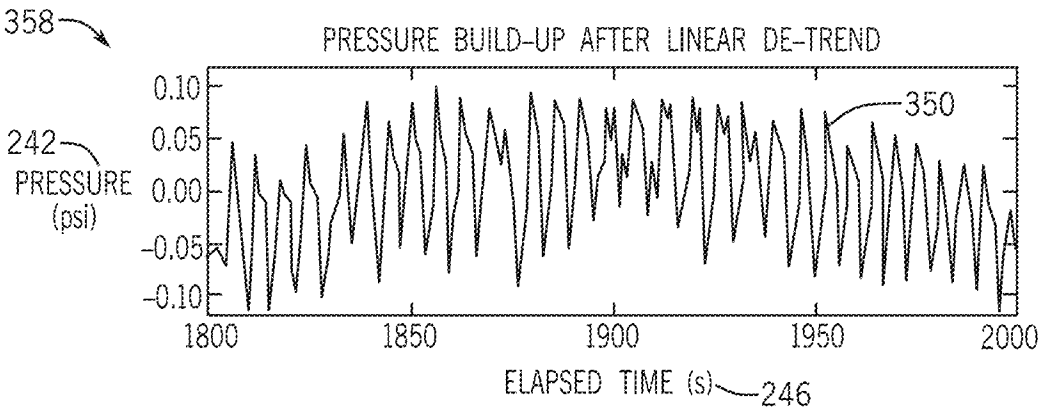
FIG. 33 is a representative plot of the modeled formation build-up pressure as a function of elapsed time for the radial-cylindrical flow regime of FIG. 30, whereby the measured pressure is de-trended to remove background trends, in accordance with an embodiment.
Figure 34:
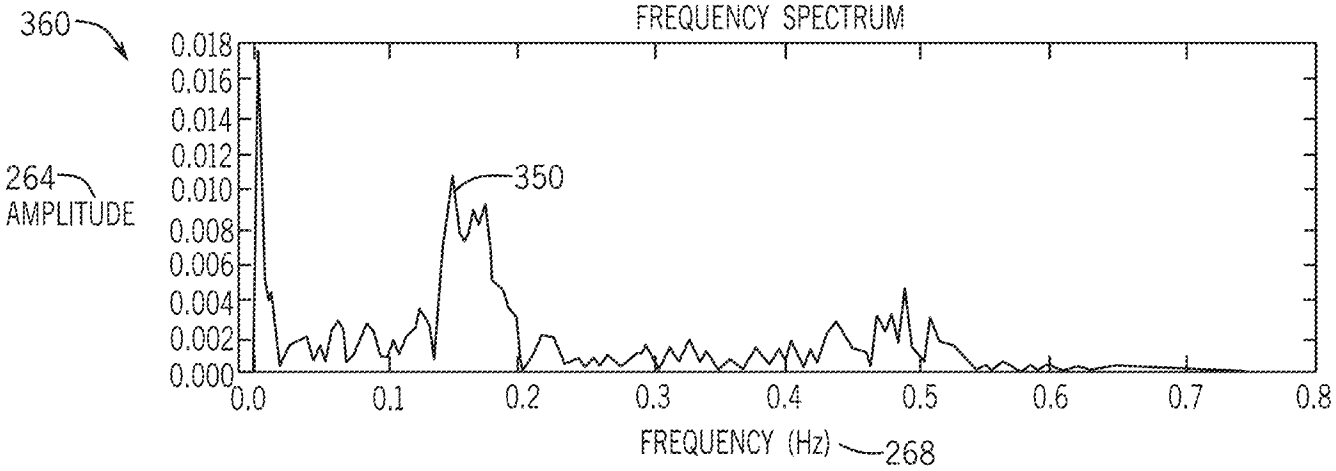
FIG. 34 is a representative plot of amplitude as a function of frequency for the radial-cylindrical flow regime of FIG. 30, in accordance with an embodiment.
Figure 35:
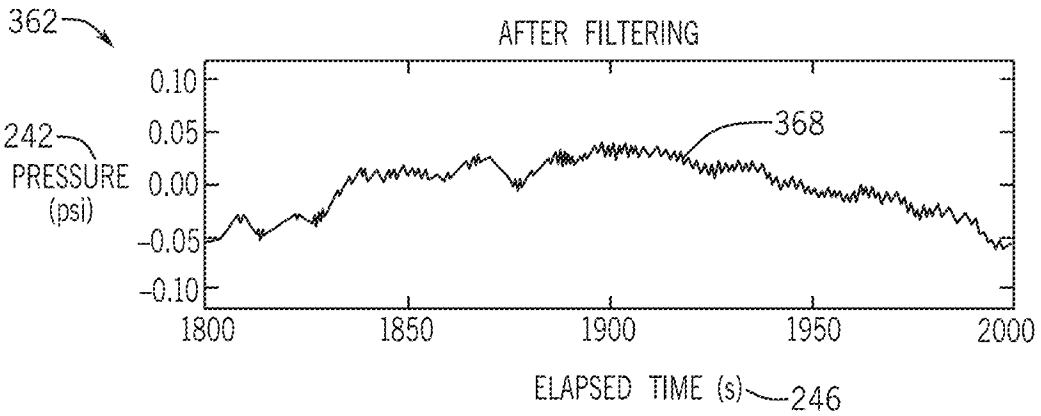
FIG. 35 is a representative plot of the modeled formation build-up pressure as a function of elapsed time for the radial-cylindrical flow regime of FIG. 30, whereby the measured formation pressure is filtered using a band-stop filter, in accordance with an embodiment.
Figure 36:
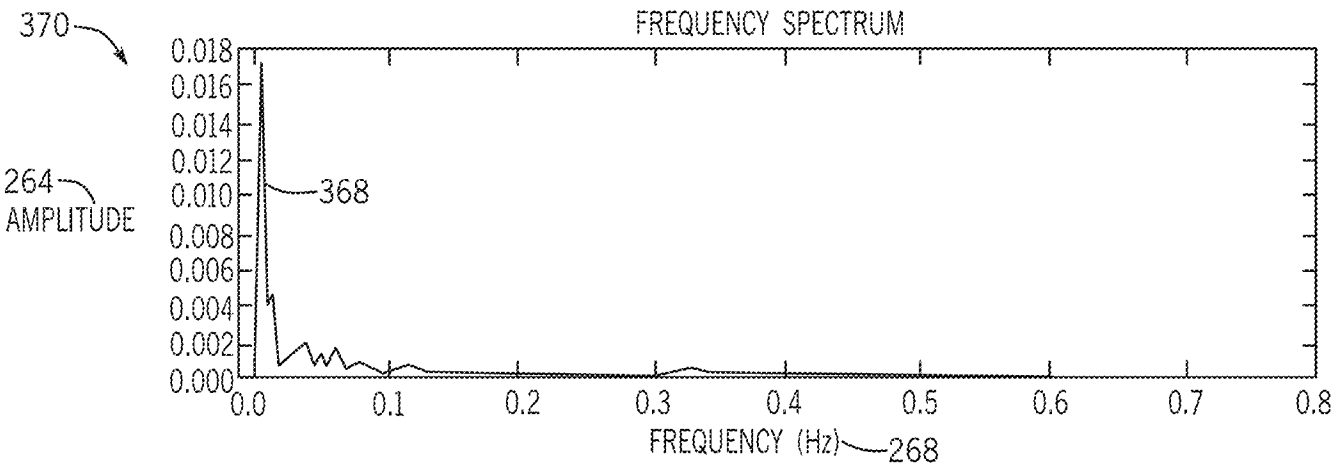
FIG. 36 is a representative plot of amplitude as a function of frequency for the radial-cylindrical flow regime of FIG. 30, whereby the measured formation pressure is filtered using a band-stop filter, in accordance with an embodiment.
Figure 37:
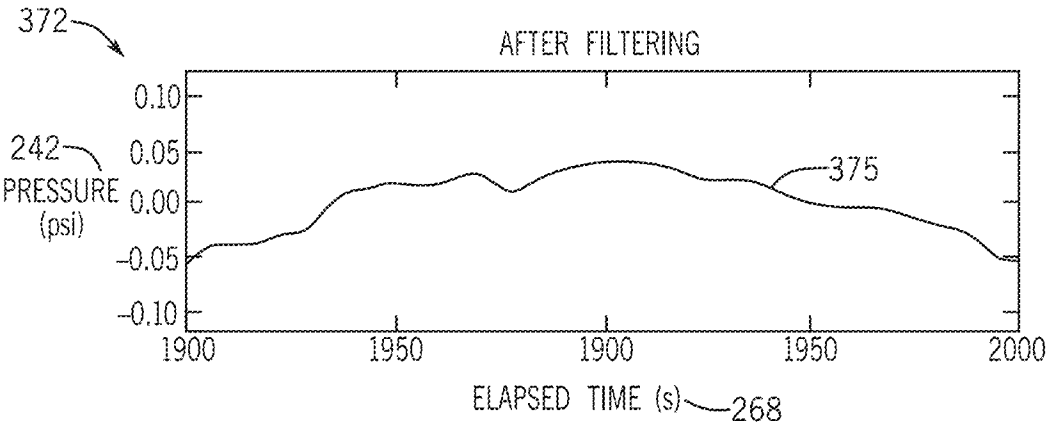
FIG. 37 is a representative plot of the modeled formation build-up pressure as a function of elapsed time for the radial-cylindrical flow regime of FIG. 30, whereby the measured formation pressure is filtered using a low-pass filter, in accordance with an embodiment.
Figure 38:
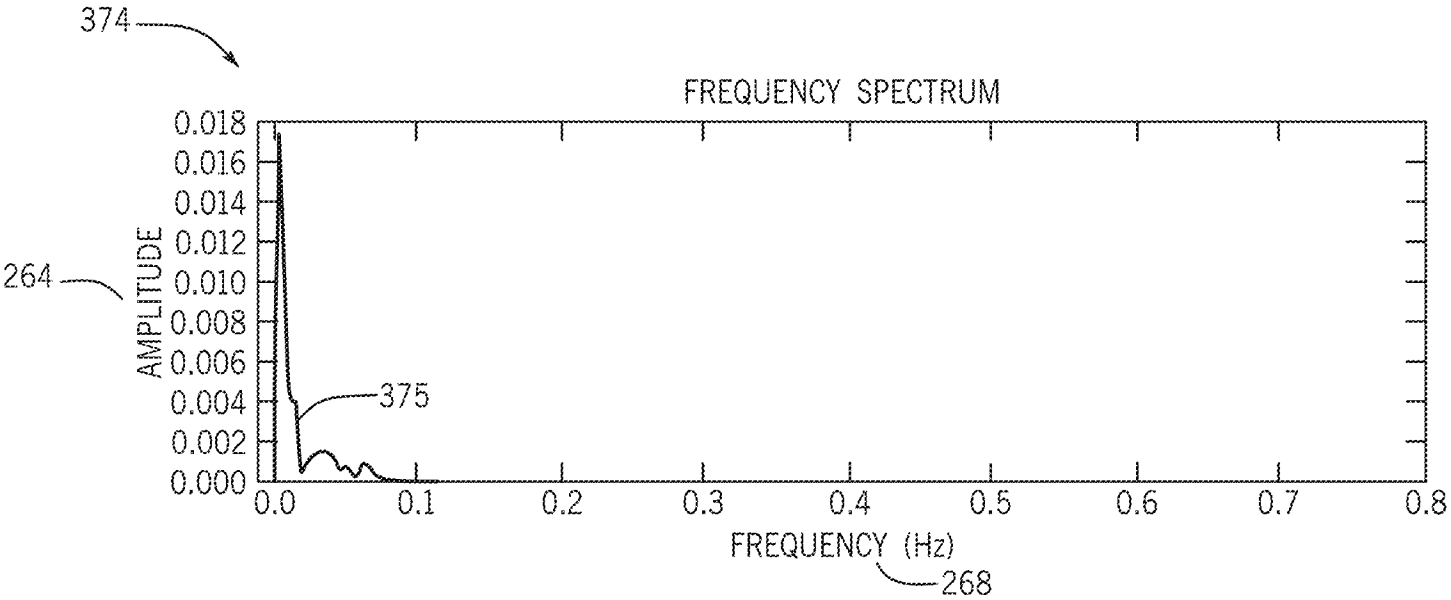
FIG. 38 is a representative plot of amplitude as a function of frequency for the radial-cylindrical flow regime of FIG. 30, whereby the measured formation pressure is filtered using a low-pass filter, in accordance with an embodiment.

The cylindrical flow modeled build-up pressure data 350 was de-trended to remove background linear trends and facilitate identification of the frequency at which the pressure oscillations occur. FIGS. 33 and 34 illustrates a plot 358, 360, respectively, of the de-trended cylindrical flow modeled build-up pressure data 350 before filtering the modeled build-up pressure data 350 and its spectral characteristic. Similar to the spherical flow regime example above, applying inferred filters to the cylindrical flow modeled build-up pressure data 350 removes the noise (e.g., pressure oscillations) and allows for a more accurate estimate of the formation build-up pressure. For example, FIGS. 35-38 illustrates filtered modeled build-up pressure data 368 for the cylindrical flow regime. FIGS. 35 and 36 illustrate plots 362, 370, respectively, for the filtered modeled build-up de-trended pressure data 368 filtered using a band-stop filter and its spectrum. FIGS. 37 and 38 illustrate plots 372 and 374, respectively, for the filtered modeled build-up de-trended pressure data 375 filtered using a low-pass filter and its spectrum.

Figure 39:
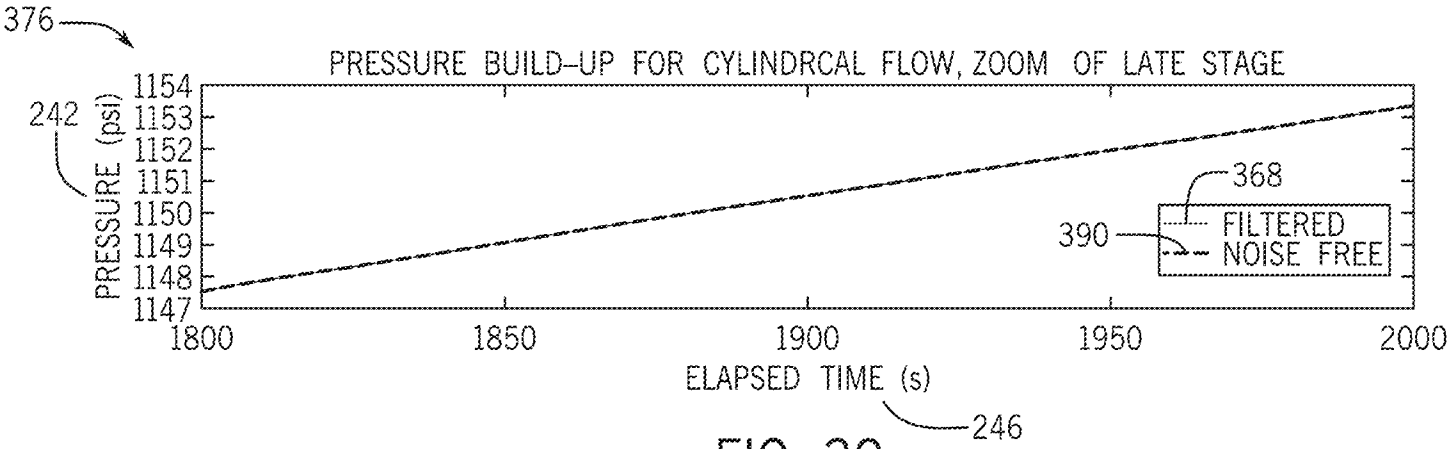
FIG. 39 is a representative plot of the modeled formation build-up pressure as a function of elapsed time having filtered and noise-free modeled data for the radial-cylindrical flow regime of FIG. 30, whereby the modeled formation build-up pressure is filtered using the band-stop filter and the formation pressure is extrapolated to estimate a formation build-up pressure for the radial-cylindrical flow regime, in accordance with an embodiment.
Figure 40:
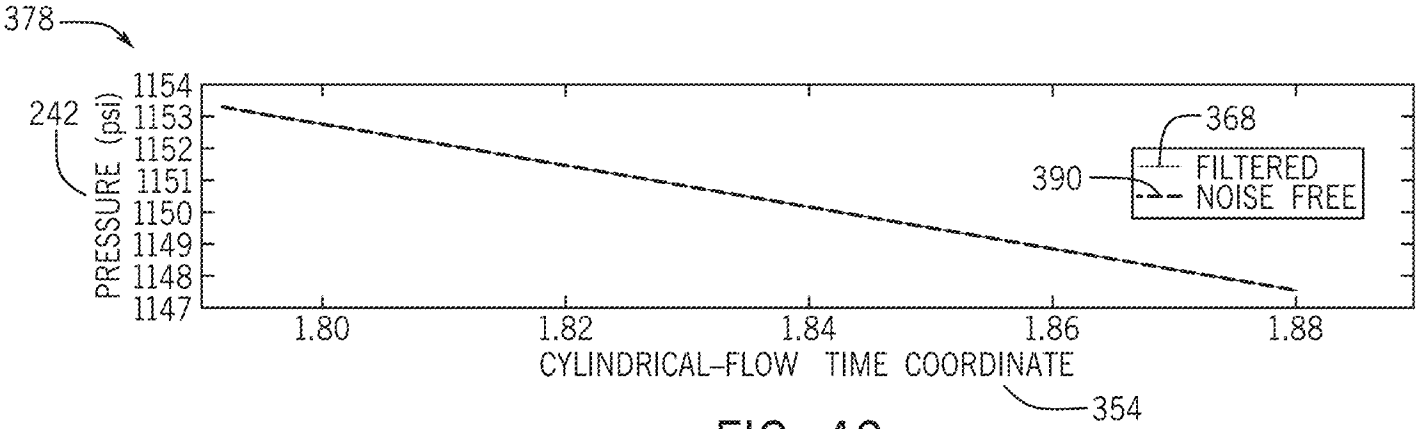
FIG. 40 is a representative plot of the modeled formation build-up pressure as a function of the cylindrical-flow time-coordinate having filtered and noise-free modeled data for the radial-cylindrical flow regime of FIG. 30, whereby the modeled formation build-up pressure is filtered using the band-stop filter and formation pressure is extrapolated to estimate a formation build-up pressure for the radial-cylindrical flow regime, in accordance with an embodiment.
Figure 41:
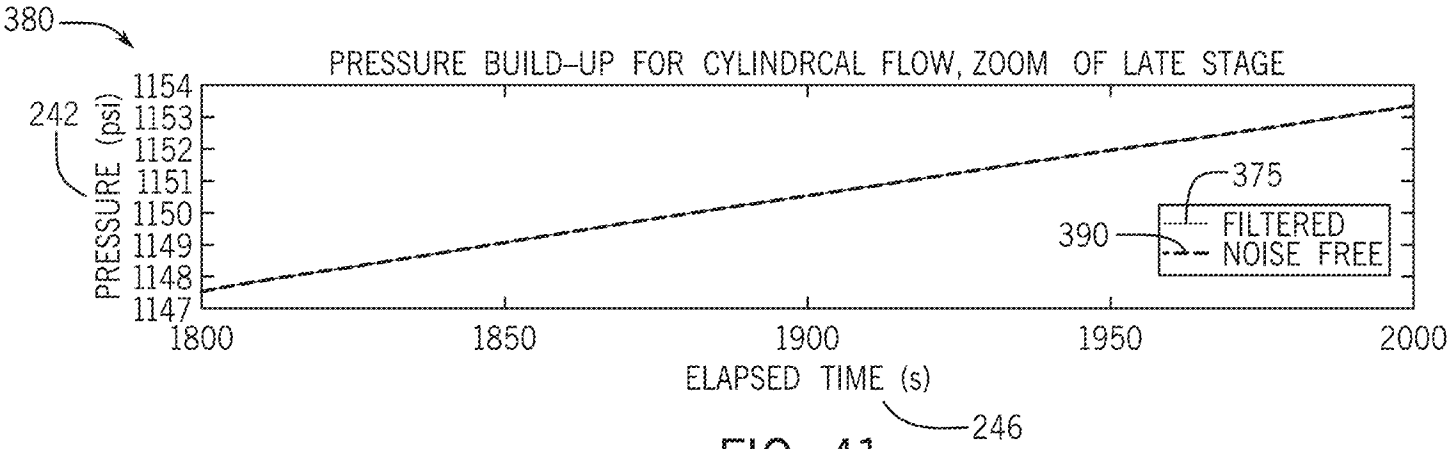
FIG. 41 is a representative plot of the modeled formation build-up pressure as a function of elapsed time having filtered and noise-free modeled data for the radial-cylindrical flow regime of FIG. 30, whereby the modeled formation build-up pressure is filtered using the low-pass filter and the formation pressure is extrapolated to estimate a formation build-up pressure for the radial-cylindrical flow regime, in accordance with an embodiment.
Figure 42:
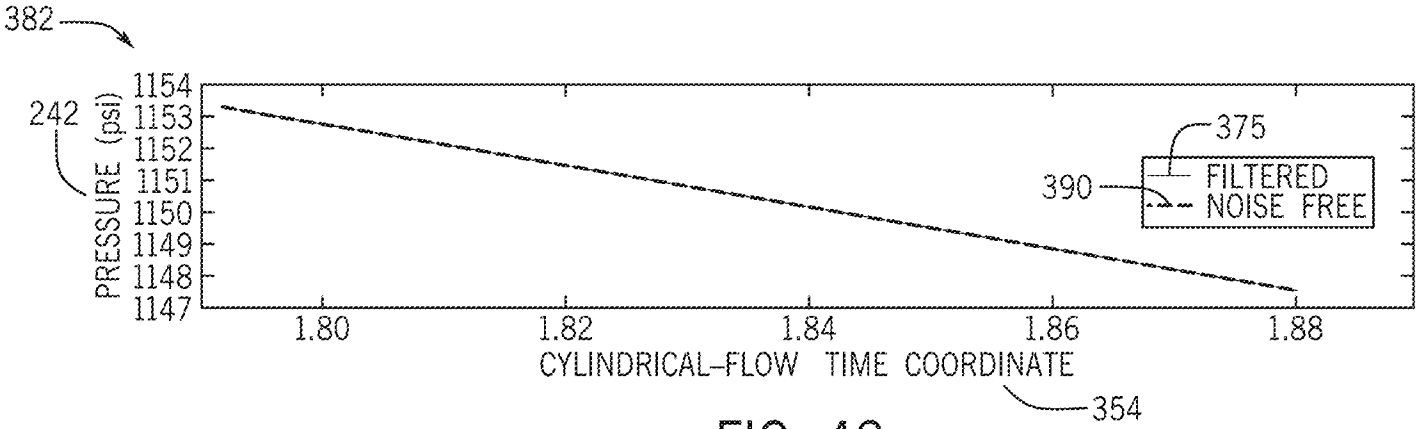
FIG. 42 is a representative plot of the modeled formation build-up pressure as a function of the cylindrical-flow time coordinate having filtered and noise-free modeled data for the radial-cylindrical flow regime of FIG. 30, whereby the modeled formation build-up pressure is filtered using the low-pass filter and the formation pressure is extrapolated to estimate a formation build-up pressure for the radial-cylindrical flow regime, in accordance with an embodiment.

FIGS. 39 and 40 illustrate plots 376 and 378 of the filtered modeled build-up pressure data 368 as a function of elapsed time 246 and the cylindrical-flow time coordinate 354, respectively, after filtering the modeled build-up pressure data 350 with the inferred band-stop filter from the de-trended build-up pressure data. Similarly, FIGS. 41 and 42 illustrate plots 380 and 382 of the filtered modeled build-up pressure data 368 as a function of elapsed time 246 and the cylindrical-flow time coordinate 354, respectively, after filtering the modeled build-up pressure data 350 with the low-pass filter inferred from the de-trended build-up pressure data. The plots 376, 380 illustrate the filtered modeled build-up pressure data 368, 375 and noise-free modeled build-up pressure data 390 (e.g., build-up pressure that is not superimposed with the noise spectrum). As discussed above, the formation pressure used to model the build-up pressure was 1270 psi. As shown in FIGS. 39-42, the extrapolated build pressure obtained from the filtered modeled build-up pressure data 368, 375 is approximately 1269.974 psi after band-stop filtering and 1269.985 psi after low-pass filtering, which are close to the formation pressure of 1270 psi used to model the build-up pressure for the cylindrical flow regime. As such, low-pass and band-stop filters may be used to effectively filter out formation/wellbore noise due to fluctuations in the mud level.

Additionally or alternatively to the low-pass and/or band-stop filters discussed above, embodiments of the present disclosure also include using a non-linear filter to process the noisy pressure data. By way of non-limiting example, the non-linear filters may include, Wiener filters, E filters, wavelet filters, or a combination thereof. As discussed in further detail below, using non-linear filters may improve processing of the noisy pressure data by smoothing out oscillatory noise while minimizing clipping and loss of the pressure information. Additionally, the non-linear filtered pressure data may be used to obtain more accurate pressure derivatives when compared to the noisy pressure data or linear filtered pressure data. Pressure derivatives are useful for identifying flow regimes e.g., cylindrical or spherical flow or linear flow etc.

Figure 43:
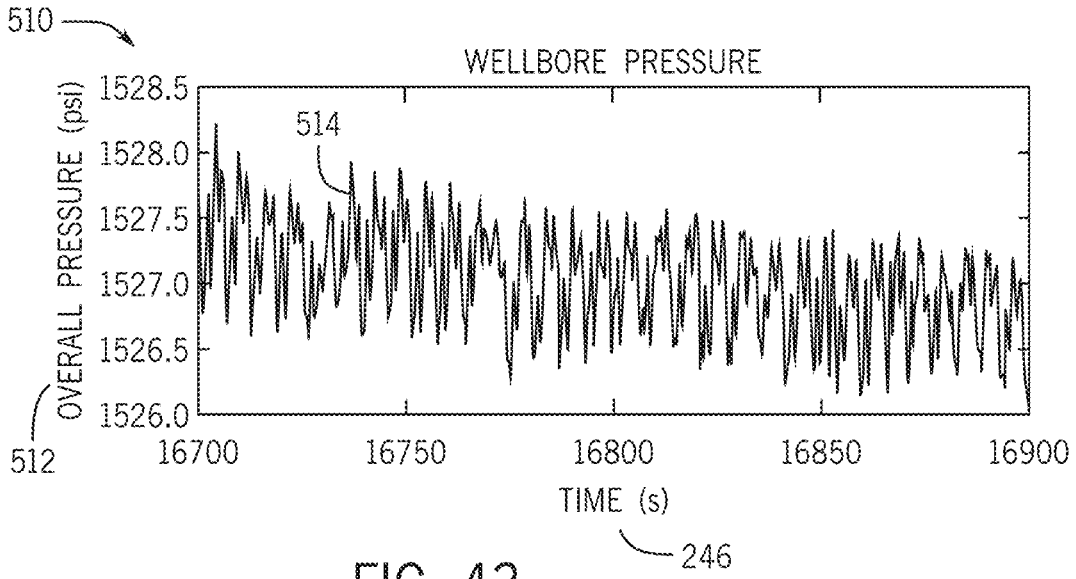
FIG. 43 is a plot of measured wellbore pressure as a function of elapsed time for wellbore undergoing formation testing's build-up, in accordance with an embodiment.
Figure 44:
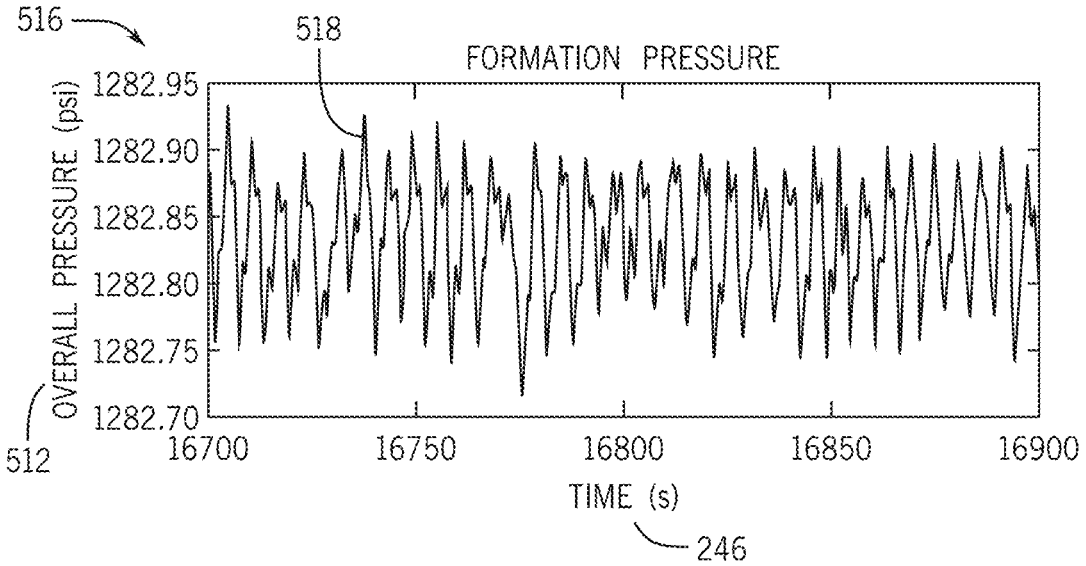
FIG. 44 is a plot of measured formation pressure during build-up as a function of elapsed time, in accordance with an embodiment.

As discussed above, wellbore environments that include pump-out rates greater than the wellbore is able to accommodate (e.g., greater than approximately 50 mL/s, greater than approximately 75 mL/s, or greater than approximately 100 mL/s). As such, drilling mud 32 may be pumped into or out of the wellbore 14 to maintain the amount of fluid in the wellbore 14 within a desirable range. Furthermore, a downhole acquisition tool 12 operating in such conditions may incur pressure oscillations/noise due, in part, to the fluctuations in the amount of drilling mud 32 in the wellbore 14 causing an attenuated oscillating formation pressure response resulting from, for example, pressure communication through the mud-cake from the wellbore 14 to the formation 20. As with the low-pass and band-stop filters, the input data may be de-trended for easier viewing and spectral analysis. However, in some embodiments, the nonlinear filtering may be applied to data without de-trending. For example FIG. 43 is a plot 510 of the overall pressure 512 as a function of time 246 of example wellbore pressure data 514, as measured in a field test of a wellbore (e.g., wellbore 14). Similarly, FIG. 44 is a plot 516 of the overall pressure 512 as a function of time 246 of example formation pressure data 518, measured in a field test of a formation (e.g., the formation 20).

Figure 45:
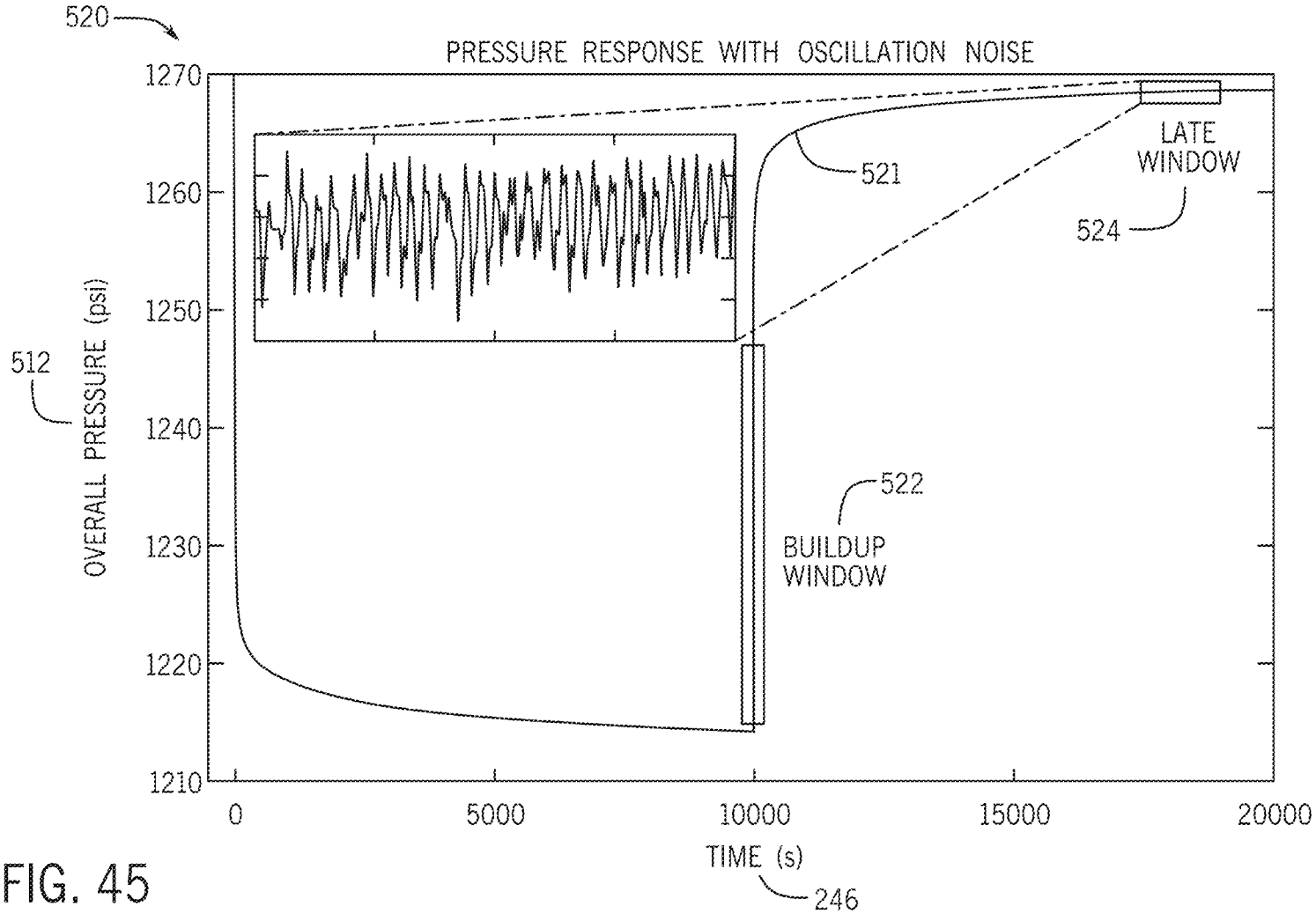
FIG. 45 is a representative plot of measured formation pressure as a function of elapsed time over a period including a pressure build-up in accordance with an embodiment.

As discussed above, the low-pass and/or band-stop filters may remove noise from the pressure data 248, 252, 514, 518. However, at times during a sudden increase in pressure, such as the pressure build-up caused by a shut-in, a sudden increase in pressure may occur. A set of pressure data over a longer time period including both the pressure build-up and a relatively steady state condition (e.g., the variation in pressure is less than approximately 2%, 5%, or 10% of the total pressure variation), contains a broad-band spectrum, and may be difficult to filter using a low-pass and/or band-stop filter. To help illustrate the effectiveness of different filters and evaluate filters over the longer time period, a synthetic pressure response over a broader time scale may be generated. FIG. 45 is a plot 520 of the overall pressure 512 versus time 246 of a set of synthetic pressure data 521 over a time period including both a build-up window 522 (e.g., the sudden increase in pressure) and a late window 524 (e.g., the relatively steady-state condition).

At later times (e.g., the late window 524, when the pressure data 521 has reached the relatively steady-state condition the pressure data 521 contains small frequencies (e.g., less than approximately 1 Hz or less than approximately 5 Hz) driven by noise caused by the wellbore variations in mud height and the intrinsic noise of the measurement system. In contrast, earlier times (e.g., times including a pressure build-up, for example, caused by shut-in) contain a fairly broad-band spectrum and may be difficult to filter. The marked difference in pressure data characteristics at different times (e.g., during drawdown, flow into the tool, or build-up when tool pump is stopped) indicates that the energy content, or spectral amplitude square of the pressure data 521 varies depending on a region of interest in time 246. Accordingly, a band-stop algorithm constructed based on the noise characteristics of the pressure data 521 may yield inaccuracies at time intervals where the noise free data contains frequencies also present in the noise, since a portion of the pressure data 521 may be removed. However, by using a nonlinear filter the oscillation noise may be suppressed while retaining the sharp changes in the pressure data 521. Suppression of the noise and retention of the sharp changes in pressure data 521 with substantial accuracy (e.g., above approximately 85%, 90%, or 95% based on the metric defined below) obtained by using one or more non-linear filters has not been previously observed using linear filters.

To achieve attenuation of the oscillatory noise and to extract an unbiased formation pressure response, multiple different types of non-linear filters are discussed herein. In one embodiment non-frequency-domain based de-noising is achieved by utilizing non-linear filters such as a Wiener filter followed by an E filter, together referred to as a Wiener-E filter. The Wiener filter is essentially an amplitude-based filter and the E filter transforms and processes a signal in a defined E domain. Both Wiener filters and E filters suppress an adjustable frequency of noise, with amplitude below an adjustable threshold, while retaining the frequencies with an amplitude above the threshold. This may be desirable so as to retain the relevant spectral features of the pressure data 521 that may otherwise have been removed. Combining two filters, such as the Wiener and E filters, may provide stability and highly selective attenuation of the noise.

Figure 46:
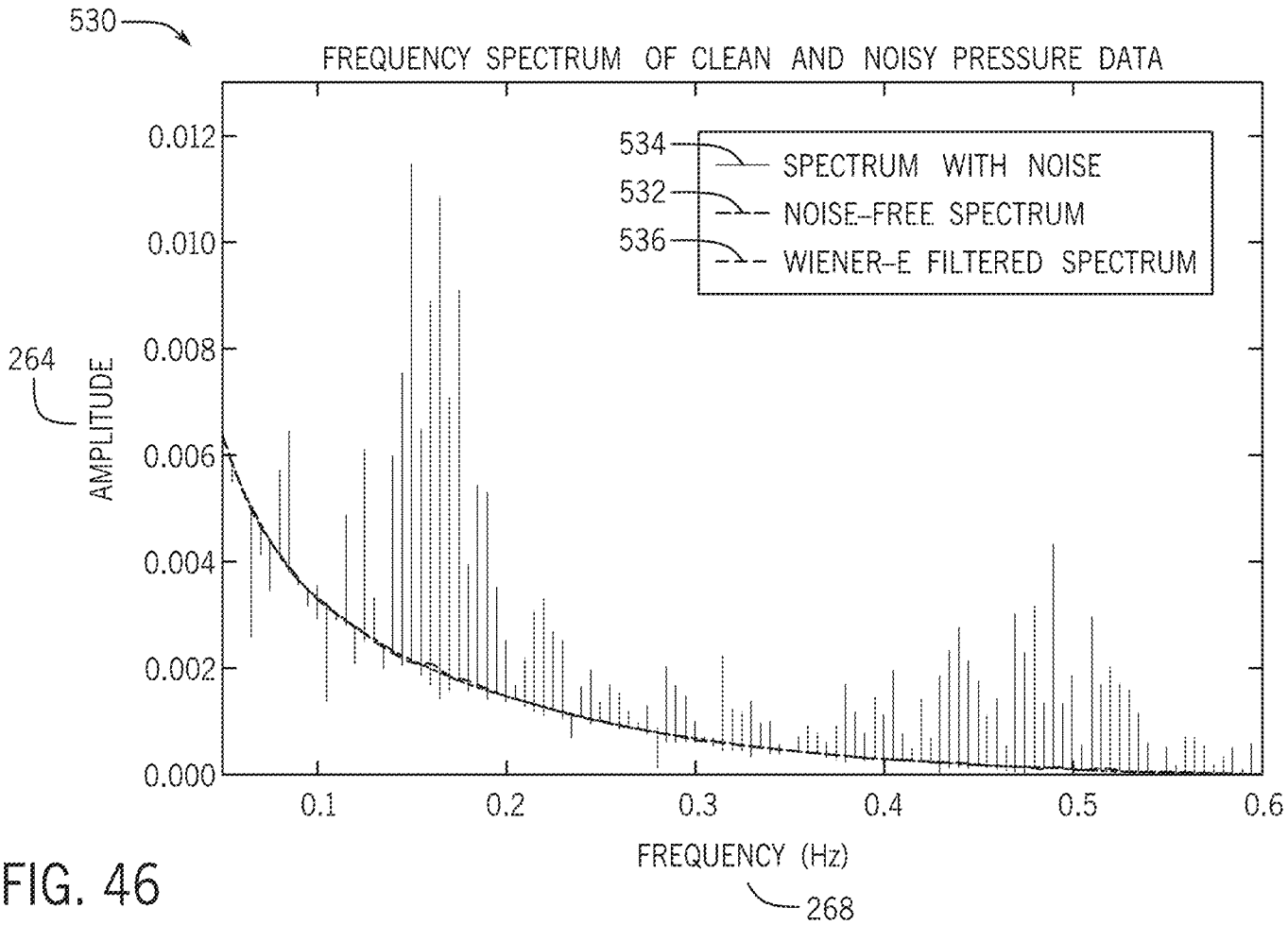
FIG. 46 is a representative plot of amplitude as a function of frequency of noise free pressure data, noisy pressure data, and filtered pressure data, in accordance with an embodiment.

To help illustrate the benefits of such a Wiener-E filter, FIG. 46 is a plot 530 of the amplitude 264 as a function of frequency 268 in hertz of the pressure data 521. A noise-free spectrum 532 of the noise-free data is shown for reference along with a spectrum with noise 534 and a Wiener-E filtered spectrum 536. As shown, the Wiener-E filtered spectrum 536 maintains accuracy throughout the range of shown frequencies 268 by eliminating noise while keeping the appropriate amplitudes 264 of the noise free spectrum 532.

The use of non-linear filters may be embodied in a similar manner to that of the low-pass and band-stop filters, such as illustrated by the flowchart 220 of FIG. 4. For example, when the spectral characteristics of the wellbore and formation pressure are determined (block 256) the dominant period and amplitude of the pressure data of interest may be used to properly set the filtering parameters in the Wiener filter and E filter and the filters may be applied (block 270).

The Wiener filter can be applied in multiple different ways. In one embodiment, it may be used as a local mean/median filter to efficiently remove the noise. Statistics of the pressure data 521 may be calculated to estimate the mean value and the standard deviation. The pressure data 521 may be processed differently depending on whether the local standard deviation is larger than an estimated value of the oscillation noise as illustrated by EQ. 5 below. It is presently recognized that the pair of median and median absolute deviation values may also be used instead of the mean and standard deviation pair for the local signal. In fact, the pair of median and median absolute deviation values has better performance where the noise is not symmetric and contains many outliers compared to the use of the mean and standard deviation. The equation summarizing the Wiener filter is $$y = \begin{cases} \frac{\sigma}{\sigma_x} E_x + \left(1 - \frac{\sigma}{\sigma_x}\right) x & \sigma_x \geq \sigma \\ E_x & \sigma_x < \sigma \end{cases}, \qquad \text{EQ. 5}$$

where x is the input pressure data 521, and y is the filtered output, $E_x$ is the local mean or median, $\sigma_x$ is the local standard deviation or median absolute deviation, and $\sigma$ is the user-input estimated standard deviation or median absolute deviation of the noise to be removed. In one embodiment, $\sigma$ is set to the estimated value of noise amplitude.

An E-filter processes the signal in a way that it not only depends on the signal frequency, but also distinguishes the signal within certain frequencies based on the amplitude. Transfer from t domain to e domain follows the rule:

$$e = \theta(t) = \int_0^t \sqrt{1 + (\dot{x}(t))^2}\, dt. \qquad \text{EQ. 6}$$

where a dot above a variable means a derivative with respect to time.

The input signal may be represented in both time domain, as x(t), or in e-domain, as $f(e)=x(\theta^{-1}(e))$. Filtering may be accomplished in the time domain or the e-domain. For example, filtering in the e-domain uses the following relationship:

$$f^*(e)=f(e)*h(e), \quad \text{EQ. 7}$$

where h(e) is a low-pass filter impulse response and f*(e) is the filtered signal in e-domain. Post filtering, the processed signal is transformed back into time domain using the following relationship:

$$y(t)=f^*(\theta(t)), \quad \text{EQ. 8}$$

and is expected to be a representation of the noise free pressure data.

For any periodic signal x(t) with periodicity T, f(e) is also periodic and the period $T_e=(\theta(T))$. $T_e$ is bounded by $X_0(T)$ and $X_1(T)$, i.e., $X_0(T)\leq T_e\leq X_1(T)$. The bounds are given by $$X_0(T)=\int_0^T\sqrt{(\dot{x}(t))^2}dt=\int_0^T|\dot{x}(t)|dt, \quad \text{EQ. 9}$$

and $$X_1(T)=\int_0^T(1+\sqrt{(\dot{x}(t))^2})dt=T+X_0(T), \quad \text{EQ. 10}$$

In such an embodiment, x(t) and t may be scaled and made suitably dimensionless. The scale is selected such that the relevant pressure data 521 is retained and the undesirable noise is removed.

$T_e$ may be set to $X_0(T)+\alpha_T$, where $0\leq\alpha\leq1$. Furthermore, $X_0(T)$ may be set to $\beta A_M$, where $A_M$ is the maximum amplitude of x(t), meaning that $X_0(T)$ is proportional to the amplitude 264, $A_M$, of the pressure data. β may be used as a constant, and in some embodiments, is bounded above by two times the total number of peaks and troughs within a time period. If it is assumed that the e-domain low-pass filter suppresses higher frequency energy above a cutting point ($T_e>T_c$ may pass through the filter), the following relationship is obtained:

$$\beta A_M+\alpha T>T_c. \quad \text{EQ. 11}$$

EQ. 11 shows that the E filter allows low frequencies (implies large T) and large amplitudes of the pressure data 521 to pass. However, the high frequencies (small T) with small (in relation to the inequality of EQ. 11) amplitudes are suppressed. Therefore, the E filter enables processing noisy pressure response data that contain sudden changes such as a pressure buildup shown in the buildup window 522. The sudden changes may occur, for example, at shut-in (e.g., the onset of build-up).

In addition to visual observations that demonstrate the effectiveness of the Wiener-E filter, as shown in FIG. 46, quantitative metrics may also be used to evaluate the effectiveness of different types of filters. For example, a measure of noise removal may be given by the following:

$$P_n=1-\frac{\sum|y[i]-x_0[i]|}{\sum|x[i]-x_0[i]|}, \quad \text{EQ. 12}$$

where y, $x_0$, and x are filtered, noise-free, and noisy pressure data, respectively, and n represents a type of filter. In cases where the filtered pressure data is biased away from the noise-free pressure data, $P_n$ will decrease. Table 1 shows the percentage of noise removal for a variety of filters based on the synthetically generated noisy pressure data 521. The non-linear filters used for comparison with the Wiener-E filter are discussed in the section below.

TABLE 1

Noise removal metric percentage for different filters

| | Filter | | | | | | |
|---|---|---|---|---|---|---|---|
| | Wiener-E | Wiener | E | Haar Wavelet | db8 Wavelet | Bessel | FIR |
| Noise Removal | 96.6% | 90.7% | 90.4% | 59.3% | 83.4% | 76.8% | 77.5% |

Figure 47:
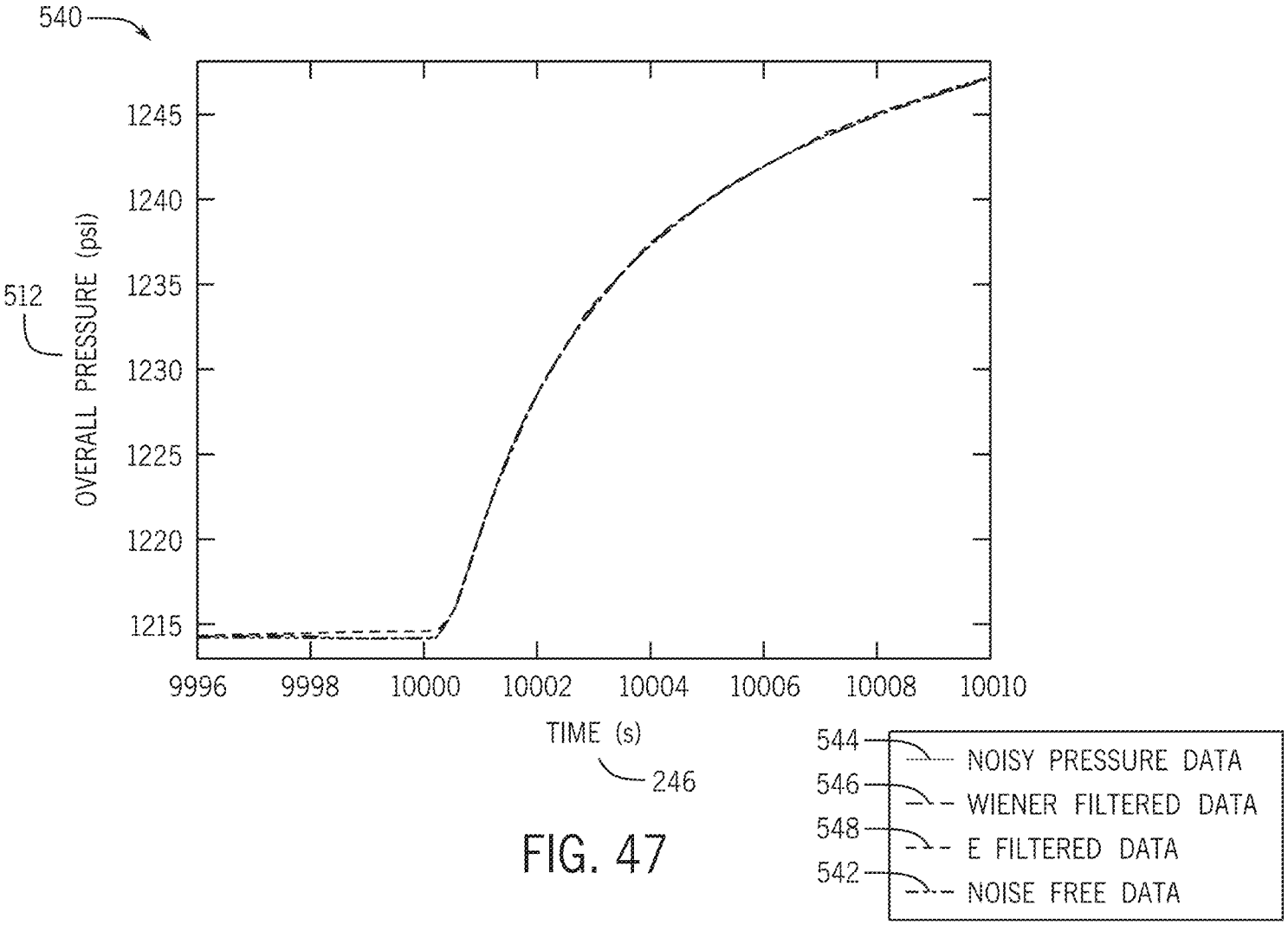
FIG. 47 is a representative plot of measured formation overall pressure as a function of elapsed time over a pressure build-up period including noise-free pressure data, noisy pressure data, and filtered pressure data, in accordance with an embodiment.
Figure 48:
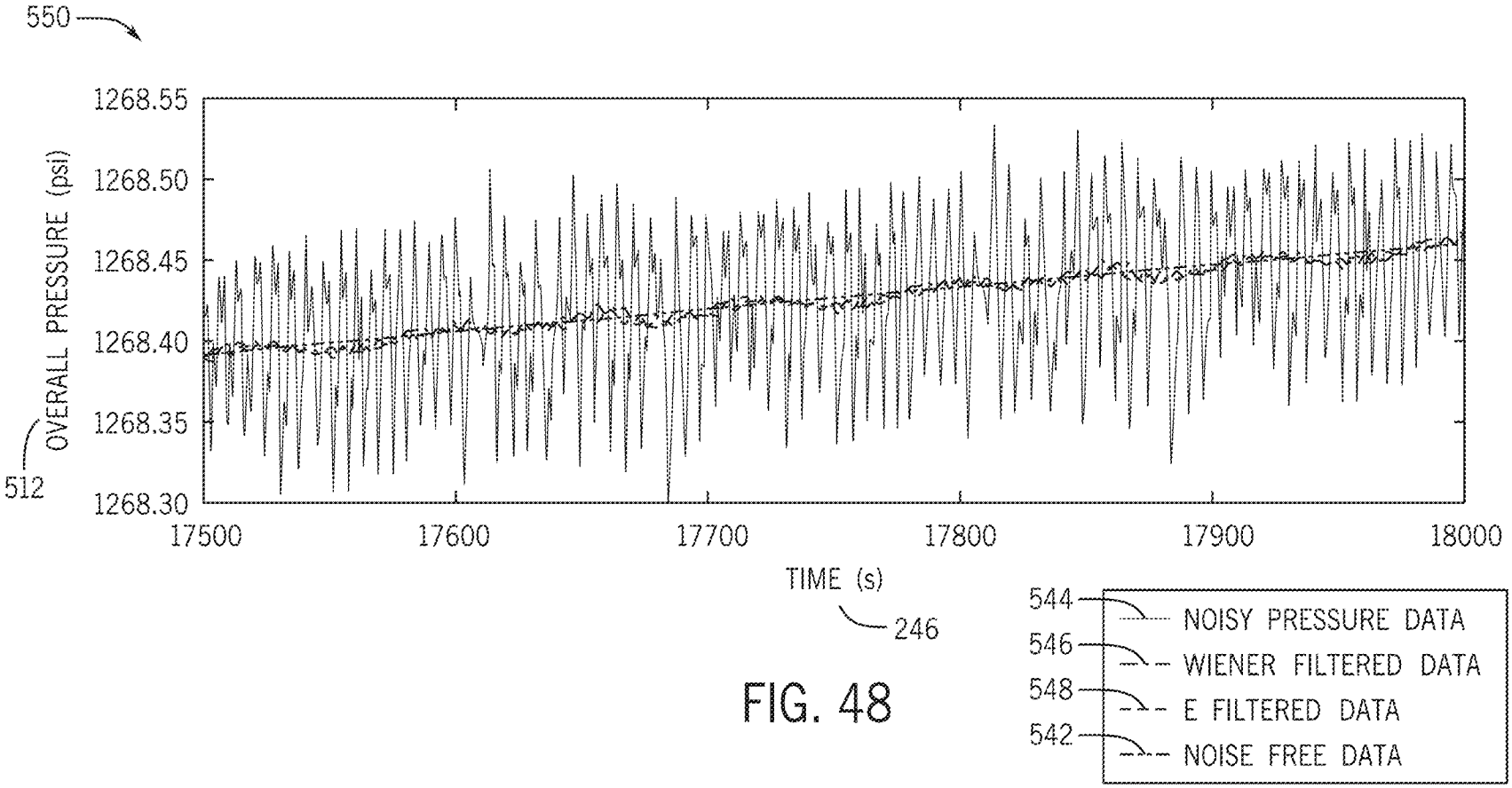
FIG. 48 is a representative plot of measured formation overall pressure as a function of elapsed time over a time period after pressure build-up including noise free pressure data, noisy pressure data, and filtered pressure data, in accordance with an embodiment.

In testing of the Wiener and E filters individually on the pressure data 521, the overall noise reduction for the entire time period by the Wiener filter or E filter is over 90%, as shown in Table 1. FIG. 47 is a plot 540 of the overall pressure 512 as a function of time 246 of noise free data 542, noisy pressure data 544, which is indicative of the pressure data 521, Wiener filtered data 546, and E filtered data 548 during the time period of the buildup window 522. As shown in FIG. 48, the overall pressure 512, in plot 550, some undesirable high-frequency oscillation noise is still present for both the Wiener filtered data 546 and the E filtered data 548 corresponding to the late-time window of FIG. 45. The presence of the high frequency oscillation noise may hinder computations of local derivatives.

Figure 49:
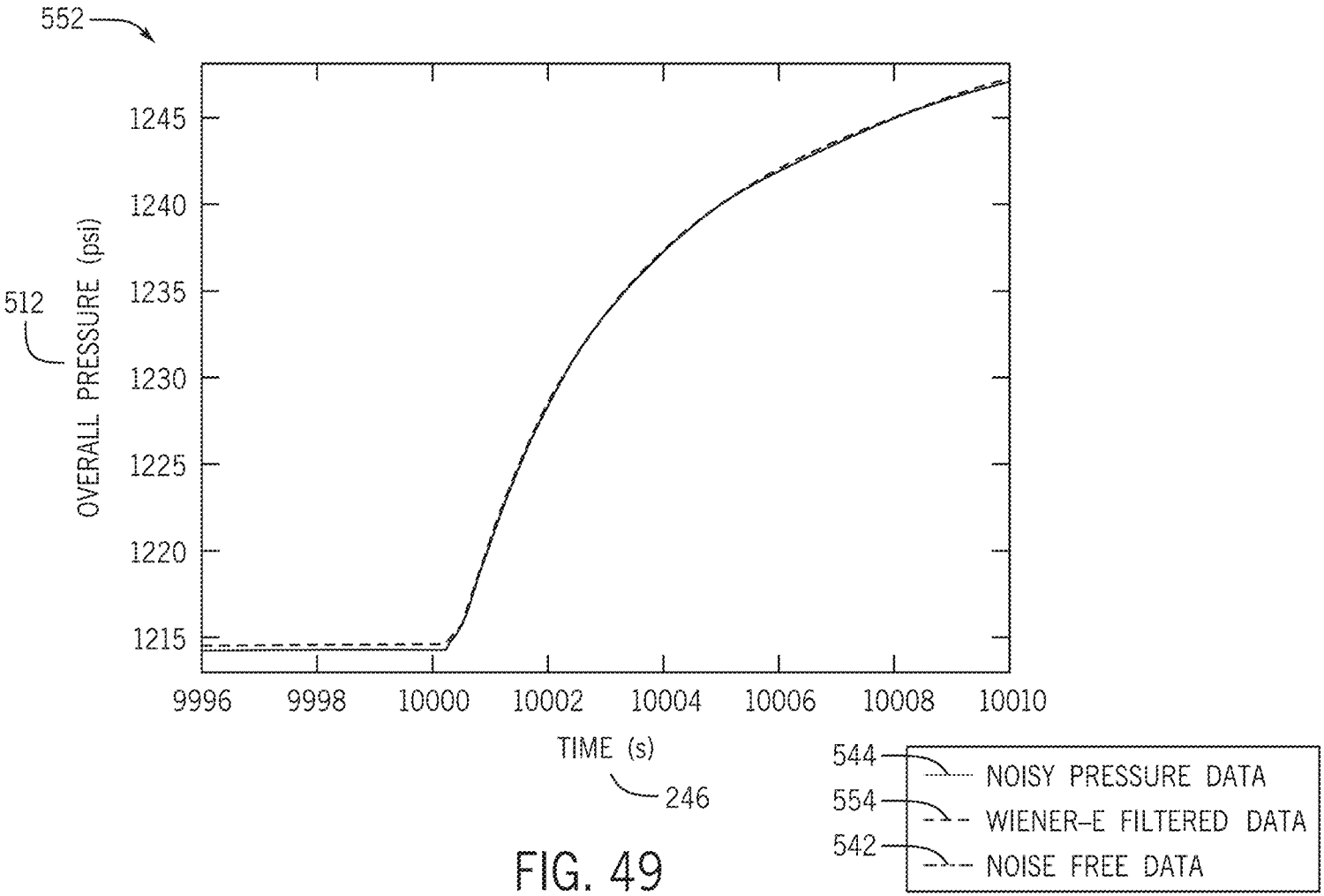
FIG. 49 is a representative plot of measured formation overall pressure as a function of elapsed time over a pressure build-up period including noise free pressure data, noisy pressure data, and filtered pressure data, in accordance with an embodiment.
Figure 50:
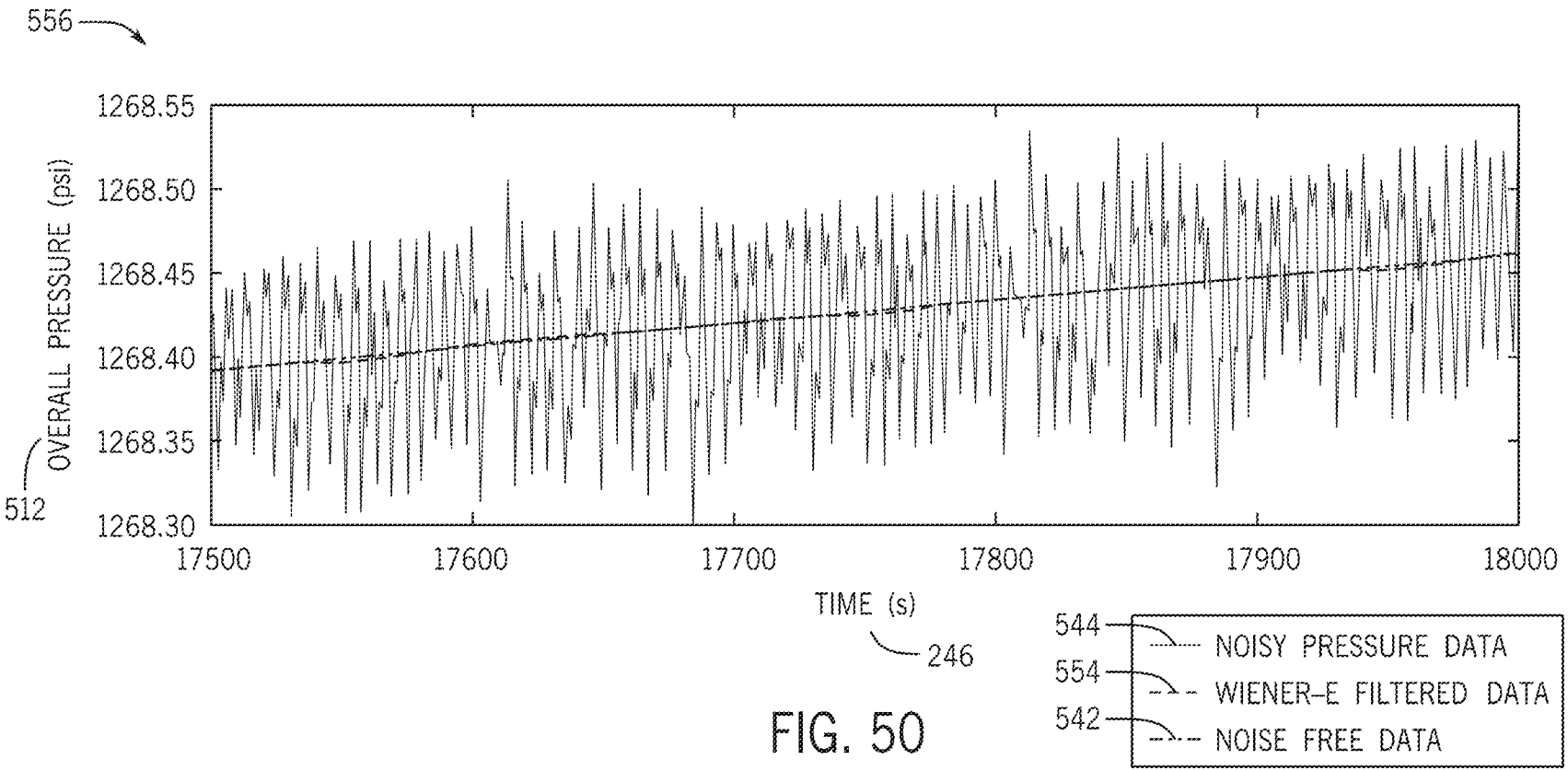
FIG. 50 is a representative plot of measured formation overall pressure as a function of elapsed time over a time period after pressure build-up including noise free pressure data, noisy pressure data, and filtered pressure data, in accordance with an embodiment.

FIG. 49 is a plot 552 of the overall pressure 512 as a function of time 246 in the buildup window 522 of Wiener-E filtered data 554. The noise free data 542 and noisy pressure data 544 are also included in the plot 552 for reference. Similarly, FIG. 50 is a plot 556 illustrating the Wiener-E filtered data 554, the noise free data 542, and noisy pressure data 544, but in the late window 524. As shown, applying the Wiener-E filter removed noise to smooth out the overall pressure 512, while maintaining accuracy. Accordingly, computation of local derivatives may be more accurate compared to that of other filtering methods.

Figure 51:
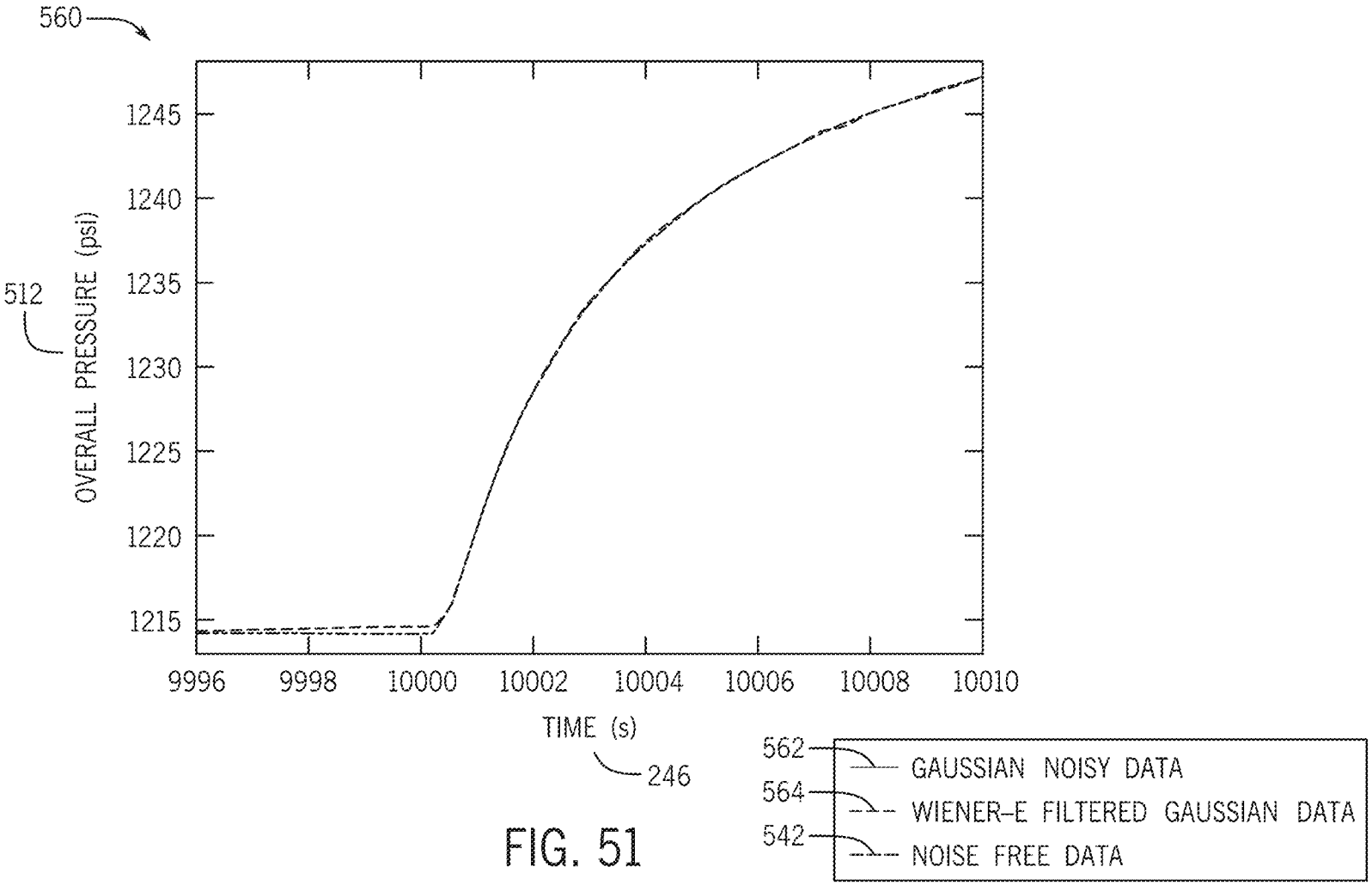
FIG. 51 is a representative plot of measured formation overall pressure as a function of elapsed time over a pressure build-up period including noise free pressure data, noisy pressure data, and filtered pressure data, in accordance with an embodiment.
Figure 52:
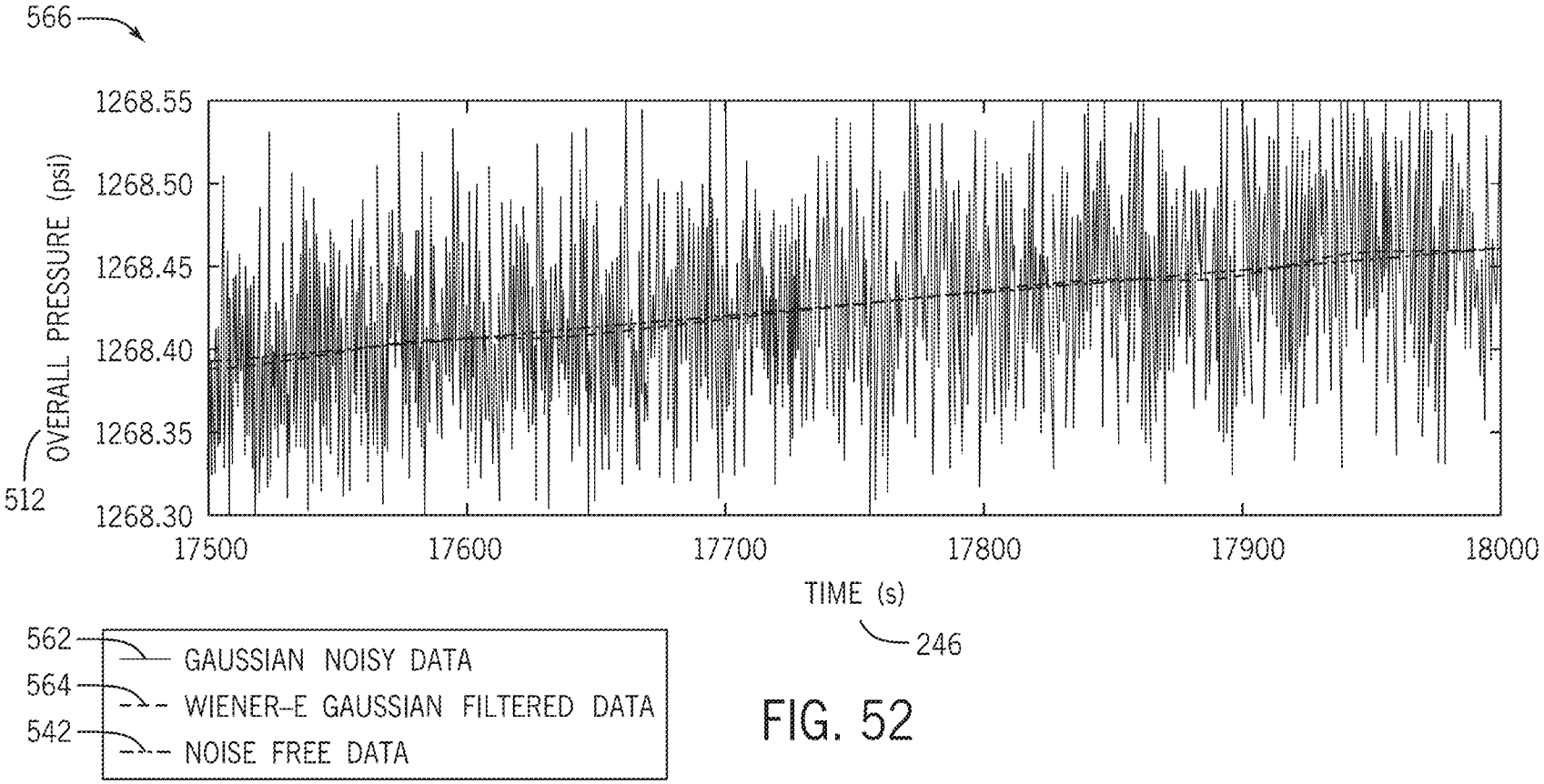
FIG. 52 is a representative plot of measured formation overall pressure as a function of elapsed time over a time period after pressure build-up including noise free pressure data, noisy pressure data, and filtered pressure data, in accordance with an embodiment.

While the noise may be due, in part, to fluctuations in the fluid level of the mud 32 within the wellbore 14, noise may also be introduced from other sources. For example, random noise in pressure response data may be caused by the transducer and/or associated electronics, such as a digital to analog converter (DAC). As such finite bits of induced noise, Boltzmann noise etc. may be added to the oscillation noise. Pressure data 521 contaminated by Gaussian white noise may represent such induced noise. For example, FIG. 51 is a plot 560 of the overall pressure 512 as a function of time 246 in the buildup window 522 of the noise free data 542, Gaussian noisy data 562, and Wiener-E filtered Gaussian data 564. Additionally, FIG. 52 is a plot 566 illustrating the Wiener-E Gaussian filtered data 564, the noise free data 542, and the Gaussian noisy data 562, but in the late window 524. As illustrated, the plots 560, 566 show that random noise (e.g., noise caused by things other than fluid fluctuations) may also be removed by the Wiener-E filter. As such, the Wiener-E filter may be used to filter both random and oscillatory noise.

While the disclosed embodiment is discussed in the context of a Wiener-E filter, present embodiments also include using other types of non-linear filters. By way of non-limiting example, other non-linear filters may include an Infinite-Impulse-Response (IIR), a Finite-Impulse-Response (FIR) filter, wavelet filters, or any combination thereof.

Frequency-domain based filters may be linear and may efficiently remove or keep a certain part of the signal with different frequency characteristics from the other parts. In one embodiment, filtering is equivalent to convolution in a time domain i.e., y(t)=x(t)*h(t). If the data of interest is discrete, the effect of the impulse response h(t) may be analyzed and designed through Z-transform as follows:

$$H(z) = \frac{Y(z)}{X(z)} = \frac{\sum_{i=0}^{P} b_i z_i^{-i}}{1 + \sum_{j=1}^{P} a_j z_j^{-j}}, \quad \text{EQ. 13}$$

where Y(z) and X(z) are Z-transform of the discrete output y(t) and input x(t).

H(z) is set by placing zeros and poles corresponding to the roots of the numerator and denominator polynomials in the complex Z domain. Replacing z with $e^{j\omega}$ where j is $\sqrt{-1}$ and ω is the angular frequency yields: $\overline{Y}(\omega)=\overline{X}(\omega)\,\overline{H}(\omega)$, with $\overline{H}(\omega)=H(e^{j\omega})$ with similar representations for X and Y. That is, the frequency spectrum of the output is the input spectrum times the filter spectrum. Since a filter is designed to remove noise by having nearly zero pass-through of noise related frequency bands, whenever the true signal and the noise overlap in frequency, noise may, at times, not be removed without affecting the noise free data 542.

Figure 53:
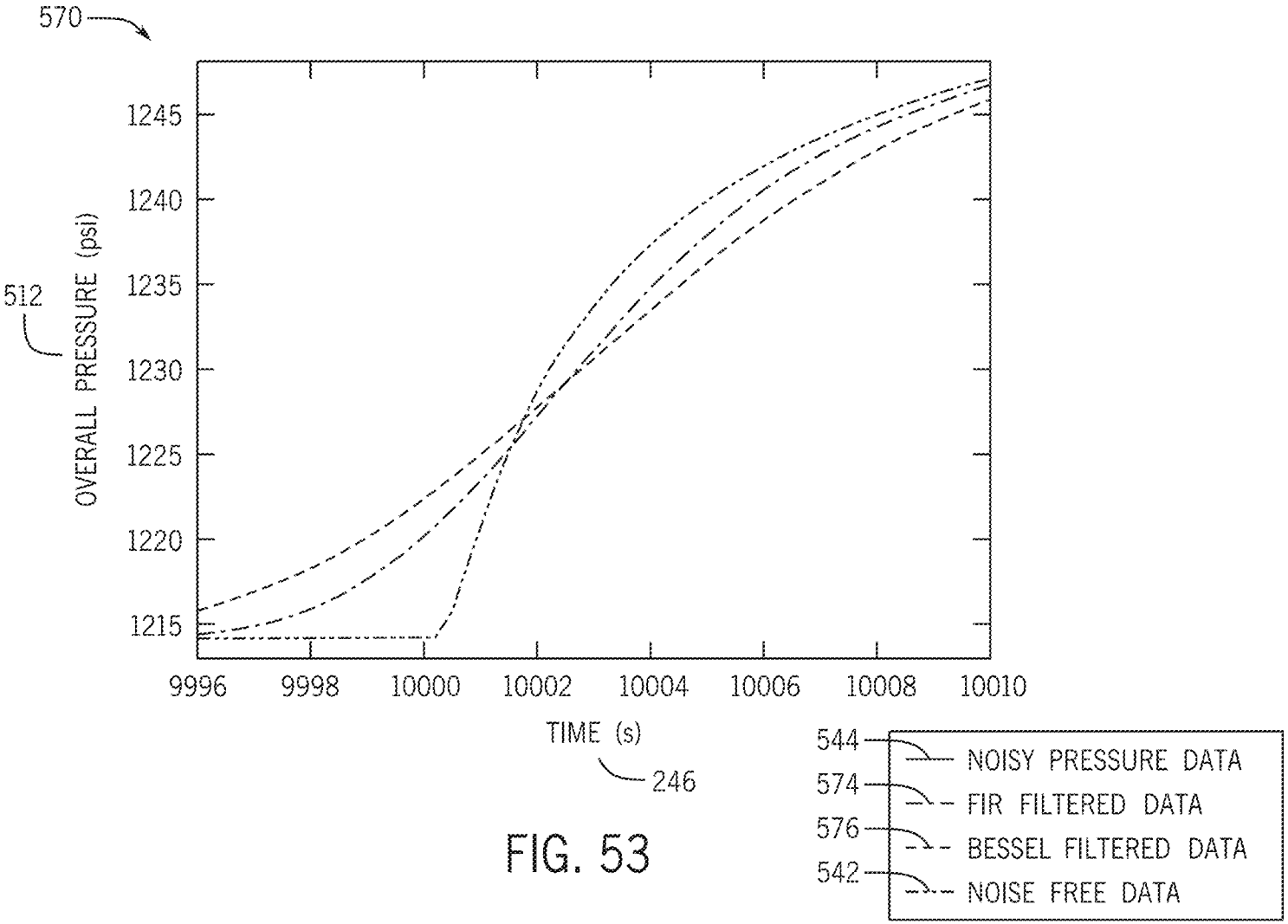
FIG. 53 is a representative plot of measured formation overall pressure as a function of elapsed time over a pressure build-up period including noise free pressure data, noisy pressure data, and filtered pressure data, in accordance with an embodiment.
Figure 54:
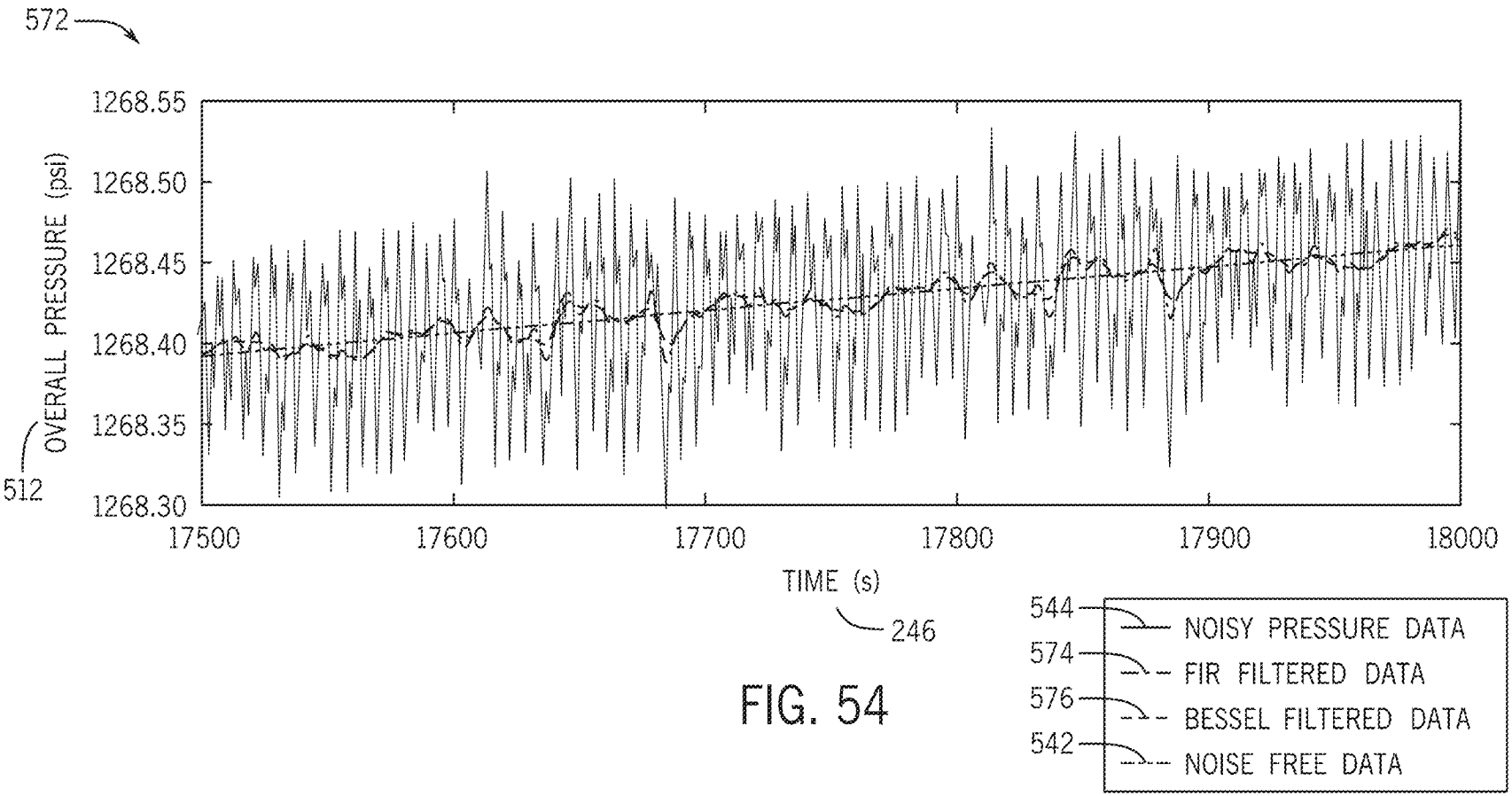
FIG. 54 is a representative plot of measured formation overall pressure as a function of elapsed time over a time period after pressure build-up including noise free pressure data, noisy pressure data, and filtered pressure data, in accordance with an embodiment.

Several types of filters, such as Bessel, Chebyshev, and Butterworth filters from the BR filter family and FIR filters, may be applied to the noisy pressure data 544. For example, FIGS. 53 and 54 are plots 570 and 572, respectively, illustrating FIR filtered data 574 and Bessel filtered data 576. Plots 570, 572 also include the noise free data 542 and noisy pressure data 544 for reference. In the illustrated embodiment, the cut-off frequency is 0.1 Hz (10 s) for both a $40^{th}$ order FIR filter and a $9^{th}$ order Bessel filter. However, other cut-off frequencies and order filters may also be used depending on the input data and/or implementation. While a certain amount of noise remains visible in the late window 524, as shown in the plot 572 of FIG. 54, the FIR filtered data 574 and Bessel filtered data 576 in the buildup window 522 is biased away from the noise free data 542. The amount of noise reduction using the Bessel and FIR filters is significantly less (e.g., 19.8% and 19.1% respectively) than that using the Wiener-E filter, as compiled in Table 1. In some scenarios, more aggressive filtering of the noise may further bias the filtered data. Based on the experimental results shown herein, frequency-domain based linear filters may not be suitable for processing noisy pressure data 544 when attempting to account for both the buildup window 522 and the late window 524.

Similar to the Fourier decomposition with sinusoidal basis, wavelet transform uses "wavelets" to decompose the signal. Wavelets allow the wavelet transform to separate the noise from the noise free data 542, independent of the frequency contents. With wavelet decomposition, the signal is represented by the following relationship:

$$x(t)=\Sigma_k c(k)\varphi_k(t)+\Sigma_k\Sigma_j d(j,k)\Psi_{j,k}(t) \quad \text{EQ. 14}$$

Where $\varphi_k(t)=\varphi(t-k)$ and $\Psi_{j,k}(t)=2^{j/2}\Psi_j(2t-k)$. φ(t) is the father wavelet, acting as an overall scaling for the whole signal, (t) is the mother wavelet, which can be shifted (parameter k) and stretched (parameter j) differently to decompose the signal, c(k) and d(j, k) are coefficients corresponding to father wavelet and mother wavelet, respectively. Wavelet-based signal processing applies a thresholding method for denoising. The choice of wavelet depends upon the characteristic desired to be filtered or approximated. For example, in some embodiments, a Haar wavelet and/or a Daubechies wavelet (e.g., an 8 tap (db8) wavelet) may be employed.

Figure 55B:
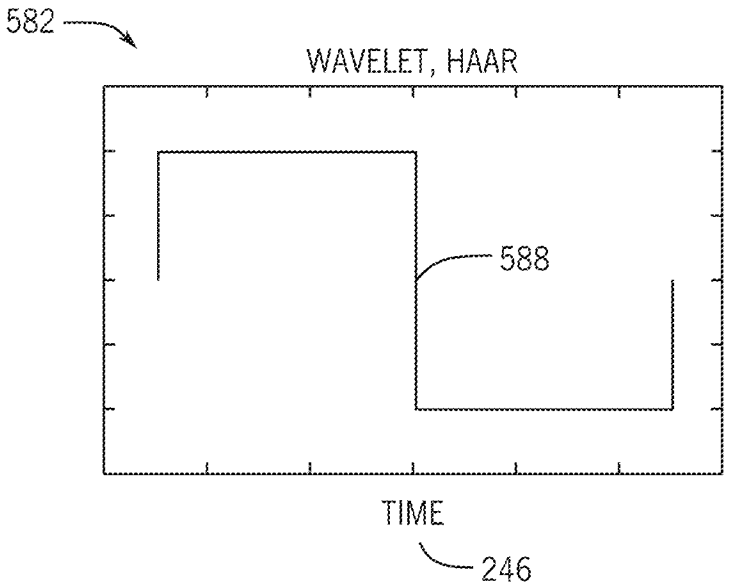
FIG. 55B is a representative plot of a Haar wavelet, in accordance with an embodiment.
Figure 55A:
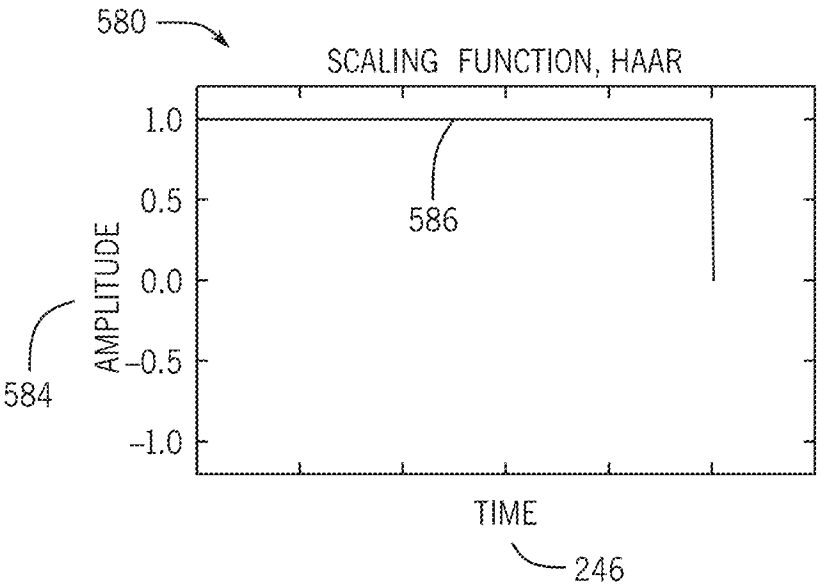
FIG. 55A is a representative plot of a Haar scaling function, in accordance with an embodiment.
Figure 56B:
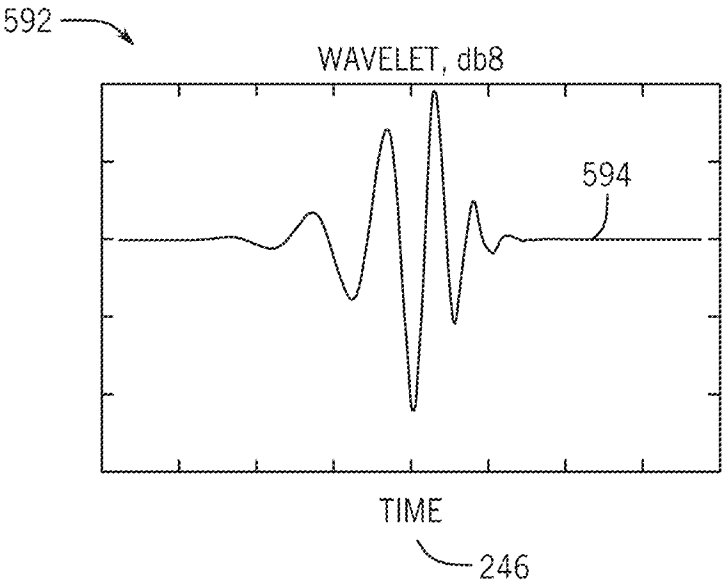
FIG. 56B is a representative plot of a db8 wavelet, in accordance with an embodiment.
Figure 56A:
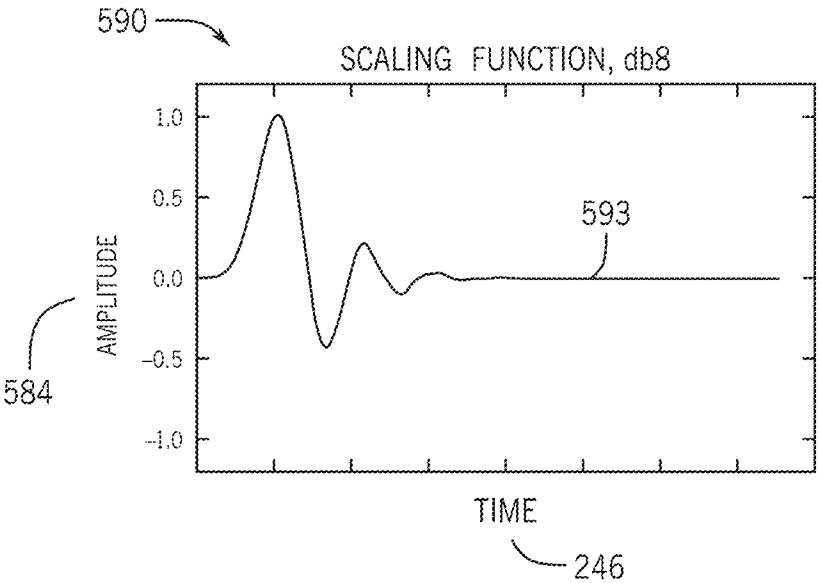
FIG. 56A is a representative plot of a db8 scaling function, in accordance with an embodiment.
Figure 57:
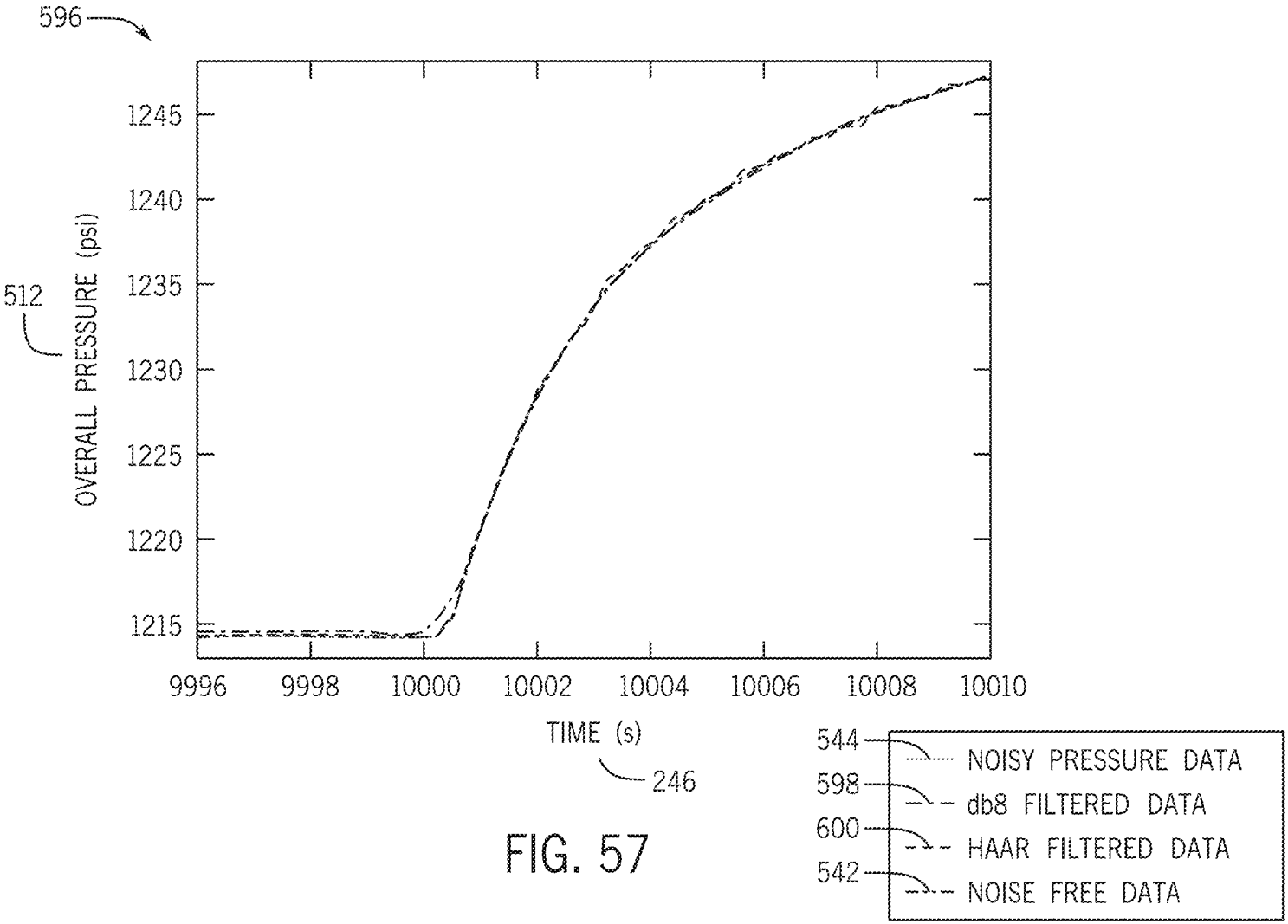
FIG. 57 is a representative plot of measured formation overall pressure as a function of elapsed time over a pressure build-up period including noise free pressure data, noisy pressure data, and filtered pressure data, in accordance with an embodiment.
Figure 58:
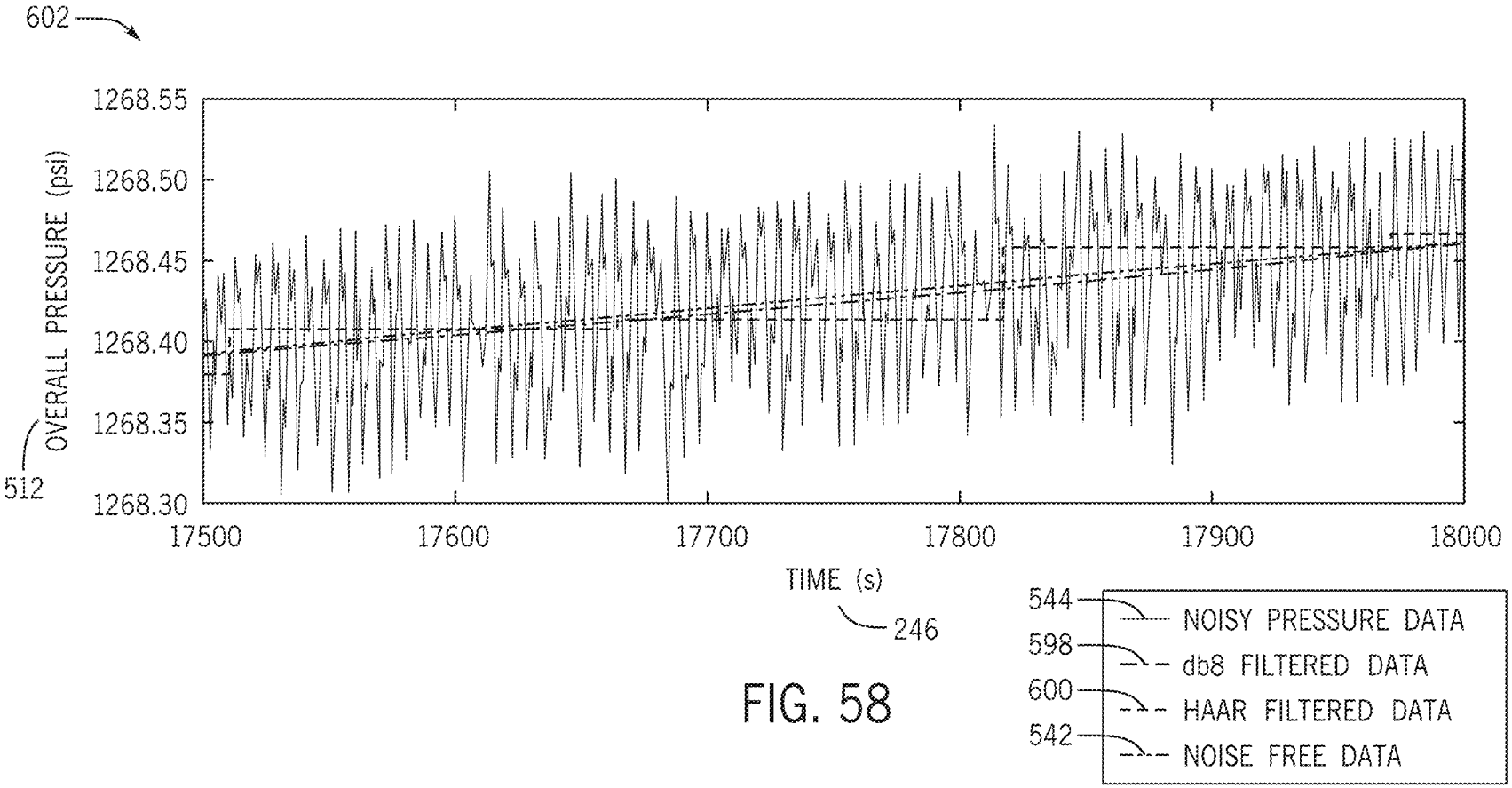
FIG. 58 is a representative plot of measured formation overall pressure as a function of elapsed time over a time period after pressure build-up including noise free pressure data, noisy pressure data, and filtered pressure data, in accordance with an embodiment.

FIGS. 55A and 55B illustrate plots 580 of the amplitude 584, in arbitrary units, as a function of time 246 for the Haar scaling function 586 and the Haar wavelet 588, respectively. FIGS. 56A and 56B illustrate plots 590, 592 of the amplitude 584, in arbitrary units, as a function of time 246 for a db8 scaling function 593 and a db8 wavelet 594, respectively. FIG. 57 is a plot 596 of the overall pressure 512 as a function of time 246 in the buildup window 522 including the db8 filtered data 598 and the Haar filtered data 600. Similarly, FIG. 58 is a plot 602 illustrating the db8 filtered data 598 and the Haar filtered data 600, but over the late window 524. Due to the step-wise nature of the Haar wavelet 588, the Haar filtered data 600 introduces undesirable periodic steps. Furthermore, periodic steps may also affect pressure derivative diagnosis. Visual examination of the db8 wavelet filter produces desirable results with respect to preserving the noise free data 542 while suppressing noise. However, using the quantitative metric analysis discussed above, the overall noise reduction by db8 wavelet filtering may be less than that of the Wiener-E filter.

For noisy pressure data 544 generated synthetically, the Wiener-E filter provides a desirably smooth and accurate modified (e.g., filtered) output. Empirical field data may contain more complicated noise patterns and pressure responses than that which is generated synthetically. However, the Wiener-E filter retains its high accuracy (e.g., greater than approximately 90% or 95%) and smoothness when used on more complicated field pressure data. Additionally, the Wiener-E filter is also suitable for computing more reliable pressure derivatives. As should be appreciated, the non-linear filters (e.g., the Wiener-E filter) and techniques described herein may also be utilized for the wellbore pressure data 248, 514.

Figure 59:
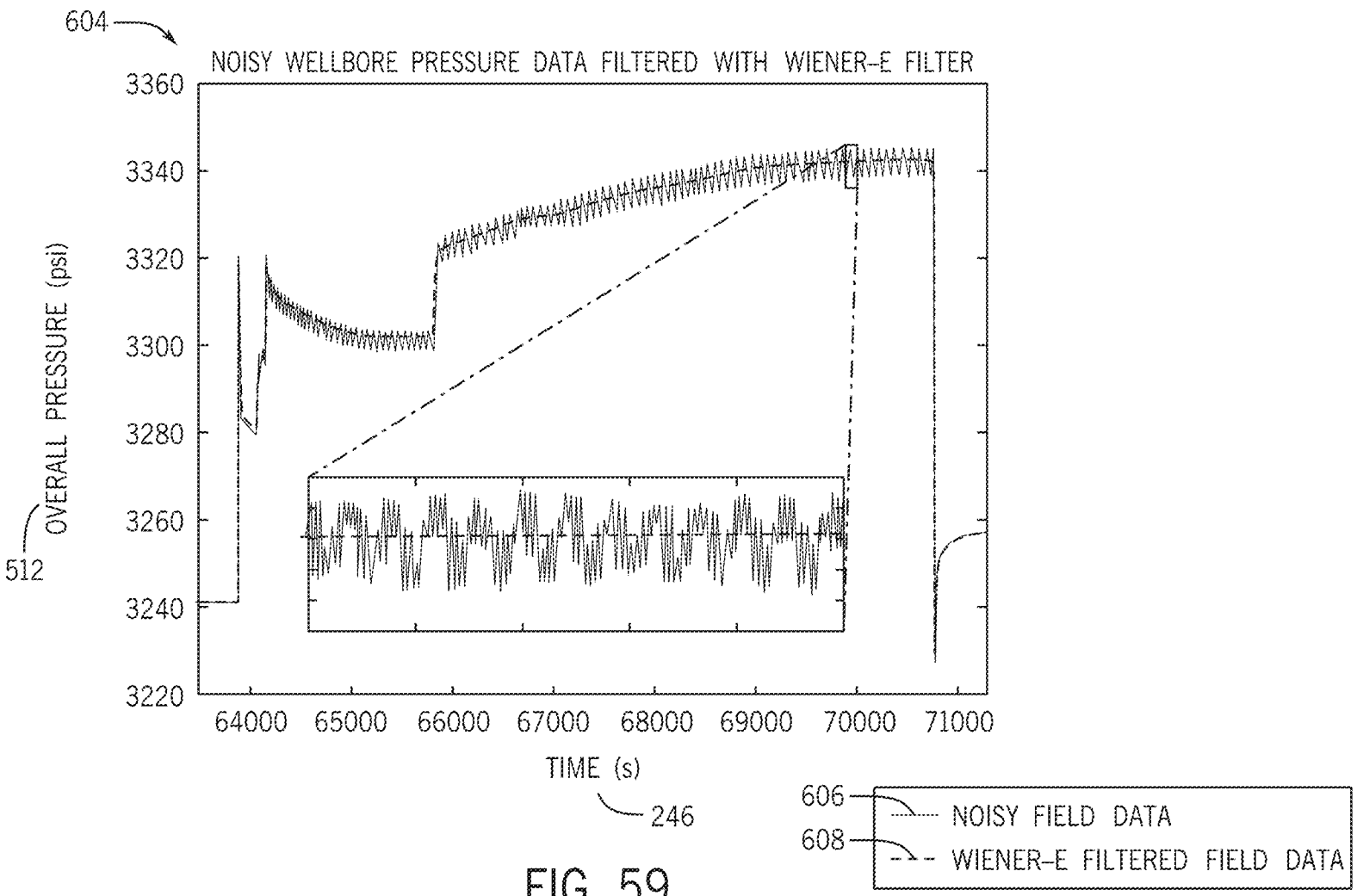
FIG. 59 is a representative plot of field measured wellbore overall pressure as a function of elapsed time including the time period from a pressure build-up of noisy pressure data, and filtered pressure data, in accordance with an embodiment.

The improved accuracy of data filtered using a Wiener-E filter is also illustrated in FIG. 59. For example, FIG. 59 is a plot 604 of the overall pressure 512 as measured within a wellbore as a function of time 246. Plot 604 depicts multiple pressure jumps corresponding to mud circulation induced by operation of the trip-tank 204. The plot 604 illustrates noisy field data 606 and Wiener-E filtered field data 608. Multiple frequency contents in the noise and near discontinuities in overall pressure 512, resulting from on/off cycling of the trip tank 204 or other causes of sudden pressure changes, make the noise removal process more challenging than processing typical formation pressure response data. However, as shown in the plot 604, the Wiener-E filter suppresses the oscillation noise effectively, and preserves the large-amplitude jumps.

Furthermore, the Wiener-E filter may also be applied to noisy formation pressure data collected during a modular formation dynamics tester (MDT) operation. Such pressure response data may have a drawdown period followed by a buildup period. Noise on the MDT pressure data includes random, periodic, and spikes. However, the use of a Wiener-E filter consistently improves the accuracy of the pressure response data from which to infer formation/wellbore properties. Furthermore, not only is the filtered pressure response data suitable for calculating formation/wellbore properties, but the quality is sufficient to carry out a derivative analysis.

In certain embodiments, the pressure oscillations created by variations in the fluid level of the mud 32 may be analyze quantitatively rather than filtered to estimate the formation pressure within a suitable confidence level. For example, the formation pressure may be estimated using a diffusion model for pressure. In deriving the disclosed diffusion model, the compressibility of the formation and the mudcake may be omitted. The diffusion model may be derived for both radial-spherical and radial-cylindrical flow regimes. In the case for a radial-cylindrical flow regime for a compressible fluid of compressibility c an equation for a rigid porous medium may be expressed as follows:

$$\frac{D_f}{r}\frac{\partial}{\partial r}\left[r\frac{\partial p_f}{\partial r}\right]=\frac{\partial p_f}{\partial t},\ r\geq r_w, \quad \text{EQ. 15}$$

where r is the radial distance from a wellbore axis, $r_w$ is the wellbore radius, $p_f$ is formation fluid pressure, t is time, and $D_f$ is pressure diffusivity defined by $$\frac{k_f}{\phi_f \mu c},$$

where $k_f$ is the formation permeability, μ is a shear coefficient of viscosity, and $\phi_f$ is formation porosity.

Similarly, pressure within the mud cake may be expressed as follows:

$$\frac{D_m}{r}\frac{\partial}{\partial r}\left[r\frac{\partial p_m}{\partial r}\right]=\frac{\partial p_m}{\partial t},\ r_m\leq r\leq r_w \quad \text{EQ. 16}$$

where $p_m$ is the fluid pressure within the mud cake and $D_m$ is diffusivity of the fluid pressure within the mud filter cake. A thickness of the mud filter cake is denoted as $r_w-r_m$. As shown in EQ. 15 and 16, gravity is not considered because, in single phase flow, gravity is not relevant as long as all of the pressures are referred to the same datum.

EQ. 15 and 16, along with fluid level boundaries and initial conditions, may be used to determine the formation pressure. The initial conditions may not be considered if the frequency response of the formation pressure is of interest. In this embodiment, a Laplace transform may be used to determine the formation pressure. For example, at an interface between the mud filter cake and the formation, the pressure and normal flux are equal. Accordingly, when $r=r_w$, the fluid pressure within the mud filter cake, $p_m$, and the formation fluid pressure, $p_f$, accord to the following relationships:

$$p_m\,|\,r_w=p_f\,|_{r_w} \quad \text{EQ. 17}$$

-continued $$\lambda_m\frac{\partial p_m}{\partial r}\Big|_{r_w}=\lambda_f\frac{\partial p_f}{\partial r}\Big|_{r_w} \quad \text{EQ. 18}$$

where $\lambda_f$ and $\lambda_m$, are the fluid mobility in the formation and the mud filter cake, respectively. By definition, $$\lambda_f=\frac{k_f}{\mu}\text{ and }\lambda_m=\frac{k_m}{\mu}.$$

The pressure at $r_m$ of the mud filter cake is the fluctuating wellbore pressure $p_b(t)$, and the formation pressure that is infinitely away from the wellbore pressure is assumed to be zero, since the pressures are referred to the far-field pressures. Therefore, the formation and mud filter cake pressures accord to the following relationship:

$$p_m(r_m,t)=p_b \quad \text{EQ. 19}$$

$$p_f(\infty,t)=0 \quad \text{EQ. 20}$$

Denoting the Laplace transform of variables with a bar, the transform variable as s, the mud filter cake pressure accords to the following relationship:

$$r^2\frac{\partial \bar{p}_m}{\partial r}+r\frac{\partial \bar{p}_m}{\partial r}-\frac{s}{D_m}r^2\bar{p}_m=0 \quad \text{EQ. 21}$$

and the formation pressure accords to the following relationship:

$$r^2\frac{\partial \bar{p}_f}{\partial r}+r\frac{\partial \bar{p}_f}{\partial r}-\frac{s}{D_f}r^2\bar{p}_f=0 \quad \text{EQ. 22}$$

EQs. 21 and 22 may be solved as follows:

$$\bar{p}_m(r,s)=C_1(s)I_0\left(\sqrt{\frac{s}{D_m}}\,r\right)+C_2(s)K_0\left(\sqrt{\frac{s}{D_m}}\,r\right) \quad \text{EQ. 23}$$

$$\bar{p}_f(r,s)=C_3(s)I_0\left(\sqrt{\frac{s}{D_f}}\,r\right)+C_4(s)K_0\left(\sqrt{\frac{s}{D_f}}\,r\right) \quad \text{EQ. 24}$$

where $I_i$ is the modified Bessel function of the first kind of order i and $K_i$ is the modified Bessel function of the second kind of order i, $C_i$ is determined based on EQs. 17 and 18, and the far-field pressure and the boundary condition, as expressed in EQ. 25 specifies the wellbore fluctuating pressure.

$$\bar{p}_m(r_m,s)=\bar{p}_b(s) \quad \text{EQ. 25}$$

Satisfying the four boundary conditions results in the following relationship:

$$C_4(s) = \frac{K_0\left(\sqrt{\frac{s}{D_m}}\, r_w\right)}{K_0\left(\sqrt{\frac{s}{D_m}}\, r_m\right)} \frac{\overline{p}_b(s)}{K_0\left(\sqrt{\frac{s}{D_f}}\, r_w\right) + \frac{\overline{f}(s)}{\overline{g}(s)}\left\{\frac{I_0\left(\sqrt{\frac{s}{D_m}}\, r_m\right)}{K_0\left(\sqrt{\frac{s}{D_m}}\, r_m\right)} K_0\left(\sqrt{\frac{s}{D_m}}\, r_w\right) - I_0\left(\sqrt{\frac{s}{D_m}}\, r_w\right)\right\}} \quad \text{EQ. 26}$$

where, $$\overline{f}(s) = K_0\left(\sqrt{\frac{s}{D_f}}\, r_w\right) K_1\left(\sqrt{\frac{s}{D_m}}\, r_w\right) - \psi K_1\left(\sqrt{\frac{s}{D_f}}\, r_w\right) K_0\left(\sqrt{\frac{s}{D_m}}\, r_w\right) \quad \text{EQ. 27}$$

$$\overline{g}(s) = I_1\left(\sqrt{\frac{s}{D_m}}\, r_w\right) K_0\left(\sqrt{\frac{s}{D_m}}\, r_w\right) + I_0\left(\sqrt{\frac{s}{D_m}}\, r_w\right) K_1\left(\sqrt{\frac{s}{D_m}}\, r_w\right) \quad \text{EQ. 28}$$

and a parameter expressed as follows:

$$\psi = \sqrt{\frac{D_m}{D_f}}\, \frac{\lambda_f}{\lambda_m} = \sqrt{\frac{\phi_f k_f}{\phi_m k_m}} \quad \text{EQ. 29}$$

The Laplace transformed formation pressure at the probe $\overline{p}_f(r_w, s)$ is expressed as follows:

$$\overline{p}_f(r_w, s) = C_4(s) K_0\left(\sqrt{\frac{s}{D_f}}\, r_w\right) \quad \text{EQ. 30}$$

A transfer function $[\overline{T}(s)=\overline{p}_f(r_w, s)/\overline{p}_b(s)]$ may describe the formation pressure at the probe with respect to fluctuations in the wellbore according to the following relationship:

$$\overline{T}(s) = \frac{K_0\left(\sqrt{\frac{s}{D_m}}\, r_w\right)}{K_0\left(\sqrt{\frac{s}{D_m}}\, r_m\right)} \frac{K_0\left(\sqrt{\frac{s}{D_f}}\, r_w\right)}{K_0\left(\sqrt{\frac{s}{D_f}}\, r_w\right) + \frac{\overline{f}(s)}{\overline{g}(s)}\left\{\frac{I_0\left(\sqrt{\frac{s}{D_m}}\, r_m\right)}{K_0\left(\sqrt{\frac{s}{D_m}}\, r_m\right)} K_0\left(\sqrt{\frac{s}{D_m}}\, r_w\right) - I_0\left(\sqrt{\frac{s}{D_m}}\, r_w\right)\right\}} \quad \text{EQ. 31}$$

EQ. 31 may be used to determine the frequency response of the formation pressure at the probe with respect to the wellbore when s is replaced by jω, where ω is the angular velocity corresponding to a frequency f and $j=\sqrt{-1}$. In this embodiment, a probe is used for measuring formation pressure passively. However, the formation pressure may also be measured with a packer interval, or any other geometry that allows communication to the formation fluid.

Figure 60:
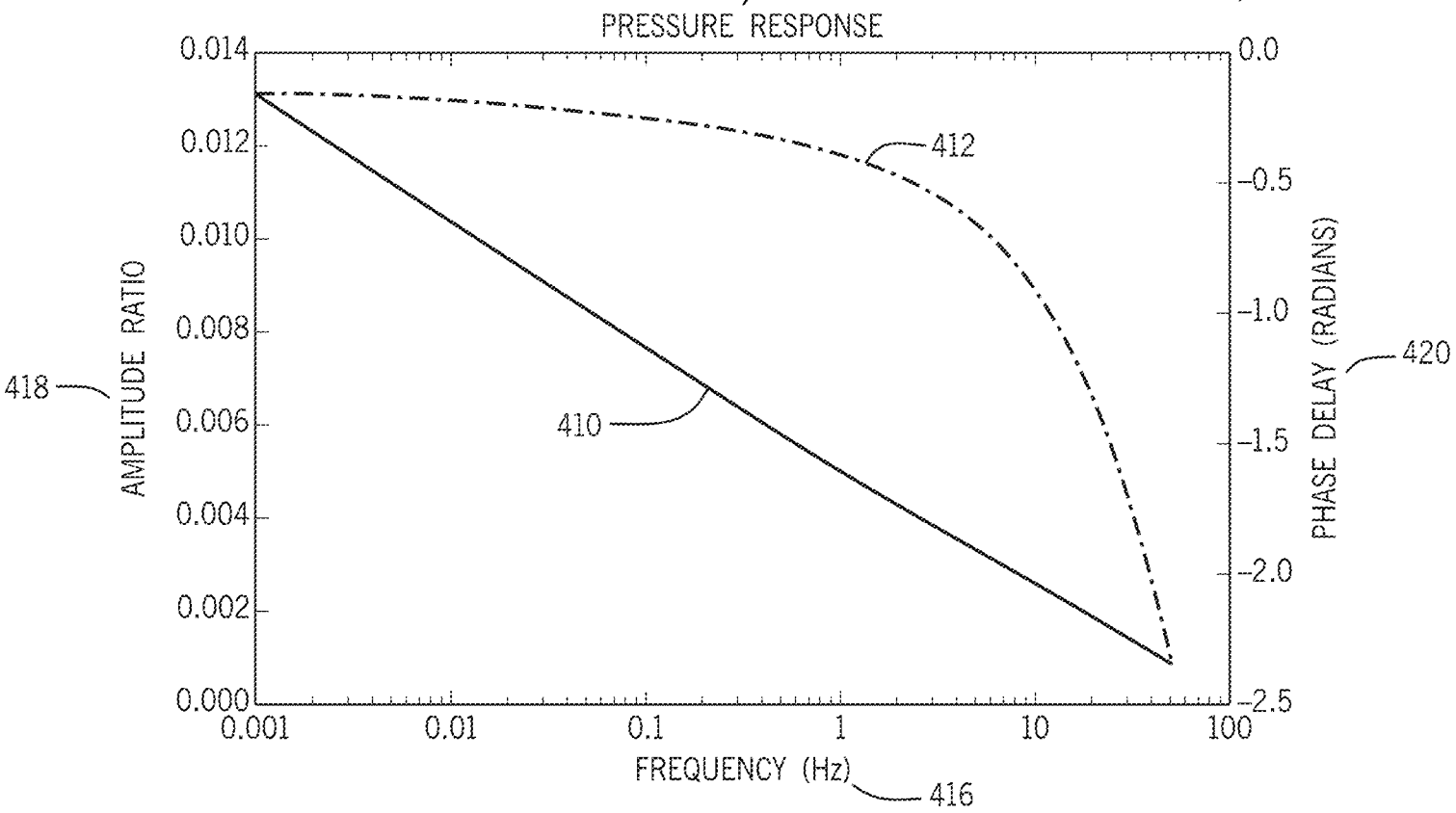
FIG. 60 is a representative plot of amplitude ratio and phase delay as a function of frequency, representing the pressure response of formation pressure, whereby the formation and wellbore pressure are measured using the same sensor type, in accordance with an embodiment.

EQ. 31 may be used to determine the frequency responses of the formation pressure under ideal conditions. FIG. 60 illustrates a plot 400 for the frequency response of the formation pressure generated using EQ. 31. In the illustrated embodiment, the parameters were as follows: $k_m$=2.5 μD, $k_f$=100 mD, $\phi_m$=0.5, $\phi_f$=0.25, μ=5×10$^{-4}$ Pa s, c=4×10$^{-10}$ Pa$^{-1}$, $r_w$=100 mm, and $r_m$=99 mm. As shown in the plot 400, amplitude ratio data 410 and phase delay data 412 of the pressure response 414 are monotonic with respect to frequency 416 for a wide range of frequencies (e.g., between approximately 0.001 and approximately 10 Hz). Within the possible frequency range of the wellbore fluctuation noise (0.01 and 10 Hz), the amplitude ratio 418 approximately linearly decreases from approximately 0.01 to 0.003. Conversely, phase delay 420 increases from approximately 0.2 to 0.9 radians.

Figure 61:
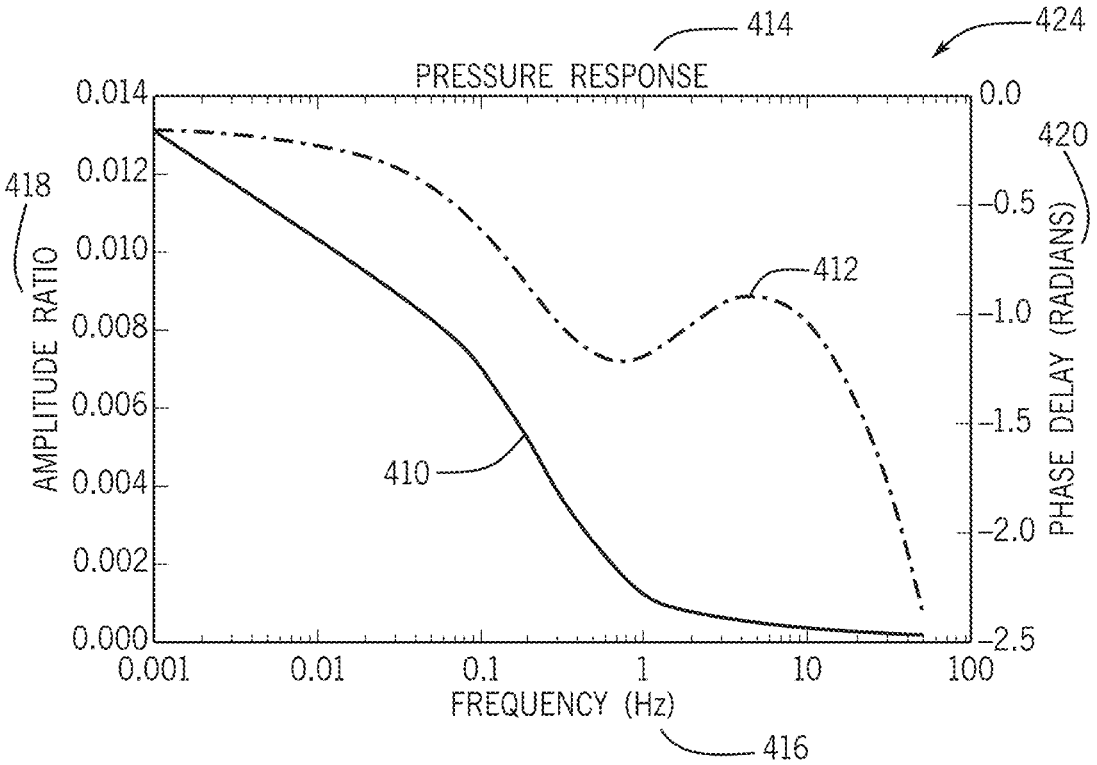
FIG. 61 is a representative plot of amplitude ratio and phase delay as a function of frequency, representing the pressure response of formation pressure, whereby the formation and wellbore pressure are measured using different sensor types, in accordance with an embodiment.
Figure 62:
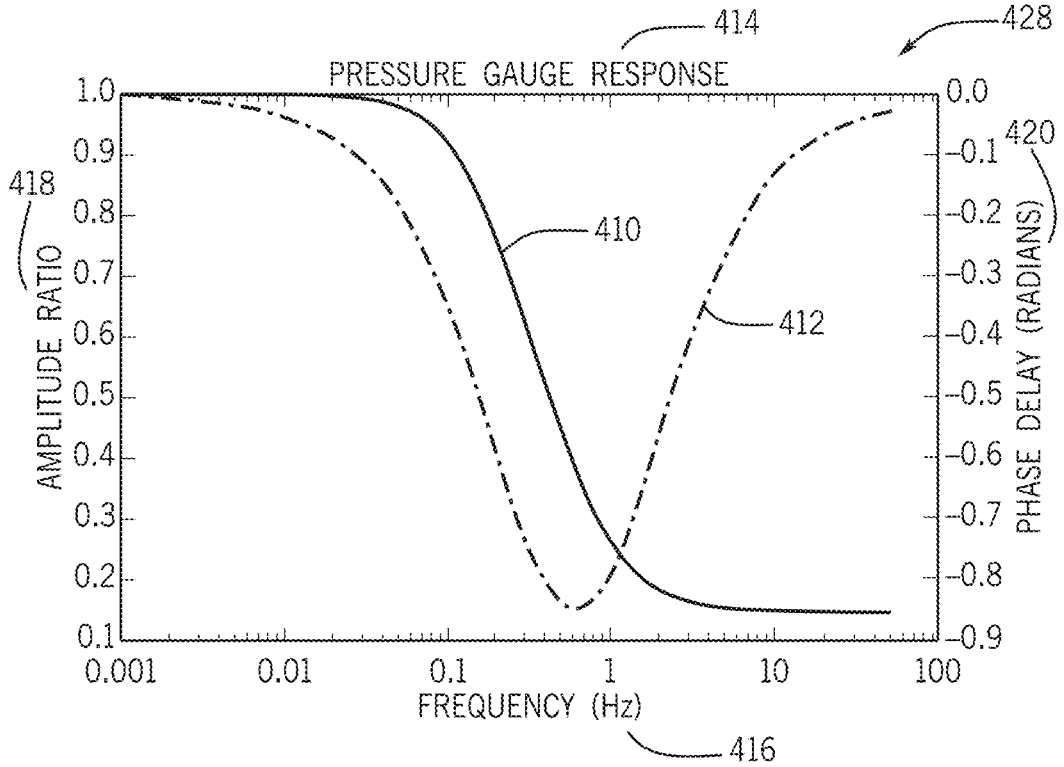
FIG. 62 is a representative plot of amplitude ratio and phase delay with respect to frequency, representing pressure sensor response, assuming formation pressure and wellbore pressure are measured using different sensor types, in accordance with an embodiment.

In field applications, wellbore and formation pressures are measured with sensors having different frequency responses. The various frequency responses may need to be accounted for in the transfer function expressed in EQ. 27. The frequency response variations may be modeled as a first order delay for each transducer. The transfer function expressed in EQ. 31 (after Laplace transform) for each of the sensors is expressed as follows:

$$\overline{H}(s) = \frac{1}{\tau s + 1} \quad \text{EQ. 32}$$

where τ is characteristic response time and the subscripts s and q in τ if used are for strain and quartz gauges, respectively. In certain embodiments, the formation pressure is measured using a quartz gauge and the wellbore pressure is measured using the strain gauge. FIG. 61 illustrates a plot 424 of the pressure response when formation pressure is measured by a quartz gauge and the wellbore pressure is measured by a strain gauge, assuming that $\tau_s$=0.1 seconds and $\tau_q$=0.7 seconds. FIG. 62 illustrates a plot 428 of the frequency response for $\overline{H}_f(s)/\overline{H}_b(s)$, where the subscript b refers to the wellbore, i.e., $r<r_m$ and f refers to wellbore face or formation. It may be assumed that $\overline{H}_f$ is obtained by a quartz gauge and $\overline{H}_b$ is obtained by a strain gauge. The transfer function may be corrected for frequency response as expressed below in EQ. 33. As seen in FIGS. 61 and 62, including differing sensor characteristics may result in a non-monotonic phase-lag response.

$$\overline{T}_c(s) = \overline{T}(s)\frac{\overline{H}_f(s)}{\overline{H}_b(s)} \quad \text{EQ. 33}$$

In embodiments where the formation and the wellbore pressure are measured using the same type of sensor $\overline{T}_c(s)=\overline{T}(s)$. As discussed above, given the formation and fluid characteristics, EQ. 32 and 33 may be used to measure formation frequency response with respect to the wellbore pressure. The fluctuations in the wellbore and formation pressures observed during formation testing may include useful information about the mud filter cake and the formation. The data obtained from EQ. 32 and 33 may be used to determine useful parameters.

As shown in EQ. 31, there are eight parameters used to determine the transformation $\overline{T}(s)$. Estimating the eight parameters may be hindered due, in part, to insufficient information available at different frequencies. However, EQs. 37, 38, and 41 may be used to derive dimensional and dimensionless parameters, $T_M$, $\beta_1$, $\beta_2$, and $\beta_3$, by following the Buckingham-π theorem. The dimensional parameter $T_M$ has units of time accords to the following relationship:

$$T_M=(r_w-r_m)^2/D_m \quad \text{EQ. 34}$$

The dimensionless parameters $\beta_1$, $\beta_2$, and $\beta_3$ accord to the following relationships:

$$\beta_1 = \lambda_f/\lambda_m \quad \text{EQ. 35}$$

$$\beta_2 = 1 - \frac{r_m}{r_w} \quad \text{EQ. 36}$$

$$\beta_3 = \frac{\phi_f}{\phi_m} \quad \text{EQ. 37}$$

The parameters $T_M$, $\beta_1$, $\beta_2$, and $\beta_3$ may be used to derive the following relationships:

$$\frac{r_w^2}{D_f} = \frac{(r_w-r_m)^2}{D_m}\frac{D_m}{D_f}\frac{1}{\left(1-\frac{r_m}{r_w}\right)^2} = \frac{\beta_3 T_M}{\beta_1\beta_2^2} \quad \text{EQ. 38}$$

$$\frac{r_w^2}{D_m} = \frac{(r_w-r_m)^2}{D_m}\frac{D_m}{D_f}\frac{1}{\left(1-\frac{r_m}{r_w}\right)^2} = \frac{T_M}{\beta_2^2} \quad \text{EQ. 39}$$

$$\psi = \sqrt{\beta_1\beta_3} \quad \text{EQ. 40}$$

$$\frac{r_m^2}{D_m} = \frac{T_M(1-\beta_2)^2}{\beta_2^2} \quad \text{EQ. 41}$$

Accordingly, the parameters $T_M$, $\beta_1$, $\beta_2$, and $\beta_3$ may provide sufficient information to estimate the parameters in EQ. 31 and characterize the frequency response. Suitable estimates for parametric ranges may be determined by setting $r_w$=0.1 m, $r_w-r_m$=1-5 mm, $\phi_f$=0.05-0.3, $\phi_m$=0.3-0.5, μ=0.5 mPa s, and c=4×10$^{-10}$ Pa$^{-1}$, $r_w$=100 mm, and $r_m$=99 mm. mud filter cake permeability ranges is 1-10 nm$^2$, and formation permeability range is 0.001-1 μm$^2$. Therefore, ranges for the parameters $T_M$, $\beta_1$, $\beta_2$, and $\beta_3$ may be estimated as follows $T_M$=0.006-2.5 second, $\beta_1$=1×10$^2$-1×10$^6$, $\beta_2$=0.01-0.05, and $\beta_3$=0.1-1. $\beta_2$ and $\beta_3$ have a narrower range compared with $T_M$ and $\beta_1$.

Figure 63:
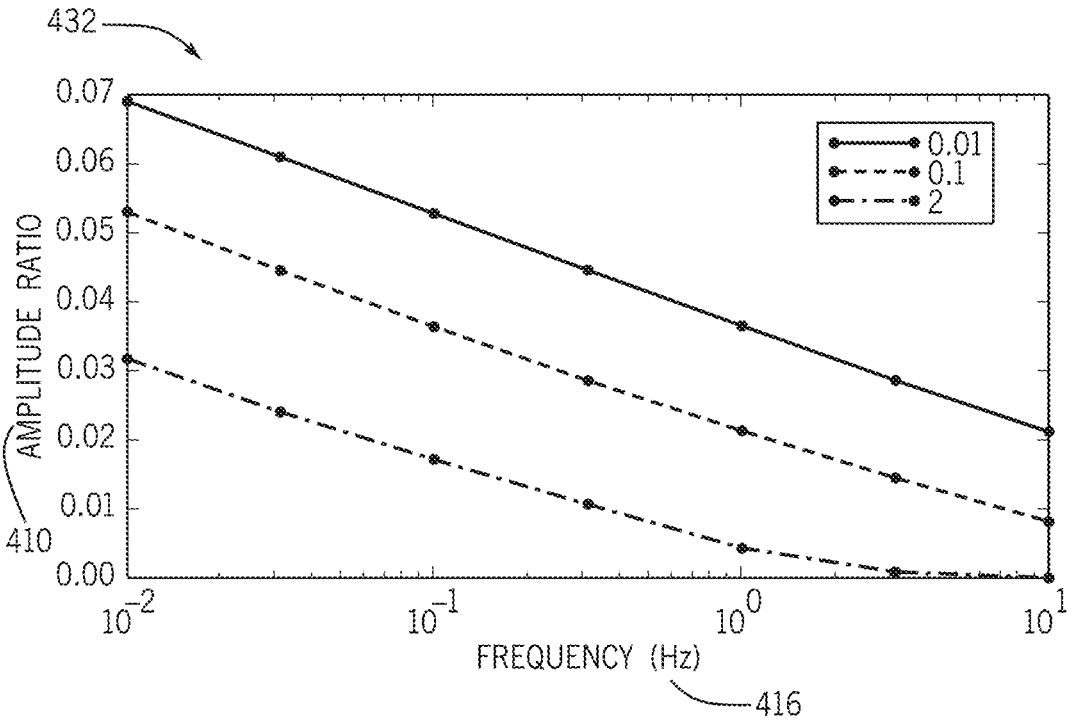
FIG. 63 is a representative plot of amplitude ratio as a function of frequency, representing the pressure response for different values of the parameter $T_M$, in accordance with an embodiment.
Figure 64:
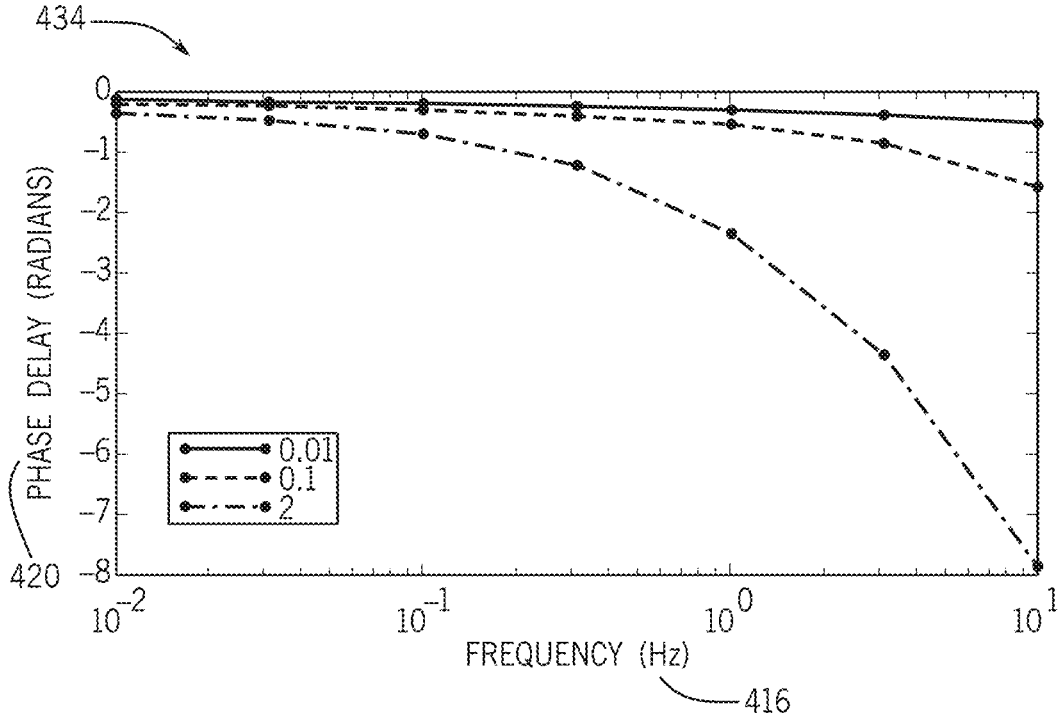
FIG. 64 is a representative plot of phase delay as a function of frequency, representing the pressure response for different values of the parameter $T_M$, in accordance with an embodiment.

FIGS. 63-70 are plot illustrating the sensitivity of the pressure response to each parameter $T_M$, $\beta_1$, $\beta_2$, and $\beta_3$ by perturbing each parameter individually within a specified range. For example, FIGS. 63 and 64 illustrate plots 432 and 434, respectively, showing the influence of the parameter $T_M$ on the frequency response. As shown in the plot 432, perturbing the parameter $T_M$ with different values (e.g., 0.01, 0.1, and 2 s) affects the amplitude ratio 410 as a function of frequency 416. Different $T_M$ values also affect the phase delay of frequency response as a function of frequency 416, as shown in the plot 434 of FIG. 64. The parameters $\beta_1$, $\beta_2$, and $\beta_3$ were kept constant at their nominal values of 2000, 0.03, and 0.5, respectively in this study.

Figure 65:
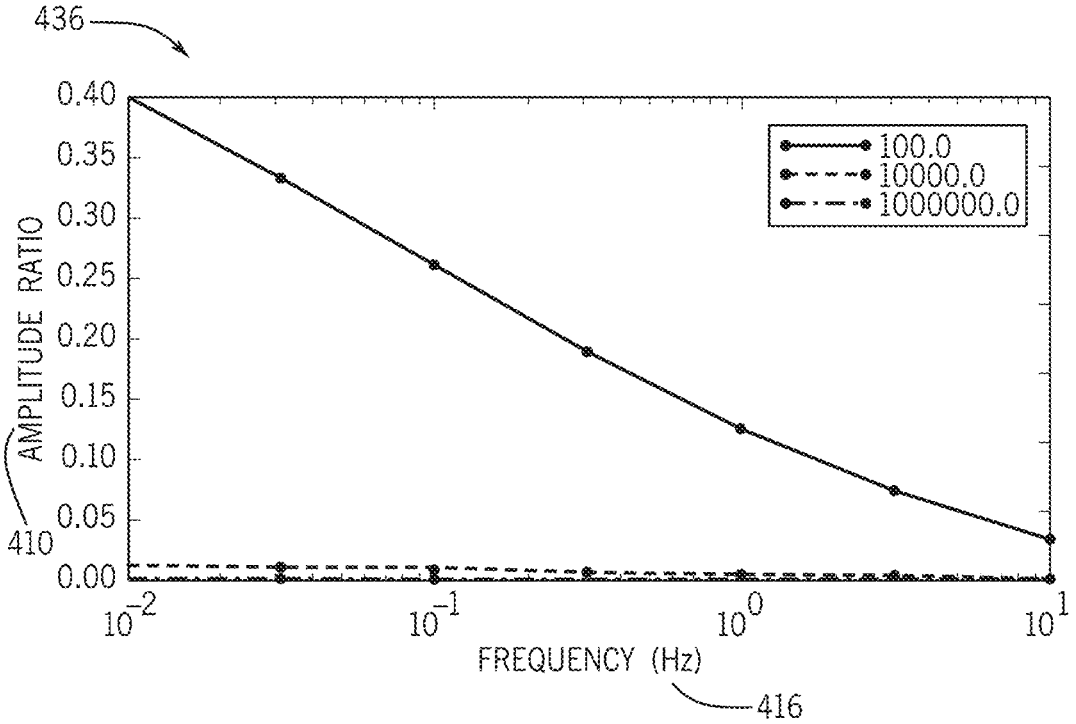
FIG. 65 is a representative frequency response plot of amplitude ratio for different values of the parameter $\beta_1$, in accordance with an embodiment.
Figure 66:
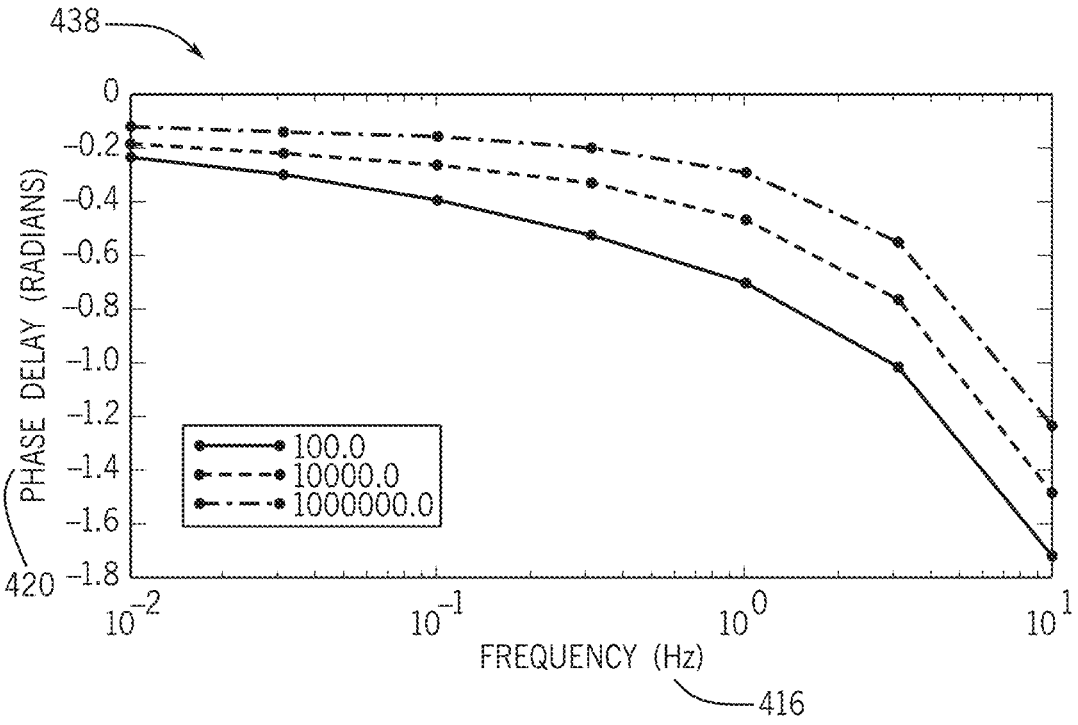
FIG. 66 is a representative plot of phase delay as a function of frequency, for different values of the parameter $\beta_1$, in accordance with an embodiment.

FIGS. 65 and 66 show plots 436 and 438, respectively, of the influence of the parameter $\beta_1$ on the frequency response. As shown in the plot 436, the amplitude ratio 410 of frequency response with $\beta_1$ equals 10000 and 1000000 are consistently small over the wide frequency range. However, when $\beta_1$ equals 100, there is a clear decrease in the amplitude ratio data 410 as a function of frequency 416. In contrast, varying $\beta_1$ with different values (e.g. 100, 10000, 1000000) leads to similar increase in the phase delay 420 as a function of frequency 416. In this particular example, the parameters $T_M$, $\beta_2$, and $\beta_3$ were kept constant at their nominal values of 0.1 seconds, 0.03, and 0.5, respectively.

Figure 67:
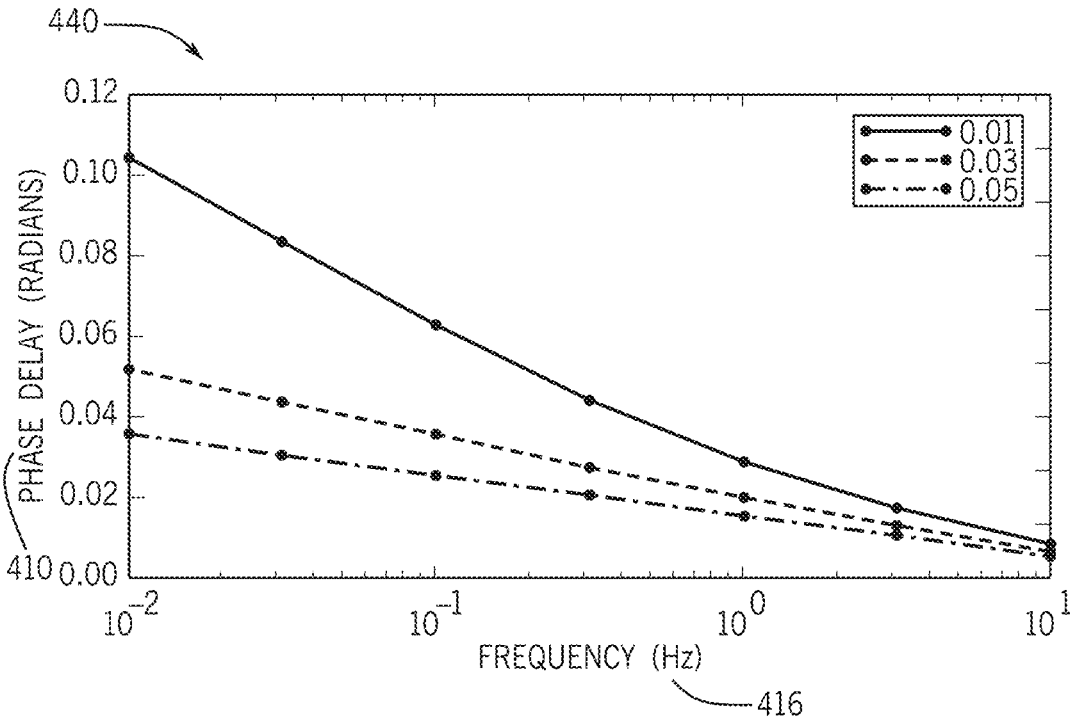
FIG. 67 is a representative plot of amplitude ratio as a function of frequency, representing the pressure response for different values of the parameter $\beta_2$, in accordance with an embodiment.
Figure 68:
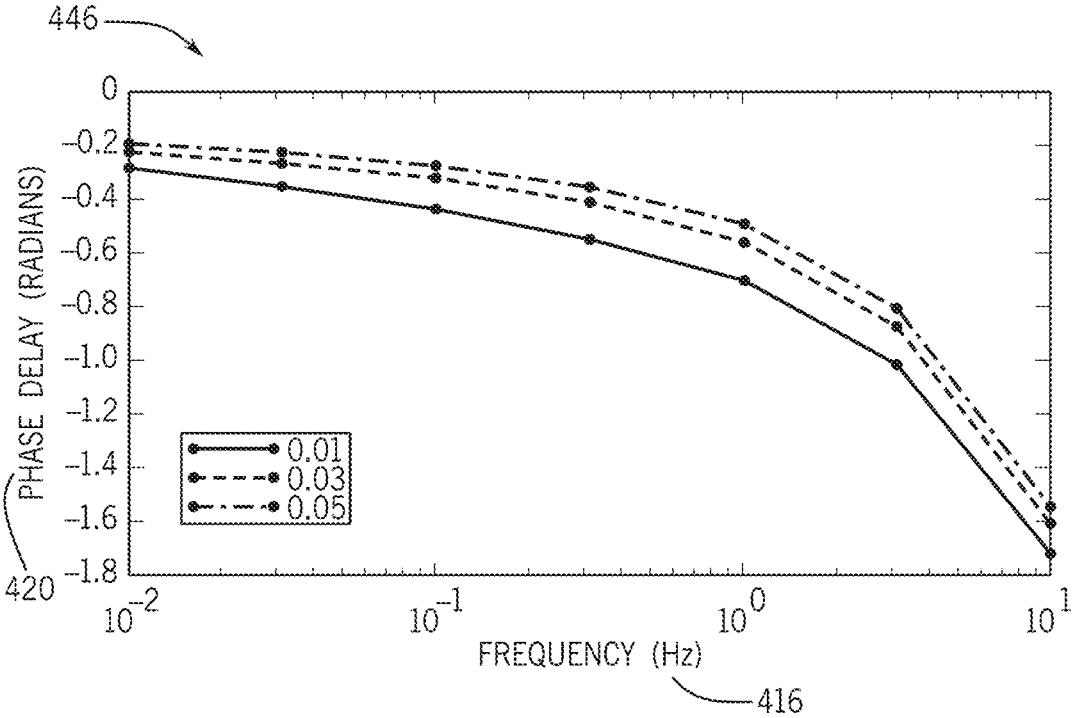
FIG. 68 is a representative plot of phase delay as a function of frequency, representing the pressure response for different values of the parameter $\beta_2$, in accordance with an embodiment.

Similarly, FIGS. 67 and 68 show plots 440 and 446, respectively, of the influence of the parameter $\beta_2$ on the frequency response. The plot 440 of FIG. 67 shows the amplitude ratio 410 of frequency response as a function of frequency 416 with $\beta_2$ having different values (e.g. 0.01, 0.03, and 0.05). The phase delay 420 of frequency response as a function of frequency 416 with different $\beta_2$ are shown in the plot 446 of FIG. 68. The parameters $T_M$, $\beta_1$, and $\beta_3$ were kept constant at their nominal values of 0.1 seconds, 2000, and 0.5, respectively.

Figure 69:
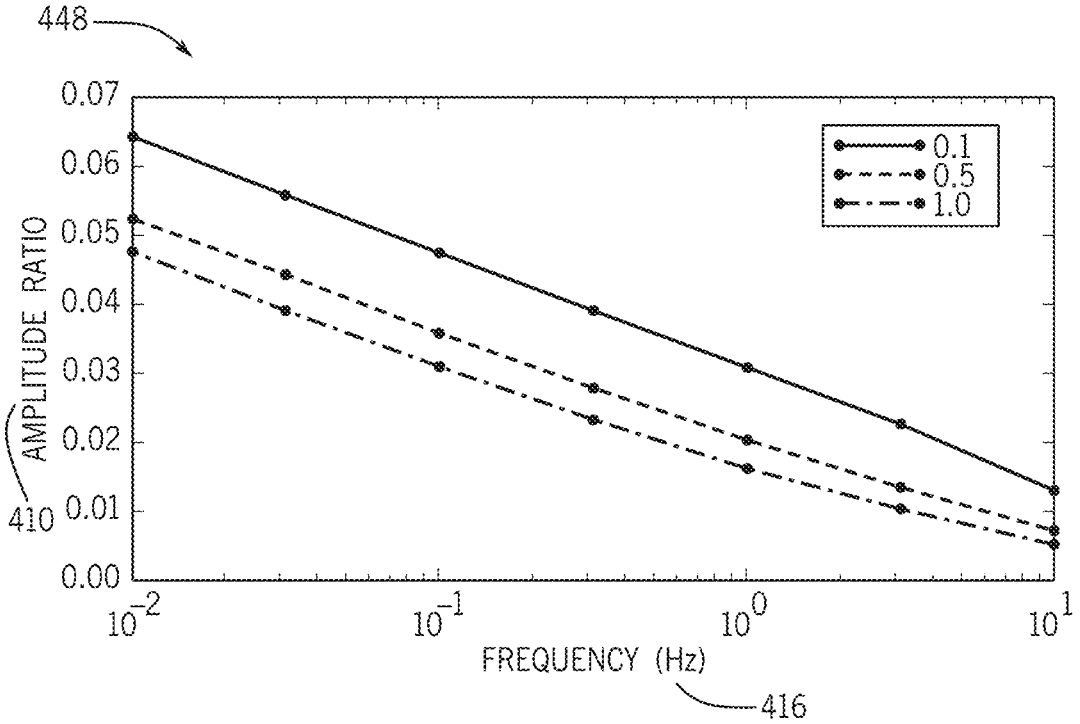
FIG. 69 is a representative plot of amplitude ratio as a function of frequency, representing the pressure response for different values of the parameter $\beta_3$, in accordance with an embodiment
Figure 70:
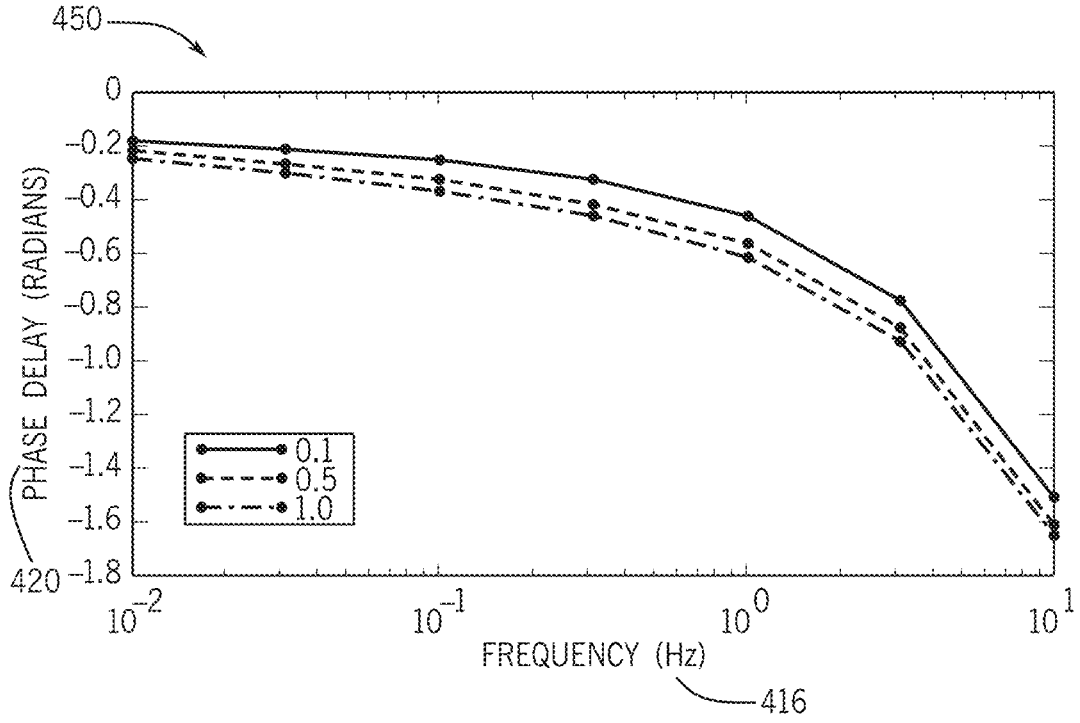
FIG. 70 is a representative plot of phase delay as a function of frequency, representing the pressure response for different values of the parameter $\beta_3$, in accordance with an embodiment

FIGS. 69 and 70 show plots 448 and 450, respectively, of the influence of the parameter $\beta_3$ on the frequency response. The plot 448 of FIG. 69 shows the amplitude ratio 410 of frequency response as a function of frequency 416 with $\beta_3$ having different values (e.g. 0.1, 0.5, and 1.0). The phase delay 420 of frequency response as a function of frequency 416 with different $\beta_2$ are shown in the plot 450 of FIG. 70. For this case, the parameters $T_M$, $\beta_1$, and $\beta_2$ were kept constant at their nominal values of 0.1 seconds, 2000, and 0.03, respectively. Therefore, as shown in FIGS. 63-70, the pressure response is sensitive to each of the parameters $T_M$, $\beta_1$, $\beta_2$, and $\beta_3$.

In certain embodiments, the parameters may be multicolinear. That is, the parameters may be highly correlated with respect to each other. In this particular embodiment, a design matrix for the parameters is singular and may not be inverted, or only a subset of the parameter set may be estimated with a desired degree of accuracy. Therefore, a correlation matrix of the parameters $T_M$, $\beta_1$, $\beta_2$, and $\beta_3$ may be calculated to identify which parameters may be accurately estimated. For example, for non-linear parameter estimation, a covariance matrix is $C \equiv 2H^{-1}$, where H is the Hessian matrix expressed as follows:

$$H = \frac{\partial^2\chi^2}{\partial\beta_k\partial\beta_l} \approx 2W_1\sum_i \frac{1}{\sigma_i^2}\left[\frac{\partial y(\omega_i\,|\,\beta)}{\partial\beta_k}\frac{\partial y(\omega_i\,|\,\beta)}{\partial\beta_l}\right] + \quad \text{EQ. 42}$$

-continued $$2W_2\sum_j \frac{1}{\sigma_j^2}\left[\frac{\partial z(\omega_j|\beta)}{\partial \beta_k}\frac{\partial z(\omega_j|\beta)}{\partial \beta_l}\right]$$

and the least-squared misfit function to be minimized is expressed as follows:

$$\chi^2(\beta) = W_1\sum_i\left[\frac{y_i - y(\omega_i|\beta)}{\sigma_i}\right]^2 + W_2\sum_j\left[\frac{z_j - z(\omega_j|\beta)}{\sigma_j}\right]^2 \quad \text{EQ. 43}$$

where $y(\omega|\beta)$ is the amplitude ratio data, $z(\omega|\beta)$ is the phase lag data, and $W_i$ is the weight given to each parameter. The amplitude ratio data and the phase lag data may be used such that the estimated parameters minimize the combined weight misfits of the two data sets. Since the amplitude ratio and the phase delay may have similar magnitude within a frequency range of interest, the weights, $W_1$ and $W_2$, may be set to the same value. The data may be measured at discrete frequencies, $\omega_i$, and $\beta_i$ is one of the four parameters $T_M$, $\beta_1$, $\beta_2$, and $\beta_3$. The correlation matrix may provide an indication of whether the correlation between some of the parameters is close to unity (singular) if any of the parameters are inverted. This may allow accurate estimation of the parameters $T_M$, $\beta_1$, $\beta_2$, and $\beta_3$. However, if only two of the parameters are inverted (e.g., $T_M$ and $\beta_1$), the correlations matrix may indicate that the two inverted parameters have enough independency for accurately estimating the parameters. The frequencies for calculating the correlation matrix were chosen to be 0.01, 0.1, 1, and 10 Hz. Nominal values of the parameters may be used to calculate Jacobian matrix (first-order derivatives) and are $T_M$=0.1 s$\beta_1$=2000, $\beta_2$=0.03, and $\beta_3$=0.5. The calculated correlation matrix for the four parameters is shown below.

$$\begin{bmatrix} 1 & 0.98 & -0.98 & -0.98 \\ 0.98 & 1 & -1.00 & -1.00 \\ -0.98 & -1.00 & 1 & 1.00 \\ -0.98 & -1.00 & 1.00 & 1 \end{bmatrix}$$

As shown in the matrix, the parameter $\beta_3$ is strongly correlated to $\beta_2$. Therefore, the parameter $\beta_3$ may be removed from the list of parameters to be estimated. Accordingly, only the parameters $T_M$, $\beta_1$, and $\beta_2$ are considered, for which the correlation matrix for these three parameters is shown below.

$$\begin{bmatrix} 1 & -0.04 & 0.32 \\ -0.04 & 1 & -092 \\ 0.32 & -0.92 & 1 \end{bmatrix}$$

The above 3×3 correlation matrix for the parameters $T_M$, $\beta_1$, and $\beta_2$ indicates a strong anti-correlation between $\beta_2$ and $\beta_1$, even after removing $\beta_3$. Accordingly, $\beta_2$ is removed from the correlation matrix, thereby resulting in a 2×2 correlation matrix shown below for the parameters $T_M$ and $\beta_1$.

$$\begin{bmatrix} 1 & 0.66 \\ 0.66 & 1 \end{bmatrix}$$

In the following example, two parameters, $T_M$ and $\beta_1$, may be inverted using the least squared inversion corresponding to EQ. 43. Modified model parameters $\alpha$=[$10T_M$, $\log_{10}\beta_1$, $100\beta_2$, $10\beta_3$] are used. Using the modified model parameters may provide a comparable value of derivatives. Scaling however does not affect the correlation value between the two variables. In theory, both amplitude ratio and phase lag data are useful for calculating inversion of the parameters. However, in certain embodiments, the phase lag data may be omitted due, in part, to cycle skipping, which may result in inversion instability. For example, cycle-skipping, meaning that phase-lag extends beyond 2π radians, may lead to inaccurate identification of phase lag value.

Figure 71:
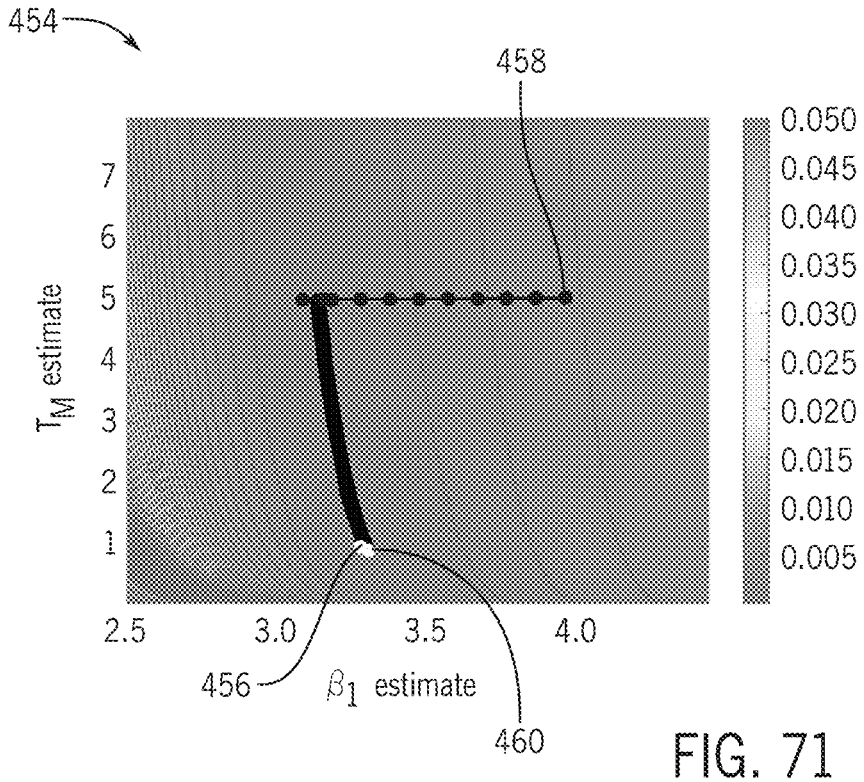
FIG. 71 is a representative plot of a two parameter estimation for estimated $T_M$ and $\beta_1$ using two parameter estimation based on modeled data having 5% noise, in accordance with an embodiment.

In certain embodiments, non-linear inversion analysis (e.g., Gradient, Newton or Levenberg-Marquardt methods) may also be used to estimate the parameters $T_M$, $\beta_1$, $\beta_2$, and $\beta_3$. For example, FIG. 71 is a plot 454 for inversion of $T_M$ and $\beta_1$ using gradient analysis. A 5% Gaussian noise was added to the model to generate modeled data. The initial values for $T_M$ and $\beta_1$ are 0.5 seconds and 10000, respectively. The values of $T_M$ and $\beta_1$ estimated from the gradient analysis 0.094 seconds and 2111, respectively, which are near the true values of the parameters (e.g., $T_M$=0.1 seconds and ($\beta_1$=2000). In the illustrated plot 454, point 456 is the true value, point 458 is the starting value, and point 460 is the estimated value. The shading and contours in the plot 454 indicate the least-square misfit error considering only the amplitude ratio expressed in EQ. 43. As shown in Table 2 below, the inversion of the parameters $T_M$ and $\beta_1$ provides stable results using modeled data having different amounts of noise when using the non-linear analysis.

TABLE 2

Parameter estimation of $T_M$ and $\beta_1$

| Percentage of Noise (%) | Estimated $T_M$ (s) | Estimated $\beta_1$ | True Value of $T_M$ | True Value of $\beta_1$ |
|---|---|---|---|---|
| 1 | 0.1004 ± 0.0028 | 2006 ± 22 | 0.1 | 2000 |
| 2 | 0.096 ± 0.005 | 2030 ± 45 | | |
| 5 | 0.102 ± 0.01 | 1992 ± 120 | | |
| 10 | 0.132 ± 0.08 | 2032 ± 390 | | |

Figure 72:
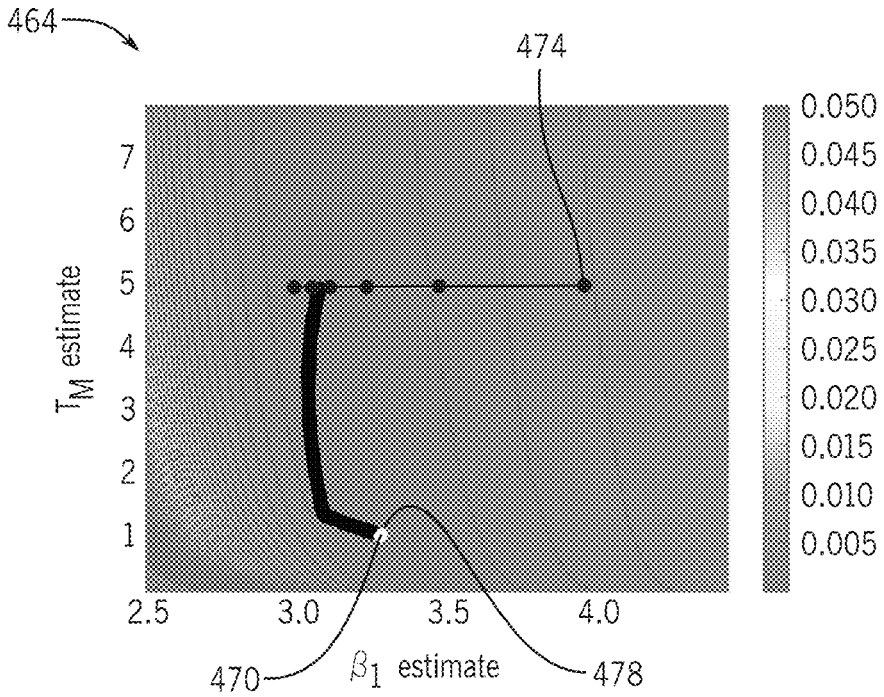
FIG. 72 is a representative plot of a three parameter estimation for estimated $T_M$ and $\beta_1$ using three parameter estimation based on noise-free modeled data, in accordance with an embodiment.
Figure 73:
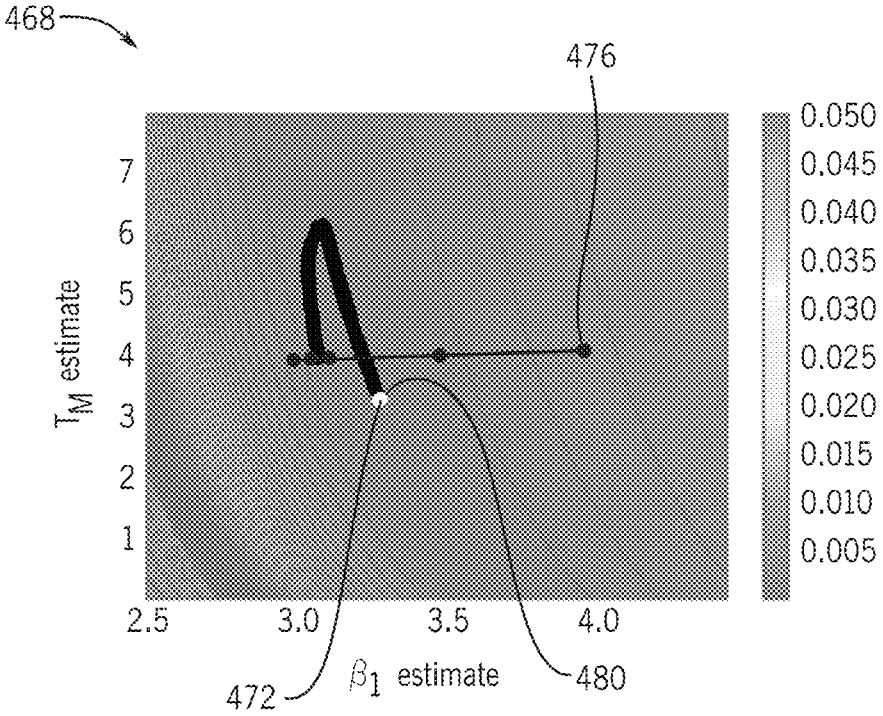
FIG. 73 is a representative plot of a three parameter estimation for estimated $\beta_1$ and $\beta_2$ using three parameter estimation based on noise-free modeled data, in accordance with an embodiment.

The additional parameters may also be estimated using the gradient analysis. For example, FIGS. 72 and 73 illustrate plots 464, 468, respectively, used to estimate three parameters simultaneously using noise-free modeled data. The parameters were accurately estimated with the noise-free modeled data. However, the number of iterations needed to reach the minimum value of the misfit function is increased compared to inversion with two parameters. In the embodiments illustrated in FIGS. 72 and 73, approximately 10 times more iterations were need to reach the minimum value of the misfit function (not all of the intermediate points are shown for brevity). Similar to the plot 454, points 470, 472 represent the true value of the parameter, points 474, 476 represent starting value, and points 478, 480 represent the estimated value for the parameters in plots 464, 468, respectively.

Figure 74:
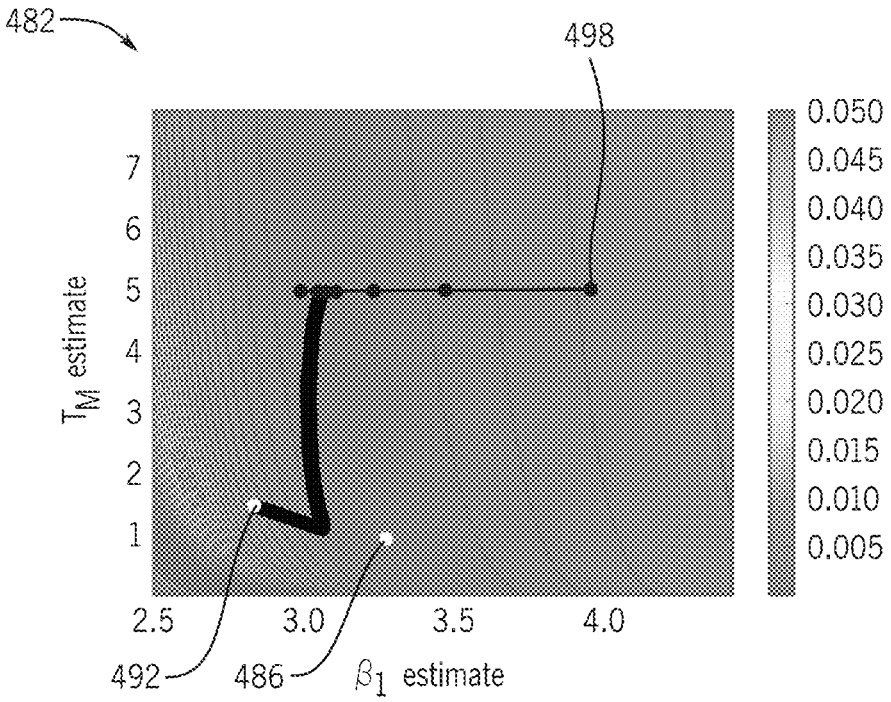
FIG. 74 is a representative plot of a three parameter estimation for estimated $T_M$ and $\beta_1$ using three parameter estimation based on modeled data having 5% noise, in accordance with an embodiment.
Figure 75:
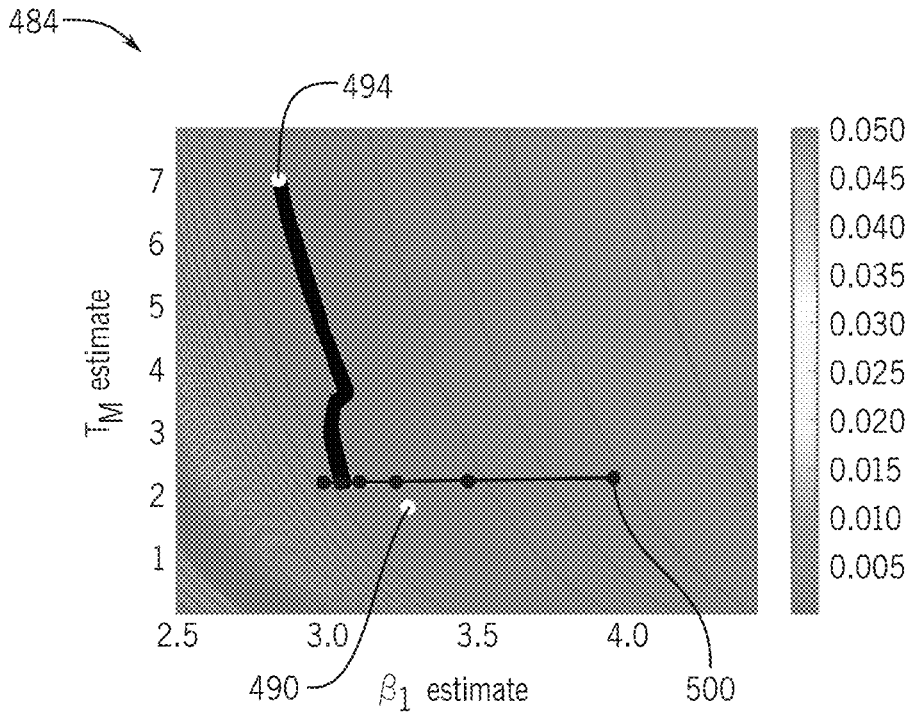
FIG. 75 is a representative plot of a three parameter estimation for estimated $\beta_1$ and $\beta_2$ using three parameter estimation based on modeled data having 5% noise, in accordance with an embodiment.

When using noisy modeled data to estimate the more than two parameters, the inversion results in inaccurate estimates. For example, FIGS. 74 and 75 illustrate plots 482, 484, respectively, of estimated parameters using modeled data having 5% noise. As shown in plots 482, 484 the estimate for parameters are far off from the true values, even after 2,000,000 iterations. For example, in the plots 482, 484, the point 486, 490 represents the true value of the parameters, point 492, 494 represents the estimated value, and points 498, 500 represent the staring value, respectively. As shown in the plots 482, 484, $T_M$ is 0.153 seconds, which is far from the true value of 0.1 seconds, $\beta_1$ is estimated to be 706 and the true value is 2000,and $\beta_2$ is estimated to be 0.091 and the true value is 0.035. Therefore, only two parameters (e.g., $T_M$ and $\beta_1$) can be estimated at a time.

Once $T_M$ and $\beta_1$ are estimated, other petrophysical parameters incorporated in $T_M$ and $\beta_1$ may be calculated. By using EQs. 34 and 35, it may be assumed that the wellbore radius $r_w$ may be measured (e.g., drilling and caliper data) and the mud filter cake thickness ($r_w$–$r_m$) may be obtained from other tools (e.g., density and dielectric tools). Accordingly, the diffusivity of the fluid in the mud filter cake, $D_m$, may be determined from EQ. 34. The mud filter cake porosity, $\phi_m$, may be determined from mud filter cakes experiments at surface, for the same differential pressure across a filter paper as in downhole conditions. If the shear coefficient of viscosity, $\mu$, and the compressibility, c, for a given filtrate fluid are known, the mud filter cake permeability, $k_m$, may be determined. Consequently, the formation permeability, $k_f$, may be estimated based on the mud filter cake permeability and the estimated parameter $\beta_1$. In this way, the natural oscillations in the wellbore may be used to determine wellbore and mud filter cake properties.

As discussed above, the amplitude and phase-lag response of the formation pressure to the wellbore pressure variation as a function of frequency may be used to determine the characteristic time of diffusion across the mud filter cake and the mobility ratio of the formation to the mud filter cake. For example, by accurately estimating the parameters $T_M$ and $\beta_1$, mud filter cake and formation permeability may be determined. Knowing the formation permeability, an operator of the wellbore may be able to characterize the producibility of the reservoir containing the wellbore. Moreover, it has now been recognized that applying filters based on identified spectral characteristics of the formation pressure data may improve the accuracy of formation pressure estimates during formatting testing applications. For example, because the mud-cake may not isolate the wellbore pressure from the formation pressure, the changes in fluid levels within the wellbore may result in oscillations in the formation pressure. Therefore, an accurate estimate of the formation pressure may be difficult to obtain using extrapolation techniques. However, by applying filters associated with identified spectral characteristics of the formation pressure, the oscillations may be removed and the formation pressure may be accurately determined using extrapolation techniques.

In essence, the above frequency response analysis of the formation and wellbore pressures may yield multiple properties of the geological formation 20 and/or wellbore 14 (e.g., pressure diffusivity and permeability). As such, the same pressure variations and frequencies that may be desired to be filtered out in some scenarios to determine certain useful properties of the geological formation 20 and/or wellbore 14, may indeed be useful in determining other properties. Furthermore, such methods for may be performed separately or concurrently.

The specific embodiments described above have been shown by way of example, and it should be understood that these embodiments may be susceptible to various modifications and alternative forms. It should be further understood that the claims are not intended to be limited to the particular forms discloses, but rather to cover modifications, equivalents, and alternatives falling within the spirit of this disclosure.

The invention claimed is:

1. A system, comprising:

a downhole acquisition tool housing comprising a packer and one or more sensors configured to measure at least one measurement of a geological formation of a hydrocarbon reservoir, a wellbore within the geological formation, or both, wherein at least one sensor of the one or more sensors is configured to measure the at least one measurement at a first region within the wellbore that is longitudinally offset from a second region corresponding to the packer while the packer is set, and wherein the at least one measurement comprises oscillations corresponding to a mud-cake permeability, wherein the at least one measurement is a pressure or a frequency spectrum of the pressure; and a data processing system comprising one or more tangible, non-transitory, machine-readable media comprising instructions configured to:

receive the at least one measurement from the downhole acquisition tool;

determine one or more parameters associated with an oscillation suppression process based at least in part on the at least one measurement;

attenuate one or more frequencies associated with the oscillations in the at least one measurement;

retain frequency components of the at least one measurement having an amplitude above a threshold amplitude to generate a modified measurement; and estimate a formation production parameter based at least in part on the modified measurement, wherein the modified measurement is a pressure measurement.

2. The system of claim 1, wherein the data processing system is configured to determine a filter parameter of one or more non-linear filters to attenuate the one or more frequencies.

3. The system of claim 2, wherein the one or more non-linear filters comprises a Wiener-E filter, and wherein the filter parameter comprises mean absolute deviation values, mean pressure values, or both.

4. The system of claim 1, wherein the one or more sensors comprises a strain gauge, quartz gauge, or both.

5. The system of claim 1, wherein the data processing system is disposed within the downhole acquisition tool housing or outside the downhole acquisition tool housing at a wellbore surface.

* * * * *